US011730662B2

(12) United States Patent
Le et al.

(10) Patent No.: US 11,730,662 B2
(45) Date of Patent: Aug. 22, 2023

(54) MASSAGE CHAIRS HAVING MASSAGE APPARATUSES FOR LEGS AND FEET AND FOR HANDS AND ARMS

(71) Applicants: Kevin Le, Arlington, TX (US); Thanh Le, Arlington, TX (US); Matthew Palmore, Grand Prairie, TX (US)

(72) Inventors: Kevin Le, Arlington, TX (US); Thanh Le, Arlington, TX (US); Matthew Palmore, Grand Prairie, TX (US)

( * ) Notice: Subject to any disclaimer, the term of this patent is extended or adjusted under 35 U.S.C. 154(b) by 699 days.

(21) Appl. No.: 16/840,454

(22) Filed: Apr. 6, 2020

(65) Prior Publication Data

US 2021/0161755 A1 Jun. 3, 2021

Related U.S. Application Data

(63) Continuation-in-part of application No. 15/415,822, filed on Jan. 25, 2017, now Pat. No. 10,842,708.

(51) Int. Cl.
*A61H 15/00* (2006.01)
*A61H 39/04* (2006.01)
(Continued)

(52) U.S. Cl.
CPC ..... *A61H 15/0078* (2013.01); *A61H 9/005* (2013.01); *A61H 9/0078* (2013.01);
(Continued)

(58) Field of Classification Search
CPC ..... A61H 7/00; A61H 7/002; A61H 7/004; A61H 7/007; A61H 15/00; A61H 15/0078; A61H 15/02; A61H 2015/0007; A61H 2015/0014; A61H 2015/0042; A61H 2015/0021; A61H 2201/0149; A61H 2201/0207; A61H 2201/1215; A61H 2201/1238; A61H 2201/164;
(Continued)

(56) References Cited

U.S. PATENT DOCUMENTS 7,717,868 B2 * 5/2010 Inada ..... A61H 9/0078 601/149
2005/0033204 A1 * 2/2005 Nakamura ..... A61H 23/04 601/103
(Continued)

*Primary Examiner* — Colin W Stuart
(74) *Attorney, Agent, or Firm* — Norred Law, PLLC; Warren V. Norred; Alec Turung

(57) ABSTRACT

One aspect of the present invention is different embodiments of legs and feet massage apparatuses for providing massage effects to the legs and/or feet of a user. Another aspect is different embodiments of hands and arms massage apparatuses for providing massage effects to the arms and/or hands of the user. Additional aspect is an armrest sliding adjustment apparatus. A further aspect is a bicep and tricep panel sliding adjustment apparatus. Additional aspect is a chair that includes at least one of the following devices, apparatuses and systems described in this application: any of the legs and feet massage apparatuses; any of the hands and arms massage apparatuses; an armrest sliding adjustment apparatus; a bicep and tricep panel sliding adjustment apparatus; a neck and shoulder massage system; an integrated smart medical device; at least one health monitoring device or system; a virtual reality device; and a touchscreen-based control system.

30 Claims, 56 Drawing Sheets

(51) Int. Cl.
*A61H 9/00* (2006.01)
*A61H 15/02* (2006.01)

(52) U.S. Cl.
CPC ..... *A61H 15/02* (2013.01); *A61H 39/04* (2013.01); *A61H 2015/0021* (2013.01); *A61H 2201/0149* (2013.01); *A61H 2201/0207* (2013.01); *A61H 2201/1215* (2013.01); *A61H 2201/1238* (2013.01); *A61H 2201/164* (2013.01); *A61H 2201/1669* (2013.01); *A61H 2201/5046* (2013.01); *A61H 2201/5082* (2013.01); *A61H 2203/0431* (2013.01); *A61H 2205/06* (2013.01); *A61H 2205/065* (2013.01); *A61H 2205/106* (2013.01); *A61H 2205/12* (2013.01); *A61H 2230/06* (2013.01); *A61H 2230/202* (2013.01); *A61H 2230/207* (2013.01); *A61H 2230/30* (2013.01); *A61H 2230/50* (2013.01)

(58) Field of Classification Search
CPC .... A61H 2201/1669; A61H 2201/5046; A61H 2201/5082; A61H 2203/0425; A61H 2203/0431; A61H 2205/10; A61H 2205/106; A61H 2205/108; A61H 2205/12; A61H 2205/06; A61H 2205/065; A61H 9/005; A61H 9/0078; A61H 39/04; A61H 2230/06; A61H 2230/202; A61H 2230/207; A61H 2230/30; A61H 2230/50
See application file for complete search history.

(56) References Cited

U.S. PATENT DOCUMENTS

2005/0288612 A1* 12/2005 Suzuki ..... A61H 1/0266 601/134
2006/0069325 A1* 3/2006 Inada ..... A61H 9/0078 601/2
2006/0142676 A1* 6/2006 Fujii ..... A61H 7/007 601/99
2006/0293618 A1* 12/2006 Hsieh ..... A61H 7/00 601/134
2007/0287941 A1* 12/2007 Yoda ..... A61H 9/0078 601/151
2009/0177128 A1* 7/2009 Fukuyama ..... A61H 7/001 601/134
2009/0227912 A1* 9/2009 Enami ..... A61H 9/0078 601/49
2010/0198120 A1* 8/2010 Tago ..... A61H 1/0292 601/149
2010/0312155 A1* 12/2010 Fukuyama ..... A61H 9/0078 601/98

* cited by examiner

MASSAGE CHAIRS HAVING MASSAGE APPARATUSES FOR LEGS AND FEET AND FOR HANDS AND ARMS

CROSS-REFERENCE TO RELATED APPLICATIONS

The present application is a continuation-in-part application of and claims the priority benefit of U.S. Nonprovisional Patent Application Ser. No. 15/415,822, filed on Jan. 25, 2017 and titled "MASSAGE APPARATUS FOR LEGS AND FEET AND MASSAGE CHAIR HAVING THE MASSAGE APPARATUS," which is incorporated herein by reference in its entirety.

BACKGROUND OF THE INVENTION

Field of the Invention

The present invention generally relates to massage chairs and massage devices, apparatuses and systems for chairs, such as, but not limited to, massage chairs. More specifically, as one aspect of the present invention, the invention is directed to different embodiments of legs and feet massage apparatuses for providing massage benefits or effects to the legs and/or feet of a user. As another aspect of the present invention, the invention is directed to different embodiments of hands and arms massage apparatuses for providing massage benefits or effects to the arms and/or hands of the user. As an additional aspect of the present invention, the invention is directed to an armrest sliding adjustment apparatus to accommodate users of different heights and/or of different upper body lengths. As a further aspect of the present invention, the invention is directed to a bicep and tricep panel sliding adjustment apparatus to accommodate users of different heights and/or of different upper body lengths. As an additional aspect of the present invention, the invention is directed to a chair, such as, but not limited to, a massage chair, that comprises at least one of the following devices, apparatuses and systems described in this application: any of the legs and feet massage apparatuses; any of the hands and arms massage apparatuses; an armrest sliding adjustment apparatus; a bicep and tricep panel sliding adjustment apparatus; a neck and shoulder massage system; an integrated smart medical device; at least one health monitoring device or system; a virtual reality device; and a touchscreen-based control system.

Description of the Related Art

Massage chairs and massage devices, apparatuses and systems for massage chairs are known in the art.

There are a number of patents, published patent applications, and/or non-patent publications directed at massage chairs and massage devices, apparatuses and systems for massage chairs that show, describe and/or teach massage benefits or effects being provided to an upper body area, such as a back body area, of a user. Further, there are a number of patents, published patent applications, and/or non-patent publications directed at massage chairs and massage devices, apparatuses and systems for massage chairs that show, describe and/or teach massage benefits or effects being provided to the legs, feet, hands and arms of users.

The present invention overcomes one or more of the shortcomings of massage chairs and massage devices, apparatuses and systems for chairs, such as, but not limited to, massage chairs. One of the limitations of traditional legs, feet, arms and/or hands massage is using air massage technique. The present invention focuses on a roller massage technique that is believed to provide more and/or better benefit(s) to the user. It's more like acupressure by human fingers on the user. In comparison to traditional air massage technique, the roller massage technique of the present invention is believed to provide better blood circulation, better sleep, better relaxation, greater relief of body pains, better mood improvement, and/or better depression fighting improvement. The combination of roller massage technique and air massage technique of the present invention is preferred. Air massage is used to control the intensity of the roller massage. Preferably, heat is applied to some, most or all of the rollers (such as, but not limited to, large and small rollers of the present invention) and/or accupressure points of the present invention to help blood circulation of the user. The installation of the massage roller system to the footrest or foot frame and armrest or arm panel is more complicated in comparison to installation of traditional air massage. It requires major modifications from traditional or common foot and arm installation (e.g., mounting, supporting frame, power wiring, safety, etc.)." As a non-limiting example to enhance relaxation, the user can enjoy massage according to the present invention with the use of a virtual reality device. The Applicant is unaware of inventions or patents, taken either singly or in combination, which are seen to describe the present invention as claimed.

SUMMARY OF THE INVENTION

As one aspect of the present invention, the invention is directed to a legs and feet massage apparatus for providing massage benefits or effects to the legs and/or feet of a user.

As a non-limiting example, the legs and feet massage apparatus comprises: a frame; a feet massage roller assembly; two sets of calf massage devices; and a pair of limit sensors.

The frame includes a pair of opposing guide rails, an upper connecting bar, and a lower connecting bar.

Each guide rail includes an upper or first end, a lower or second end, an upper or vertical section located adjacent the upper end, a lower or horizontal section located about the lower end, a bend section connecting the vertical section and horizontal section of the corresponding guide rail, an outer side, an inner side, and a guide channel extending from the vertical section into the horizontal section and running along the inner side of the guide rail. The guide channel includes a plurality of gear teeth for engaging with a plurality of driving gears of a plurality of feet massage roller devices when the plurality of feet massage roller devices move upwardly, or alternatively downwardly, in a generally vertical direction along the vertical section and bend section from the upper ends toward the lower ends of the guide rails and vice versa, respectively, and moves forwardly, or alternatively rearwardly, in a generally horizontal direction along the horizontal section.

Each of the upper connecting bar and lower connecting bar has a first end, a second end, and a body portion extending from the first end to the second end, respectively. The upper connecting bar is secured, attached, fastened, fixed or mounted to the upper ends of the guide rails, while the lower connecting bar is secured, attached, fastened, fixed or mounted to the lower ends of the guide rails. The upper connecting bar and lower connecting bar help to stabilize the frame and the positioning of the guide rails relative to one another.

The feet massage roller assembly includes: a plurality of feet massage roller devices; a worm gear device; and a motor. The plurality of feet massage roller devices may be moved along the guide channels of the pair of guide rails by the motor powering the worm gear device to rotate the plurality of feet massage roller devices such that the plurality of feet massage roller devices move along the guide channels while also providing massage benefits or effects to the bottoms or soles of the feet and backsides of the ankles and calves of the user.

Each feet massage roller device has a first end with a rotational shaft that is connected to the worm gear device, a second end that has a plurality of driving gears for engaging with the corresponding guide channel of the guide rails, and a main massage roller positioned between the first end and second end of the feet massage roller device. Each main massage roller has a plurality of smaller massage rollers surrounding the outer surface of the main massage roller. Thus, preferably, the plurality of smaller massage rollers make contact with and provide massage benefits or effects to the bottom or sole of the feet and backside of the ankle and calves of the user as the plurality of feet massage roller devices move along the guide channels of the guide rails.

The worm gear device is in communication with or connected to the motor such that the worm gear device is powered by the motor to rotate the plurality of feet massage roller devices via the rotational shafts wherein the plurality of feet massage roller devices can move along the guide channel.

The motor powers the worm gear device to rotate the plurality of feet massage roller devices via the rotational shafts wherein the plurality of feet massage roller devices can move along the guide channels of the guide rails.

Each of the two sets of calf massage devices includes: a first or upper calf massage device and a second or lower calf massage device. Both of the upper calf massage device and lower calf massage device of each set are secured, attached, fastened, fixed or mounted to the vertical section of the corresponding guide rail such that, preferably, the upper calf massage devices face toward one another and the lower calf massage devices face toward one another.

Preferably, each of the upper calf massage devices and lower calf massage devices has an attachment plate, a wiring coil secured or attached to the inner side of the attachment plate, and a metal core or plunger secured or attached to the inner side of the wiring coil. Preferably, the wiring coil is an energized solenoid coil that produces linear movement of the corresponding metal core or plunger so that punching massage effects is provided to the calves of the user. Thus, preferably, the plurality of metal cores or plungers make contact with and provide punching massage benefits or effects to the sides of the calves of the user when the two sets of calf massage devices are in use.

Limit sensors control the traveling distance of the plurality of feet massage roller devices along the guide channels of the guide rails in either direction, and prevent the plurality of feet massage roller devices from exiting the guide channels at either end of the guide rails.

As an additional aspect of the present invention, the invention is directed to another legs and feet massage apparatus for providing massage benefits or effects to the legs and/or feet of a user.

As a first embodiment of this additional aspect, the legs and feet massage apparatus includes a legs and feet frame, a feet massage device (preferably motorized), and a calves massage device (preferably motorized). The legs and feet massage apparatus may also include a linear extension actuator, a linear sliding device, a pair of rotating wheels, a foot detection sensor/switch, a plurality of arrays or arrangements of fluid-actuated devices, and/or at least one pressure sensor related to fluid-actuated devices. Each array or arrangement of fluid-actuated devices is positioned about the corresponding side of a calf and/or corresponding side of a foot of the user during operation.

As other embodiments of this additional aspect, a massage apparatus related to the legs and/or feet includes a frame, and either the feet massage device (preferably motorized) or calves massage device (preferably motorized). Embodiments with either the feet massage device (preferably motorized) or calves massage device (preferably motorized) may or may not also include the linear extension actuator, linear sliding device, pair of rotating wheels, foot detection sensor/switch, a plurality of arrays or arrangements of fluid-actuated devices, and/or at least one pressure sensor related to fluid-actuated devices.

The legs and feet frame includes a pair of opposing guide bars, an upper connecting bar, and a lower connecting bar.

The feet massage device preferably includes a first or right foot massage device, a second or left foot massage device, a feet roller motor gearbox, a feet roller motor, and a driving, rotational shaft.

Each of the first or right and second or left foot massage devices includes a partial housing frame, a pair of plate guiders, a massage plate with raised accupressure points, shaft support bearings or bushings, a circular-to-linear motion translator, a pair of larger rollers mounted on the driving, rotational shaft, and smaller rollers of acupressure points located on or about the outer surface of the body of each larger roller.

Each massage plate has a first or front end, a second or rear end, a top surface, a bottom surface, a pair of sides, and raised accupressure points. The sides of the massage plate are positioned within the channel of the corresponding pair of plate guiders such that the massage plate, with the raised accupressure points, may be displaced, moved or slid forwardly, or alternatively rearwardly, during operation via the corresponding rotational direction of the driving, rotational shaft and large rollers.

The linear extension actuator can be extended from and/or retracted to an original position via the actuator motor.

The linear sliding device, along with the set of driving, rotational shaft, larger rollers, and smaller rollers of acupressure points, can be raised upwardly from and/or lowered downwardly to an original position via the linear extension actuator such that users of different heights or with different leg lengths can be accommodated on the same massage chair.

The foot detection sensor/switch allows for the adjustment of the footrest (combination of the legs and feet frame and linear sliding device) to fit with the user's height or leg length.

The calves massage device is preferably the same as or substantially similar (especially in structure and in function) to the feet massage device, and preferably includes a first or right calf massage device, a second or left calf massage device, a calves roller motor gearbox, a calves roller motor, and a driving, rotational shaft.

Each of the first or right and second or left calves massage devices includes a partial housing frame, a pair of plate guiders, a massage plate with raised accupressure points, shaft support bearings or bushings, a circular-to-linear motion translator, a pair of larger rollers mounted on the driving, rotational shaft, and smaller rollers of acupressure points located on or about the outer surface of the body of each larger roller.

Each massage plate related to calves massage devices has a first or front end, a second or rear end, a top surface, a bottom surface, a pair of sides, and raised accupressure points. The sides of the massage plate are positioned within the channel of the corresponding pair of plate guiders such that the massage plate, with the raised accupressure points, may be displaced, moved or slid upwardly, or alternatively downwardly, during operation via the corresponding rotational direction of the driving, rotational shaft and large rollers.

As a different embodiment of the legs and feet massage apparatus of this additional aspect, this different embodiment differs from the first embodiment in that it does not include the partial housing frames, pairs of plate guiders, massage plates with raised accupressure points, circular-to-linear motion translators, and a pair of rotating wheels. In addition, this different embodiment differs from the first embodiment in that it includes: a plate; a plurality of sets of driving, rotational shafts, larger rollers, smaller rollers of acupressure points, and shaft support bearings or bushings related to providing feet massage (instead of one set of driving, rotational shaft, larger rollers, smaller rollers of acupressure points, and shaft support bearings or bushings related to providing feet massage with regard to the first embodiment); and a plurality of sets of driving, rotational shafts, larger rollers, smaller rollers of acupressure points, and shaft support bearings or bushings related to providing calves massage (instead of one set of driving, rotational shaft, larger rollers, smaller rollers of acupressure points, and shaft support bearings or bushings related to providing calves massage with regard to the first embodiment).

In this non-limiting example of the different embodiment, there are three driving, rotational shafts related to feet massage that are positioned parallel to one another, operationally connected to one another by the system of pulley gears and belts with teeth, and run at the same speed. There are two driving, rotational shafts related to calves massage that are positioned parallel to one another, operationally connected to one another by the system of pulley gears and belt with teeth, and run at the same speed.

As a further aspect of the present invention, the invention is directed to a hands and arms massage apparatus for providing massage benefits or effects to the hands and/or arms of a user.

As a first embodiment of this further aspect, the hands and arms massage apparatus includes a pair of hand and arm massage devices (preferably motorized), two arrays or arrangements of fluid-actuated devices, and/or at least one pressure sensor related to fluid-actuated devices. Each array or arrangement of fluid-actuated devices is preferably positioned above a corresponding hand and arm massage device during operation.

As another embodiment of this further aspect, a massage apparatus related to the hand(s) and arm(s) includes one hand and arm massage device (preferably motorized), one array or arrangement of fluid-actuated devices (which is positioned above the hand and arm massage device during operation), and at least one pressure sensor related to fluid-actuated devices. As a further embodiment of this further aspect, a massage apparatus related to the hand(s) and arm(s) includes one or more hand and arm massage device (preferably motorized) but does not include any fluid-actuated device or any array or arrangement of fluid-actuated devices.

With regard to the first embodiment of this further aspect, the hand and arm massage devices are a first or right hand and arm massage device and a second or left hand and arm massage device wherein each of the massage devices is secured, attached, fastened, fixed or mounted to and supported by a corresponding armrest frame or arm panel.

Each of the first or right hand and arm massage device and second or left hand and arm massage device includes a partial housing frame, a pair of plate guiders, a massage plate with raised accupressure points, shaft support bearings or bushings, a circular-to-linear motion translator, a pair of larger rollers mounted on a driving, rotational shaft, smaller rollers of acupressure points located on or about the outer surface of the body of each larger roller, a hand and arm roller motor gearbox, and a hand and arm roller motor.

In use, with regard to providing massage benefits or effects to the hands and arms of the user, each of the first or right and second or left hand and arm massage devices can be activated for operation by the hand and arm roller motor activating or powering the hand and arm roller motor gearbox to rotate the second driving, rotational shaft and system of pulley gears and belt with teeth such that the first driving, rotational shaft, larger rollers, and the smaller rollers of acupressure points located on or about the outer surface of the body of each corresponding larger roller are also rotated and then able to provide massage benefits or effects to the hands and arms of the user. Each of the two arrays or arrangements of fluid-actuated devices provides roller massage intensity control of the massage to the corresponding hand and arm of the user.

As a different embodiment from the first embodiment of this further aspect, the hands and arms massage apparatus of this different embodiment differs in that the hands and arms massage apparatus does not include the pairs of plate guiders, massage plates with raised accupressure points, and circular-to-linear motion translators.

In addition, the hands and arms massage apparatus of this different embodiment differs in that it includes four sets of driving, rotational shafts, larger rollers, smaller rollers of acupressure points, shaft support bearings or bushings, and belts with teeth (instead of one set of driving, rotational shafts, larger rollers, smaller rollers of acupressure points, shaft support bearings or bushings, and belt with regard to the first embodiment).

The hands and arms massage apparatus of this different embodiment includes a pair of hand and arm massage devices (preferably motorized) and two arrays or arrangements of fluid-actuated devices. Each array or arrangement of fluid-actuated devices is positioned above a corresponding hand and arm massage device during operation.

As another embodiment of this further aspect, a massage apparatus related to the hand(s) and arm(s) includes one hand and arm massage device (preferably motorized), one array or arrangement of fluid-actuated devices (which is positioned above the hand and arm massage device during operation), and at least one pressure sensor related to fluid-actuated devices. As a further embodiment of this further aspect, a massage apparatus related to the hand(s) and arm(s) includes one or more hand and arm massage device (preferably motorized) but does not include any fluid-actuated device or any array or arrangement of fluid-actuated devices.

With regard to the different embodiment of this further aspect, the hand and arm massage devices are a first or right hand and arm massage device and a second or left hand and arm massage device wherein each of the massage devices is secured, attached, fastened, fixed or mounted to and supported by a corresponding armrest frame or arm panel.

Each of the first or right hand and arm massage device and second or left hand and arm massage device includes a partial housing frame, five driving, rotational shafts, shaft support bearings or bushings, larger rollers secured, attached, fastened, fixed or mounted on the driving, rotational shaft, smaller rollers of acupressure points located on or about the outer surface of the body of each larger roller, a hand and arm roller motor gearbox, and a hand and arm roller motor.

As an additional aspect of the present invention, the invention is directed to an armrest sliding adjustment apparatus for allowing at least one massage device directed to the biceps and triceps to be adjusted in a linear direction from one position to a second position to accommodate users of different heights and/or of different upper body lengths. The armrest sliding adjustment apparatus may be secured, attached, fastened, fixed or mounted to or about the sides of the seat or bottom body area portion of the chair frame.

The armrest sliding adjustment apparatus includes a pair of armrest sliding adjustment devices. Each armrest sliding adjustment device includes two plates, a sliding structure positioned between the two plates, and a latching device.

The first plate is secured, attached, fastened, fixed or mounted to a corresponding side of the seat or bottom body area portion of the chair frame, while the second plate is secured, attached, fastened, fixed or mounted to the armrest frame or arm panel. The sliding structure allows the sliding adjustment motion to be able to take place. The latching device locks the corresponding armrest frame or arm panel when it returns to the original position. Each of the armrest frames or arm panels is able to be slid between at least two positions.

As a further aspect of the present invention, the invention is directed to a bicep and tricep panel sliding adjustment apparatus for allowing at least one massage device directed to the biceps and triceps to be adjusted in a linear direction from one position to a second position to accommodate users of different heights and/or of different upper body lengths. The bicep and tricep panel sliding adjustment apparatus may be secured, attached, fastened, fixed or mounted to or about the sides of the back body area portion of the chair frame.

The bicep and tricep panel sliding adjustment apparatus includes a pair of bicep and tricep panel sliding adjustment devices. Each bicep and tricep panel sliding adjustment device includes two plates, a sliding structure positioned between the two plates, and a latching device.

The first plate is secured, attached, fastened, fixed or mounted to a corresponding side of the back body area portion of the chair frame, while the second plate is secured, attached, fastened, fixed or mounted to the bicep and tricep panel. The sliding structure allows the sliding adjustment motion to be able to take place. The latching device locks the corresponding bicep and tricep panel when it returns to the original position. Each of the bicep and tricep panel is able to be slid between at least two positions.

As an additional aspect of the present invention, the invention is directed to a chair, such as, but not limited to, a massage chair, that comprises at least one of the following devices, apparatuses and systems disclosed in this application: any of the legs and feet massage apparatuses; any of the hands and arms massage apparatuses; the armrest sliding adjustment apparatus; the bicep and tricep panel sliding adjustment apparatus; a neck and shoulder massage system; an integrated smart medical device; at least one health monitoring device or system; a virtual reality device; and a touchscreen-based control system. Preferably, heat is applied to some, most or all of the rollers (such as, but not limited to, large and small rollers of the present invention) and/or accupressure points that are components of at least one of the following devices, apparatuses and systems disclosed in this application to help blood circulation of the user.

It should be understood that the above-attached figures are not intended to limit the scope of the present invention in any way.

DETAILED DESCRIPTION OF THE PRESENT INVENTION

Referring to FIGS. 1-8 and as one aspect of the present invention, the invention is directed to a legs and feet massage apparatus 1 for providing massage benefits or effects to the legs and feet of a user (not shown in this embodiment) wherein the legs and feet massage apparatus 1 may be secured, attached, fastened, fixed or mounted to (as shown in FIGS. 9 and 18-20) a chair, preferably a massage chair.

As a non-limiting example, the legs and feet massage apparatus 1 comprises: a frame 10; a feet massage roller assembly 60 (preferably motorized); two sets of calf massage devices 80R, 80L; and a pair of limit sensors 96, 98.

Figure 1:
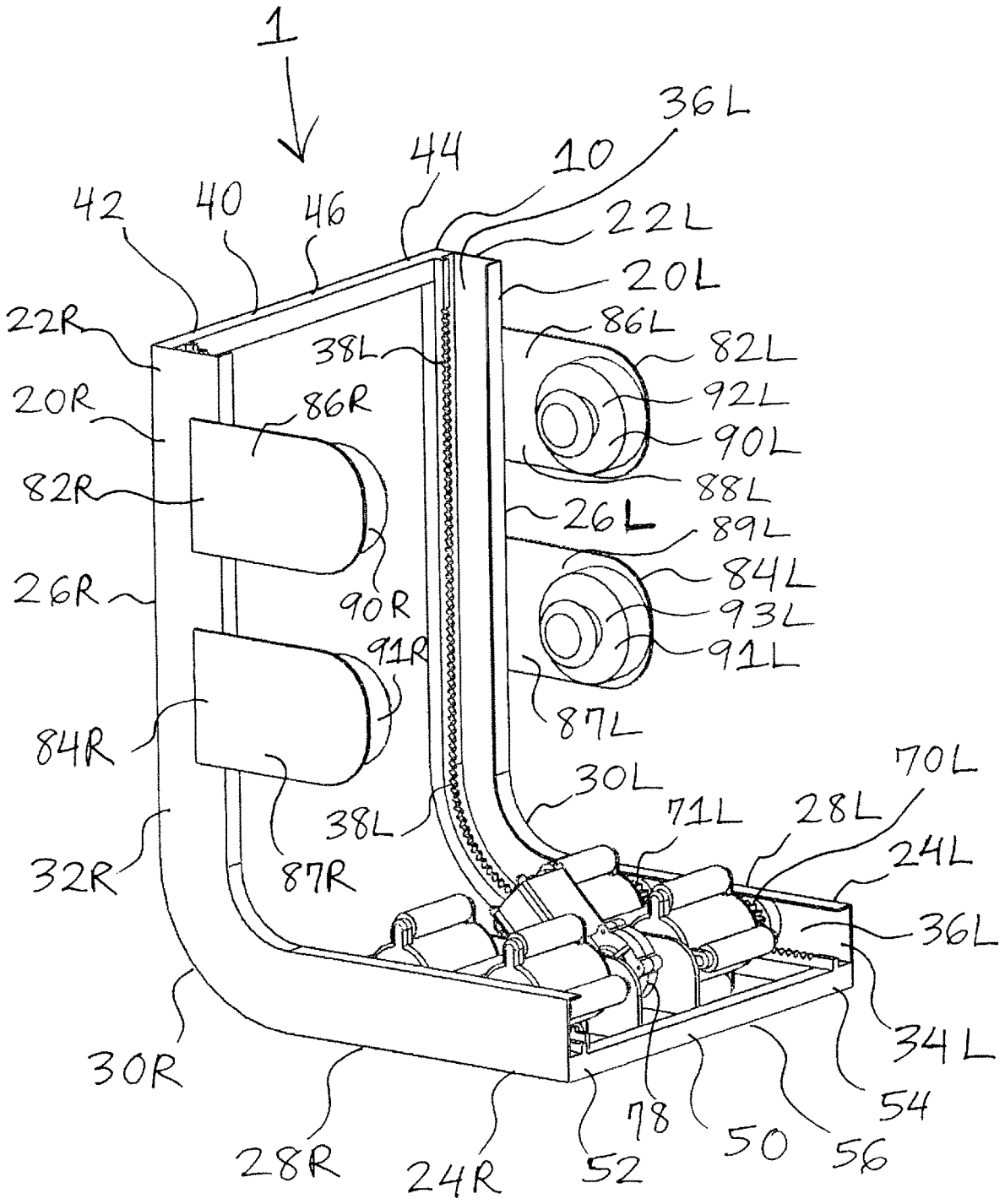
FIG. 1 is a front, right side, perspective view of an embodiment of a legs and feet massage apparatus according to the present invention.
Figure 2:
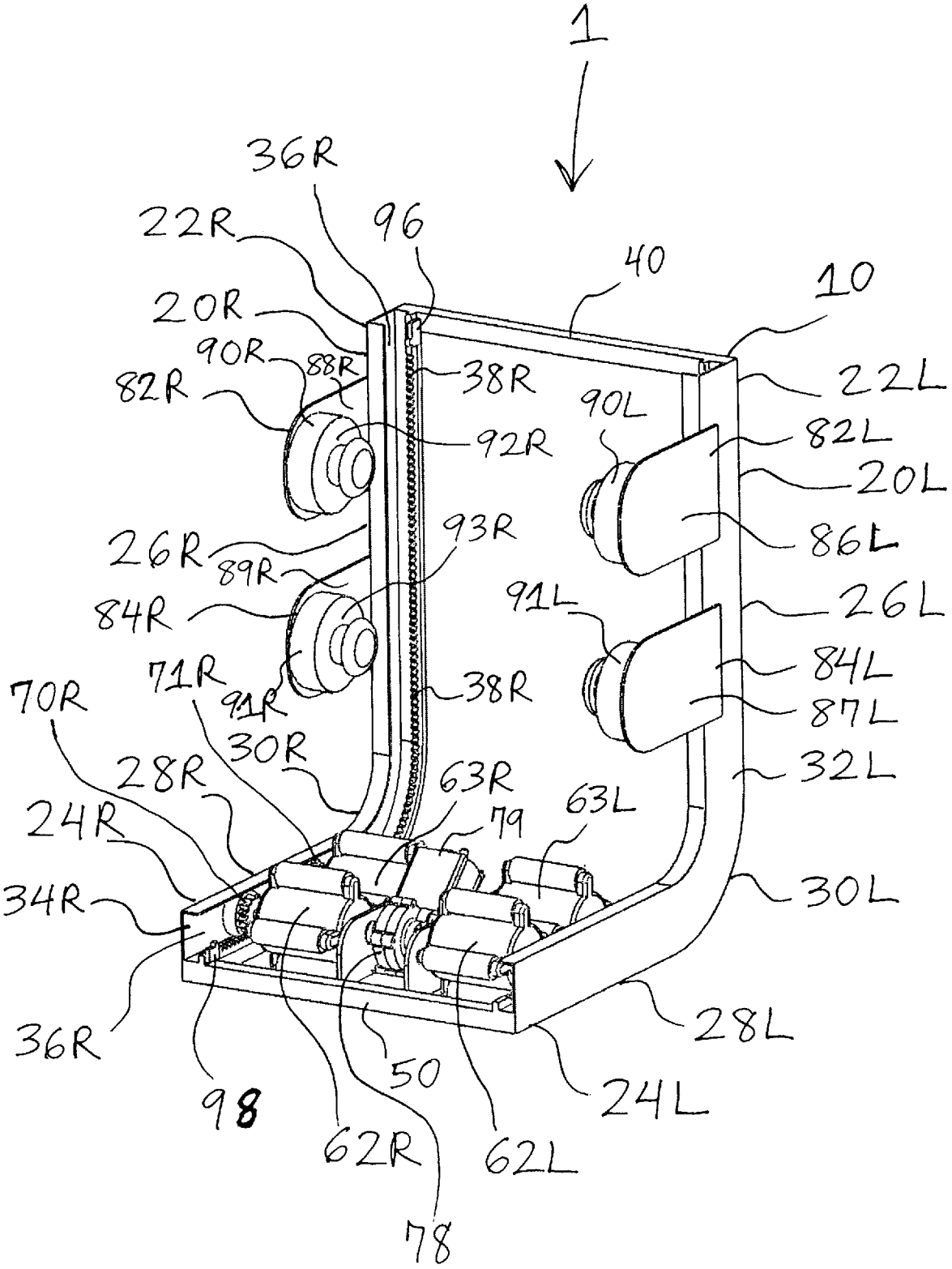
FIG. 2 is a front, left side, perspective view of the legs and feet massage apparatus of FIG. 1.
Figure 3:
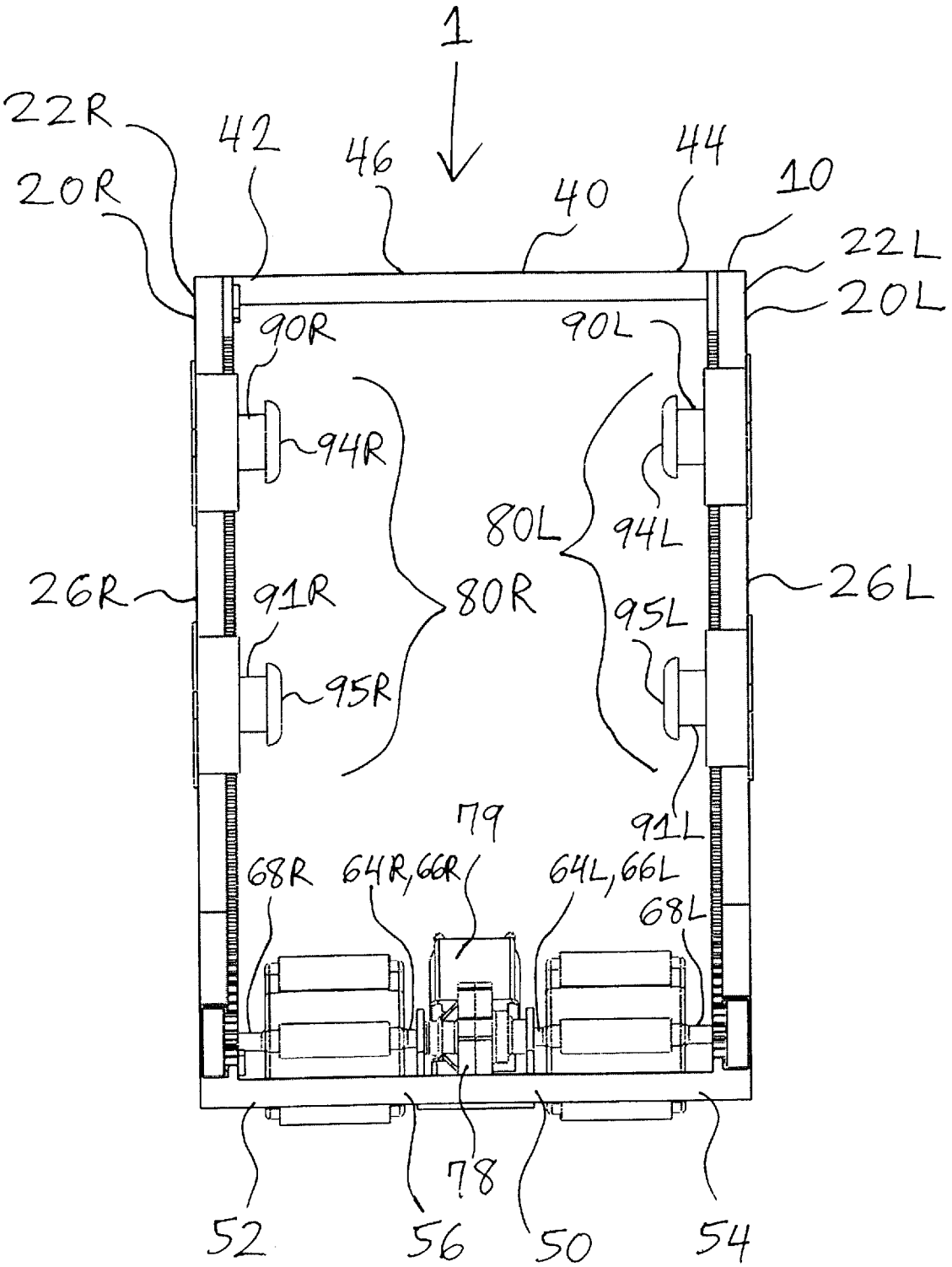
FIG. 3 is a front view of the legs and feet massage apparatus of FIG. 1.
Figure 4:
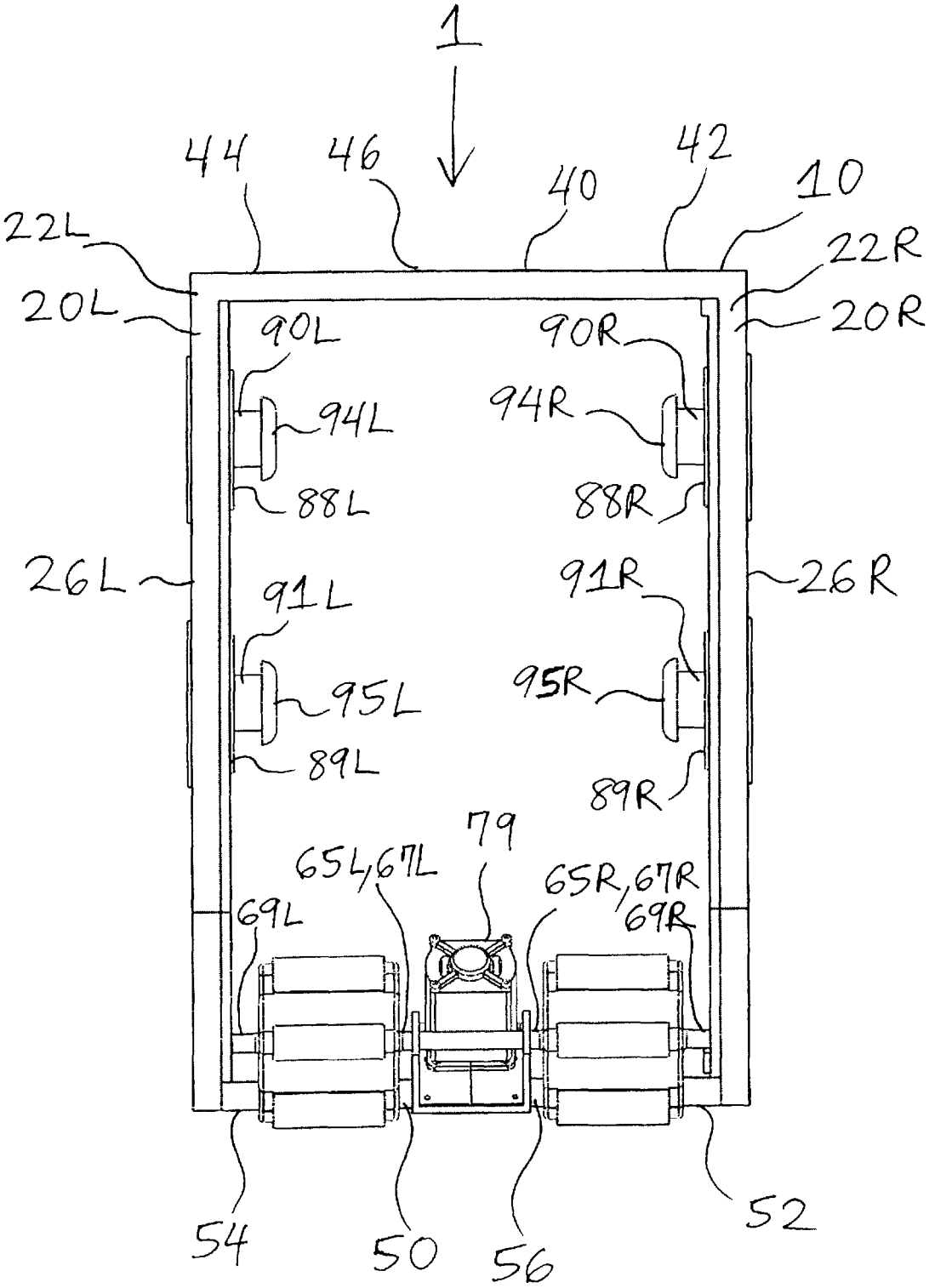
FIG. 4 is a rear view of the legs and feet massage apparatus of FIG. 1.
Figure 5:
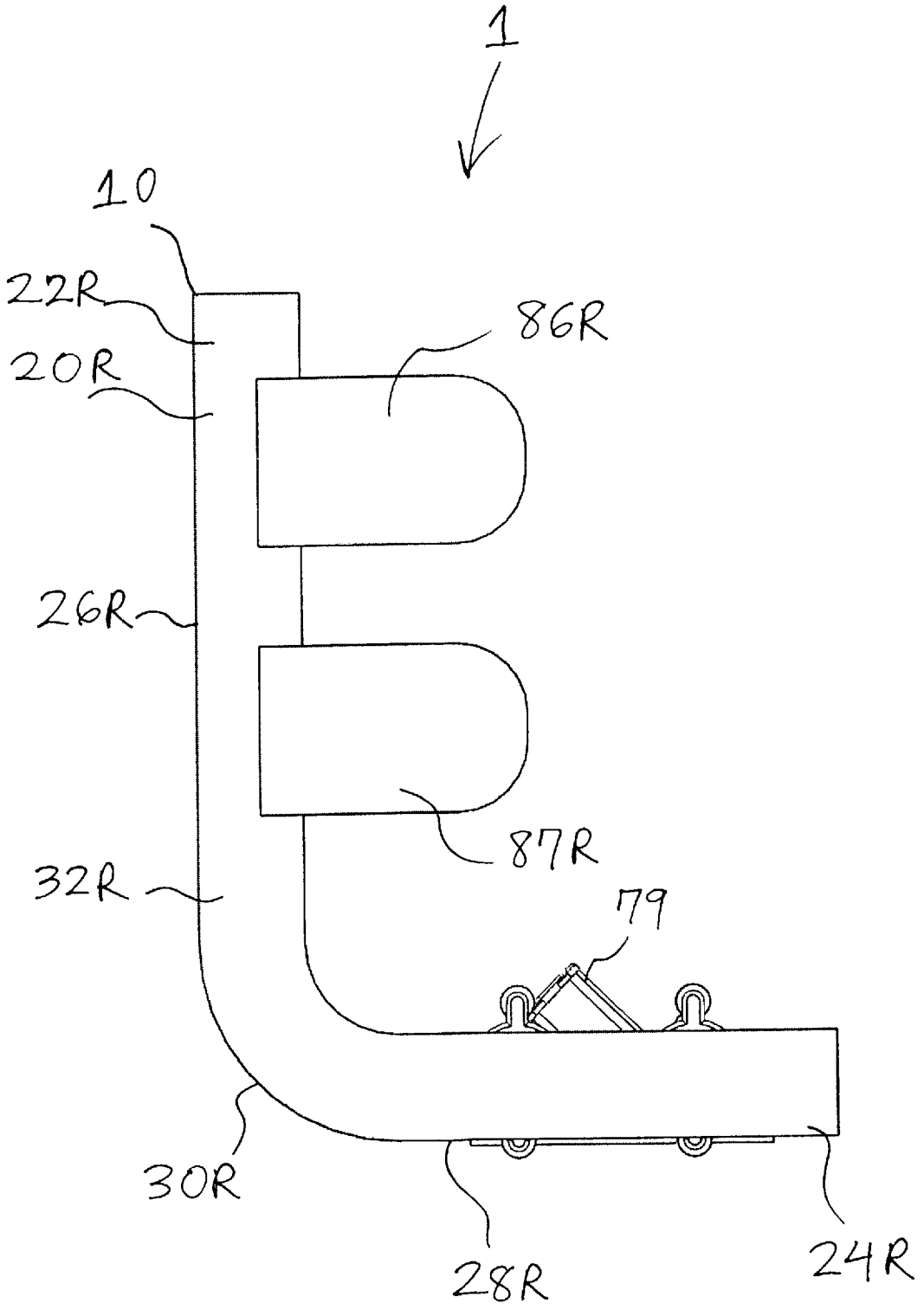
FIG. 5 is a right side view of the legs and feet massage apparatus of FIG. 1.
Figure 6:
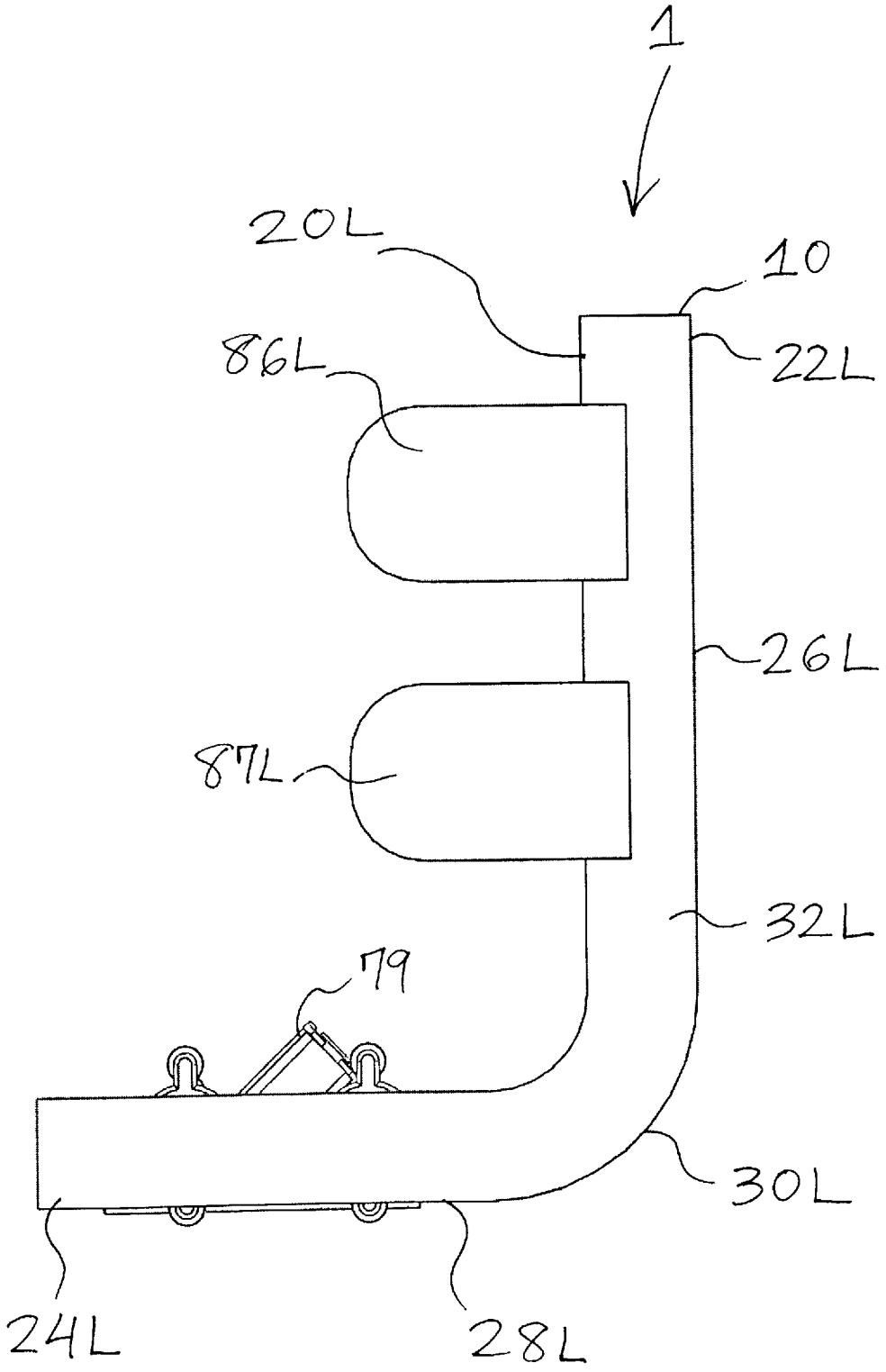
FIG. 6 is a left side view of the legs and feet massage apparatus of FIG. 1.
Figure 7:
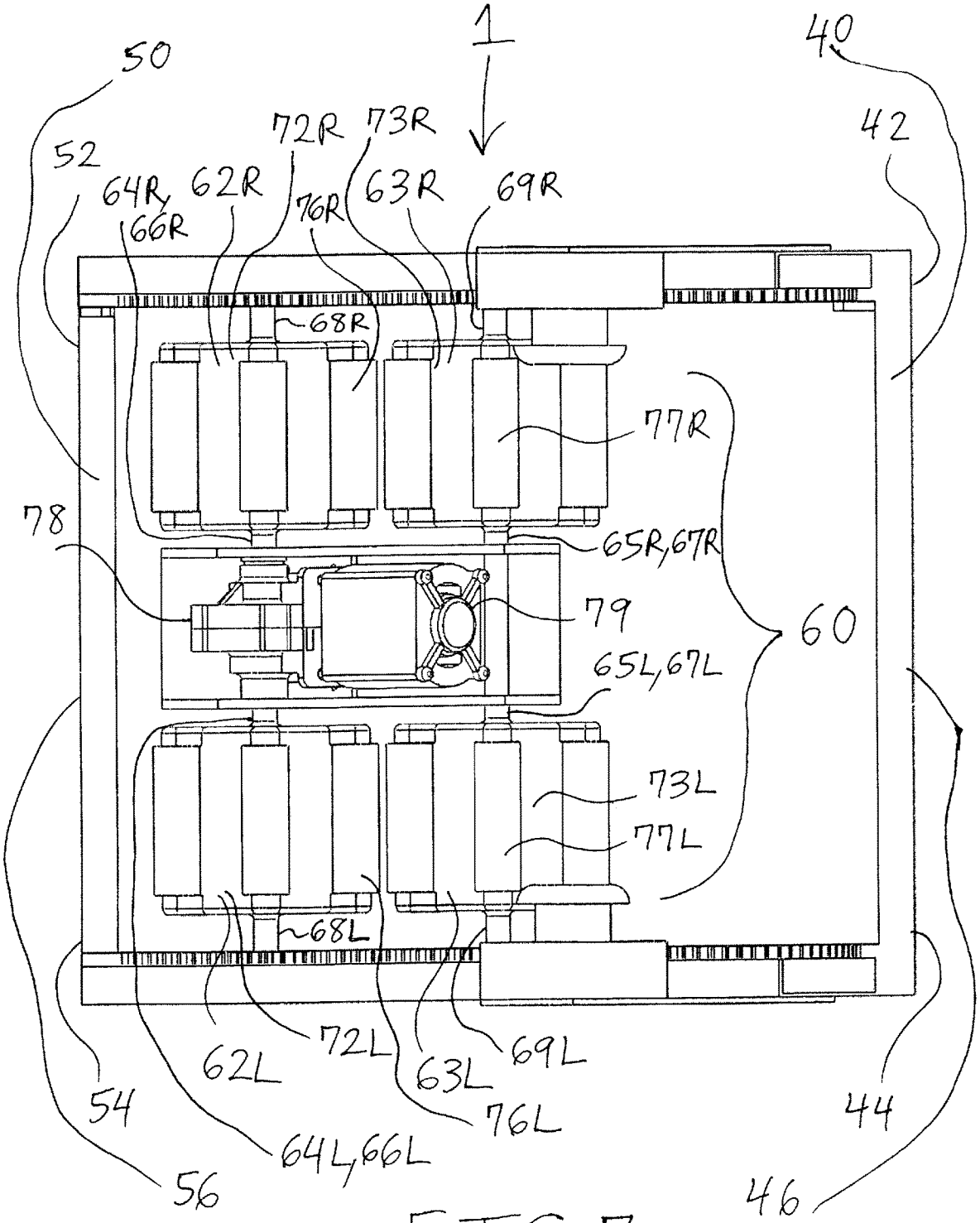
FIG. 7 is a top view of the legs and feet massage apparatus of FIG. 1.
Figure 8:
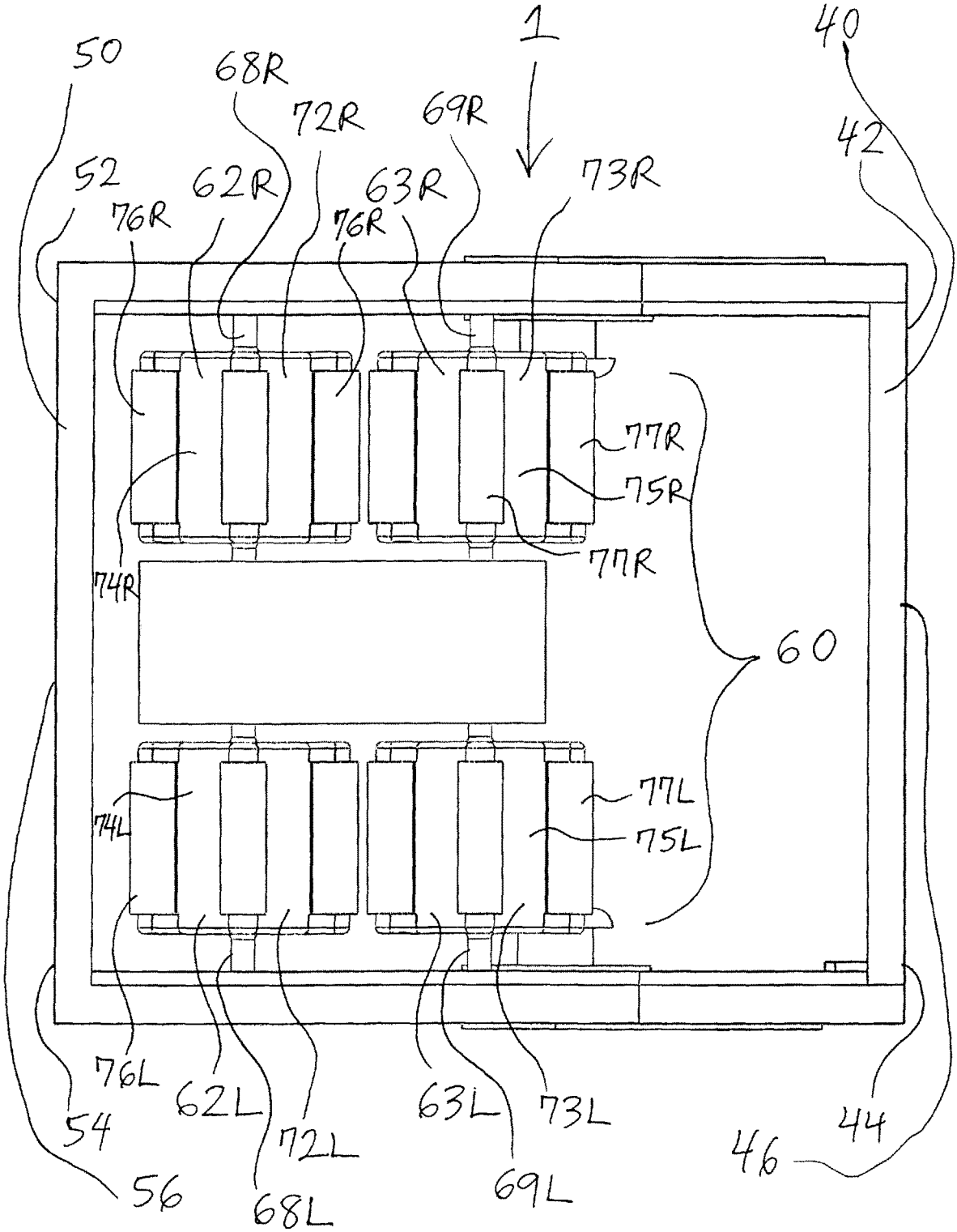
FIG. 8 is a bottom view of the legs and feet massage apparatus of FIG. 1.
Figure 9:
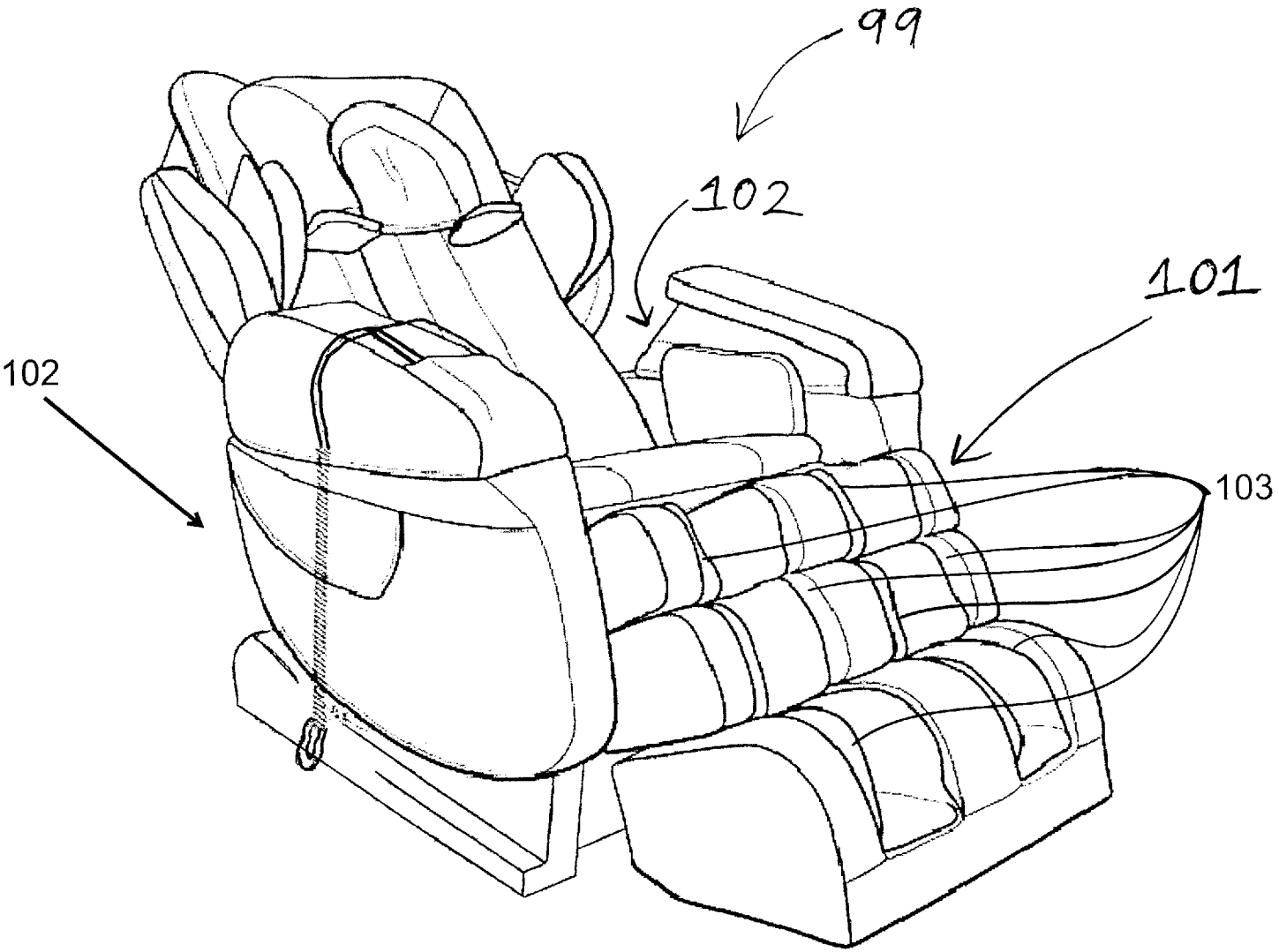
FIG. 9 is a front, right side, perspective view of a chair having a legs and feet massage apparatus according to the present invention, wherein the legs and feet massage apparatus is positioned inside a chair covering material.

As best shown in FIGS. 1 and 2, the frame 10 includes a pair of opposing guide rails 20R, 20L, an upper connecting bar 40, and a lower connecting bar 50.

Preferably, the guide rails 20R, 20L are substantially similar or mirror images of one another. As best shown in FIGS. 1-6, each guide rail 20R, 20L includes an upper or first end 22R, 22L, a lower or second end 24R, 24L, an upper or vertical section 26R, 26L located adjacent the upper end 22R, 22L, a lower or horizontal section 28R, 28L located about the lower end 24R, 24L, a bend section 30R, 30L connecting the vertical section 26R, 26L and horizontal section 28R, 28L of the corresponding guide rail 20R, 20L, an outer side 32R, 32L, an inner side 34R, 34L, and a guide channel 36R, 36L extending from the vertical section 26R, 26L into the horizontal section 28R, 28L and running along the inner side 34R, 34L of the guide rail 20R, 20L. The guide channel 36R, 36L includes a plurality of gear teeth 38R, 38L for engaging with a plurality of driving gears 70R, 70L, 71R, 71L of a plurality of feet massage roller devices 62R, 62L, 63R, 63L of the feet massage roller assembly 60 when the plurality of feet massage roller devices 62R, 62L, 63R, 63L move upwardly, or alternatively downwardly, in a generally vertical direction along the vertical section 26R, 26L and bend section 30R, 30L from the upper ends 22R, 22L toward the lower ends 24R, 24L of the guide rails 20R, 20L and vice versa, respectively, and moves forwardly, or alternatively rearwardly, in a generally horizontal direction along the horizontal section 28R, 28L. Preferably, each of the guide rails 20R, 20L has a generally "L-shaped" configuration. In this configuration, the lower portion of the "L" includes the horizontal section 28R, 28L and a portion of the bend section 30R, 30L, and the upper portion of the "L" includes the vertical section 26R, 26L and also a portion of the bend section 30R, 30L.

As best shown in FIGS. 1-4, 7 and 8, each of the upper connecting bar 40 and lower connecting bar 50 has a first end 42, 52, a second end 44, 54, and a body portion 46, 56 extending from the first end 42, 52 to the second end 44, 54, respectively. The upper connecting bar 40 is secured, attached, fastened, fixed or mounted to the upper ends 22R, 22L of the guide rails 20R, 20L, while the lower connecting bar 50 is secured, attached, fastened, fixed or mounted to the lower ends 24R, 24L of the guide rails 20R, 20L. The upper connecting bar 40 and lower connecting bar 50 help to stabilize the frame 10 and the positioning of the guide rails 20R, 20L relative to one another.

As best shown in FIGS. 1-4, 7 and 8, the feet massage roller assembly 60 includes: the plurality of feet massage roller devices 62R, 62L, 63R, 63L (a total of four in this embodiment); a worm gear device 78; and a motor 79. The plurality of feet massage roller devices 62R, 62L, 63R, 63L may be moved along the guide channels 36R, 36L of the pair of guide rails 20R, 20L by the motor 79 powering the worm gear device 78 to rotate the plurality of feet massage roller devices 62R, 62L, 63R, 63L such that the plurality of feet massage roller devices 62R, 62L, 63R, 63L move along the guide channels 36R, 36L while also providing massage benefits or effects to the bottoms or soles of the feet and backsides of the ankles and calves of the user.

As best shown in FIGS. 1-4, 7 and 8, each feet massage roller device 62R, 62L, 63R, 63L has a first end 64R, 64L, 65R, 65L with a rotational shaft 66R, 66L, 67R, 67L that is connected to the worm gear device 78 or motor 79, respectively, a second end 68R, 68L, 69R, 69L that has a plurality of driving gears 70R, 70L, 71R, 71L for engaging with the corresponding guide channel 36R, 36L of the guide rails 20R, 20L, and a main massage roller 72R, 72L, 73R, 73L positioned between the first end 64R, 64L, 65R, 65L and second end 68R, 68L, 69R, 69L. Each main massage roller 72R, 72L, 73R, 73L has a plurality of smaller massage rollers 76R, 76L, 77R, 77L surrounding the outer surface 74R, 74L, 75R, 75L of the main massage roller 72R, 72L, 73R, 73L. Thus, preferably, the plurality of smaller massage rollers 76R, 76L, 77R, 77L make contact with and provide massage benefits or effects to the bottom or sole of the feet and backside of the ankle and calves of the user as the plurality of feet massage roller devices 62R, 62L, 63R, 63L move along the guide channels 36R, 36L of the guide rails 20R, 20L.

As best shown in FIGS. 1-4, the worm gear device 78 is in communication with or connected to the motor 79 such that the worm gear device 78 is powered by the motor 79 to rotate the plurality of feet massage roller devices 62R, 62L via the rotational shafts 66R, 66L so that the plurality of feet massage roller devices 62R, 62L, 63R, 63L can move along the guide channel 36R, 36L. The worm gear device 78 may be any applicable worm gear device known to one of ordinary skill in the art.

As best shown in FIGS. 1-4, the motor 79 powers the worm gear device 78 to rotate the plurality of feet massage roller devices 62R, 62L via the rotational shafts 66R, 66L while itself rotating the plurality of feet massage roller devices 63R, 63L via the rotational shafts 67R, 67L such that the plurality of feet massage roller devices 62R, 62L, 63R, 63L can move along the guide channels 36R, 36L of the guide rails 20R, 20L. The motor 79 may be any applicable motor known to one of ordinary skill in the art.

As best shown in FIGS. 1-6, each of the two sets of calf massage devices 80R, 80L includes: a first or upper calf massage device 82R, 82L; and a second or lower calf massage device 84R, 84L. Both of the upper calf massage device 82R, 82L and lower calf massage device 84R, 84L of each set 80R, 80L are secured, attached, fastened, fixed or mounted to the vertical section 26R, 26L of the corresponding guide rail 20R, 20L such that, preferably, the upper calf massage devices 82R, 82L face toward one another and the lower calf massage devices 84R, 84L face toward one another.

Preferably, each of the upper calf massage devices 82R, 82L and lower calf massage devices 84R, 84L has an attachment plate 86R, 86L, 87R, 87L, a wiring coil 90R, 90L, 91R, 91L secured or attached to the inner side 88R, 88L, 89R, 89L of the attachment plate 86R, 86L, 87R, 87L, and a metal core or plunger 94R, 94L, 95R, 95L secured or attached to the inner side 92R, 92L, 93R, 93L of the wiring coil 90R, 90L, 91R, 91L. Preferably, the wiring coil 90R, 90L, 91R, 91L is an energized solenoid coil that produces linear movement of the corresponding metal core or plunger 94R, 94L, 95R, 95L so that punching massage effects is provided to the calves of the user. Thus, preferably, the plurality of metal cores or plungers 94R, 94L, 95R, 95L make contact with and provide punching massage benefits or effects to the sides of the calves of the user when the two sets of calf massage devices 80R, 80L are in use.

As shown in FIG. 2, limit sensors 96, 98 control the traveling distance of the plurality of feet massage roller devices 62R, 62L, 63R, 63L along the guide channels 36R, 36L of the guide rails 20R, 20L in either direction, and prevent the plurality of feet massage roller devices 62R, 62L, 63R, 63L from exiting the guide channels 36R, 36L at either end of the guide rails 20R, 20L. As a non-limiting example, a first limit sensor 96 may be positioned at the upper end 22R, 22L of a guide rail 20R, 20L, and a second limit sensor 98 may be positioned at the lower end 24R, 24L of the same guide rail 20R, 20L.

Figure 17:
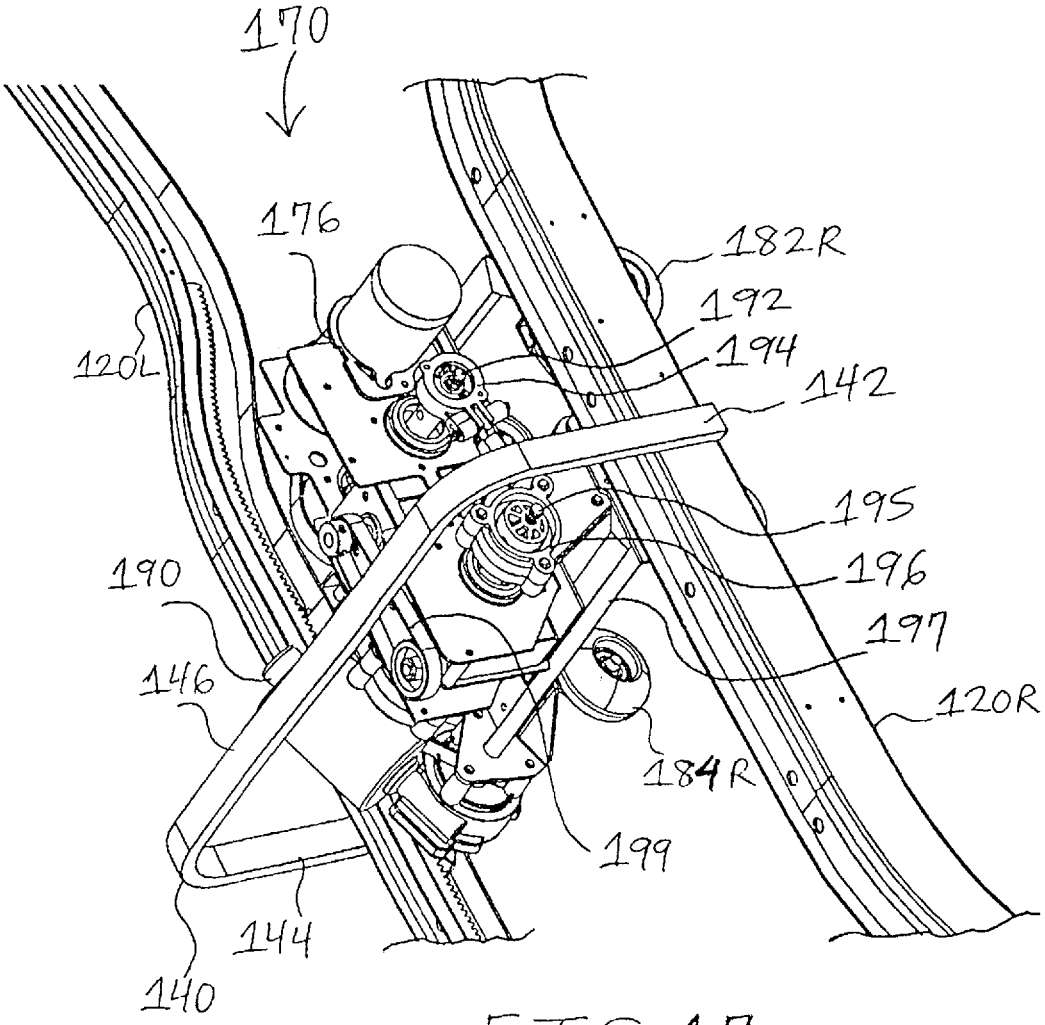
FIG. 17 is another rear, right side, perspective view of a massage device of the body massage apparatus for a massage chair of FIG. 10.
Figure 18:
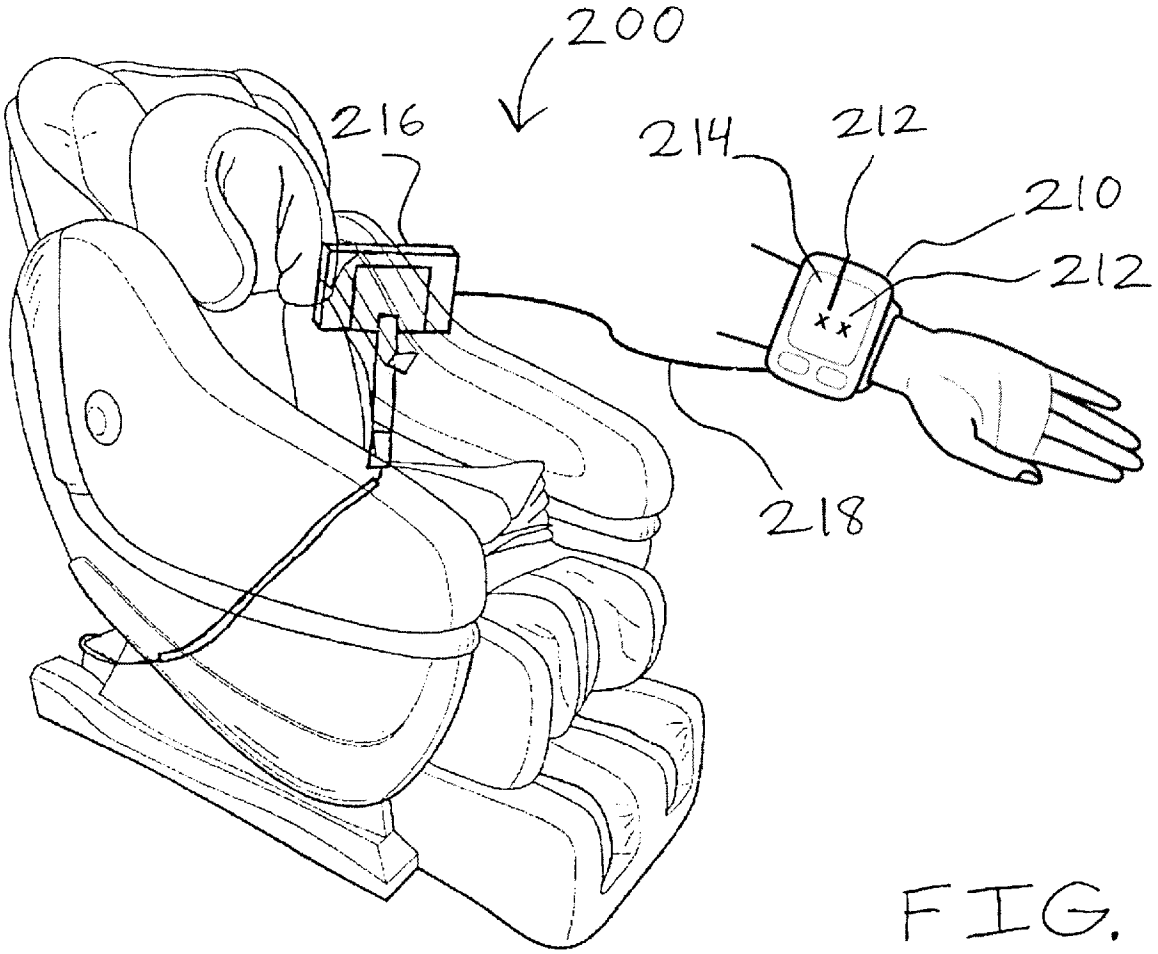
FIG. 18 is a front, right side, environmental perspective view of a massage chair according to the present invention, showing at least one health monitoring device or system being positioned on or secured to a user.
Figure 19:
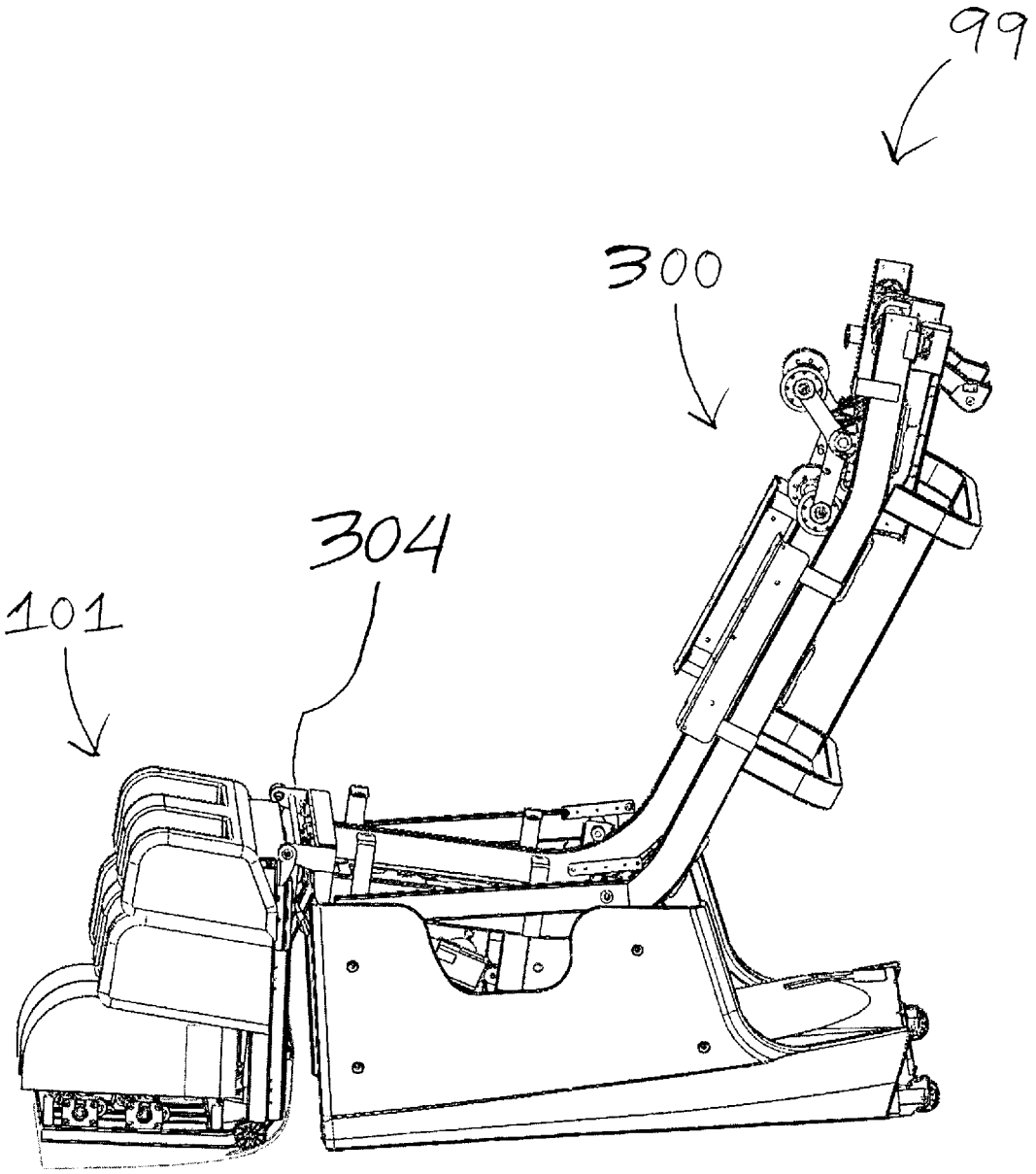
FIG. 19 is a left side, perspective view of the massage chair of FIG. 18, wherein a chair covering material is partially removed to show a substantial portion of the body massage apparatus, and wherein the chair covering material is partially revealed to show a portion of the legs and feet massage apparatus.
Figure 20:
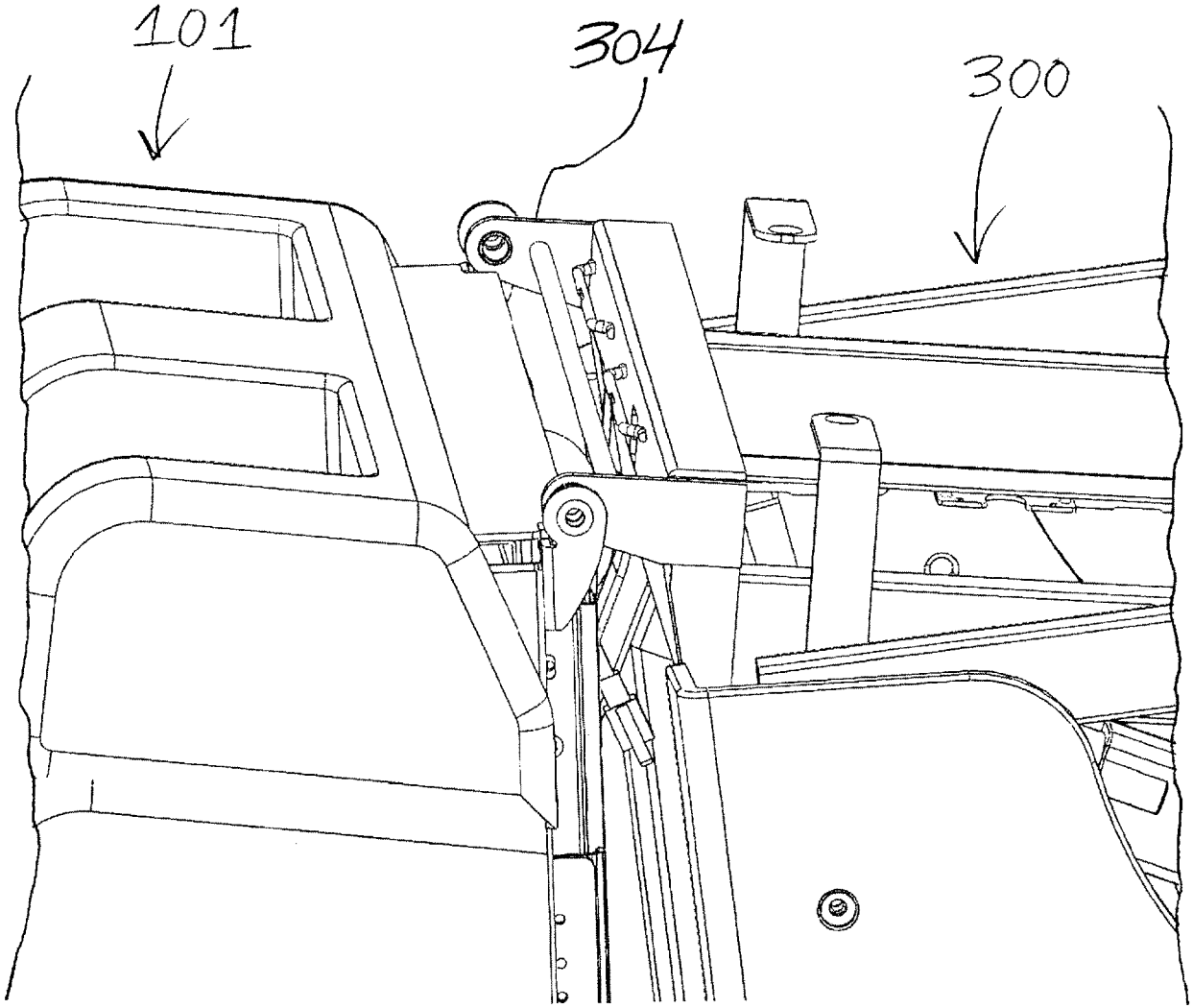
FIG. 20 is a close-up perspective view of the legs and feet massage apparatus secured to the body massage apparatus of FIG. 19.

Referring to FIGS. 9-20 and as another aspect of the present invention, the invention is directed to a chair 99, preferably a massage chair, having a legs and feet massage apparatus 101. Preferably, the legs and feet massage apparatus 101 is substantially or exactly the same as the legs and feet massage apparatus 1 described above and shown in FIGS. 1-8. As described above and shown in FIG. 9, the legs and feet massage apparatus 101 is secured, attached, fastened, fixed or mounted to a chair 99, preferably a massage chair that has a pair of armrests or arm panels 102 and a plurality of fluid-actuated devices 103 (such as, but not limited to, air cells, air bags, water bags, water cells, gel bags, gel cells, and any combination thereof), and positioned inside or under a chair covering material, such as, but not limited to, leather, suede, a man-made material, and any other covering material known to one of ordinary skill in the art. The plurality of air cells or air bags 103 are used for massage and control the intensity of foot and calf roller massage, and, as a non-limiting example, are preferably positioned about, adjacent or in proximity of the sides of the calves and feet of the user. As shown in FIG. 19, the chair covering material is partially revealed to show the legs and feet massage apparatus 101 being positioned inside or under the chair covering material, and the chair covering material is also partially revealed to show a substantial portion of a body massage apparatus 300. FIGS. 19 and 20 show a non-limiting example of a securing device 304 that secures the legs and feet massage apparatus 101 to the body massage apparatus 300. Preferably, body massage apparatus 300 is substantially similar to body massage apparatus 100.

Referring to FIGS. 10-20 and in one embodiment, the massage chair 99 comprises a body massage apparatus 100 wherein massage benefits or effects are provided to a back body area, a bottom body area, and a thigh body area of a user (not shown). Massage benefits or effects may also be provided to a head and neck body area of the user. The body massage apparatus 100 includes a frame 110 and a body massage device 170. Also, in another embodiment, the massage chair 200 includes a body massage apparatus and at least one health monitoring device 210. The body massage apparatus of massage chair 200 is preferably body massage apparatus 100.

Figure 10:
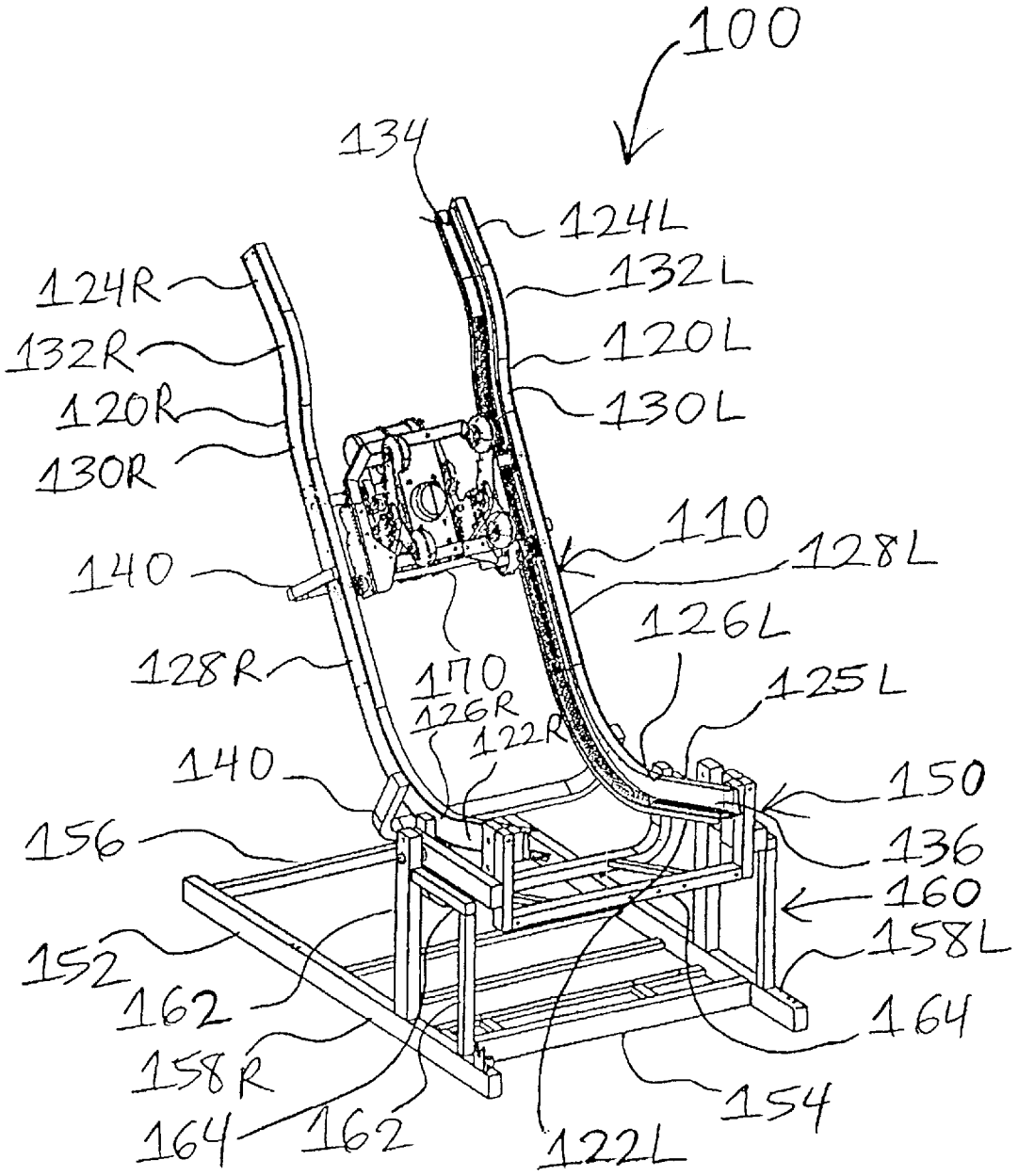
FIG. 10 is a front, right side, perspective view of a body massage apparatus for a massage chair according to the present invention.
Figure 11:
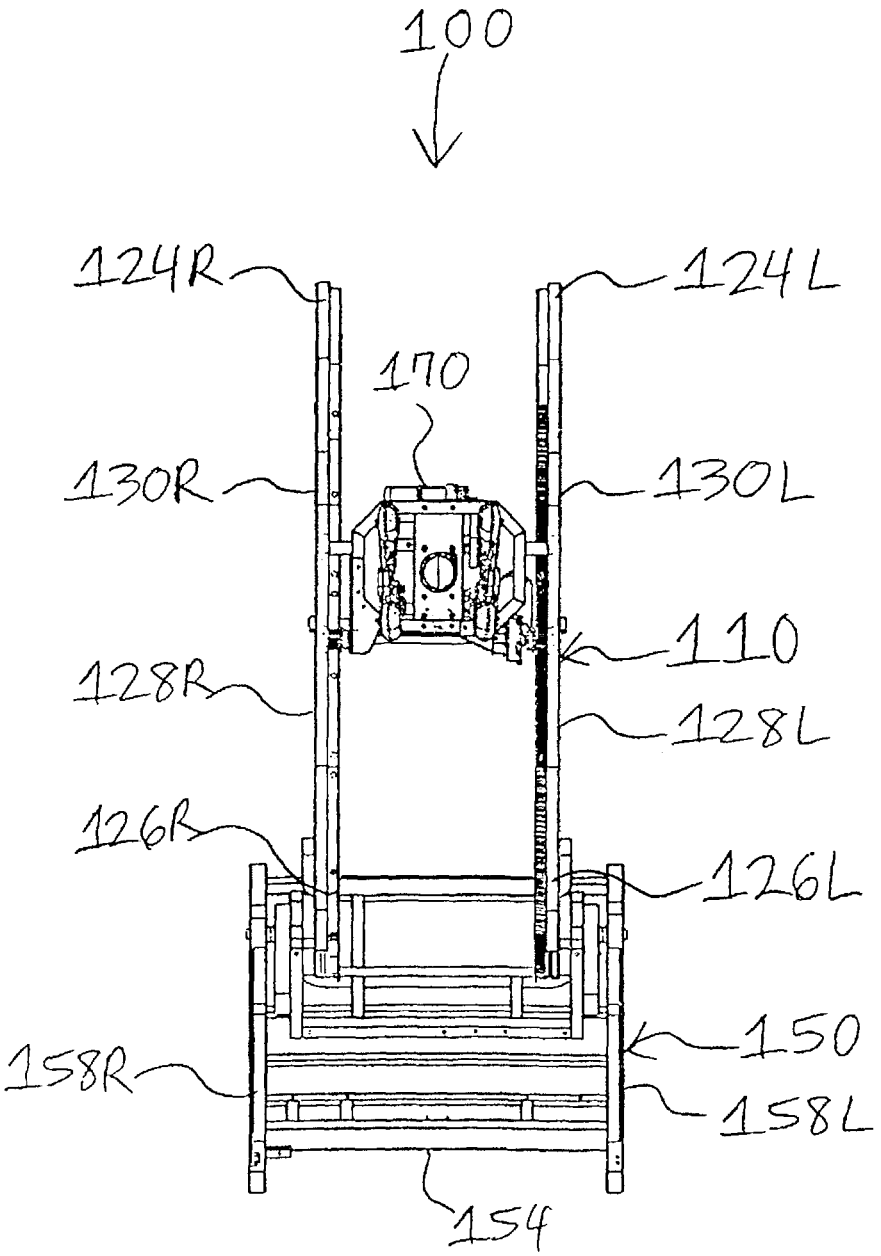
FIG. 11 is a front view of the body massage apparatus for a massage chair of FIG. 10.
Figure 12:
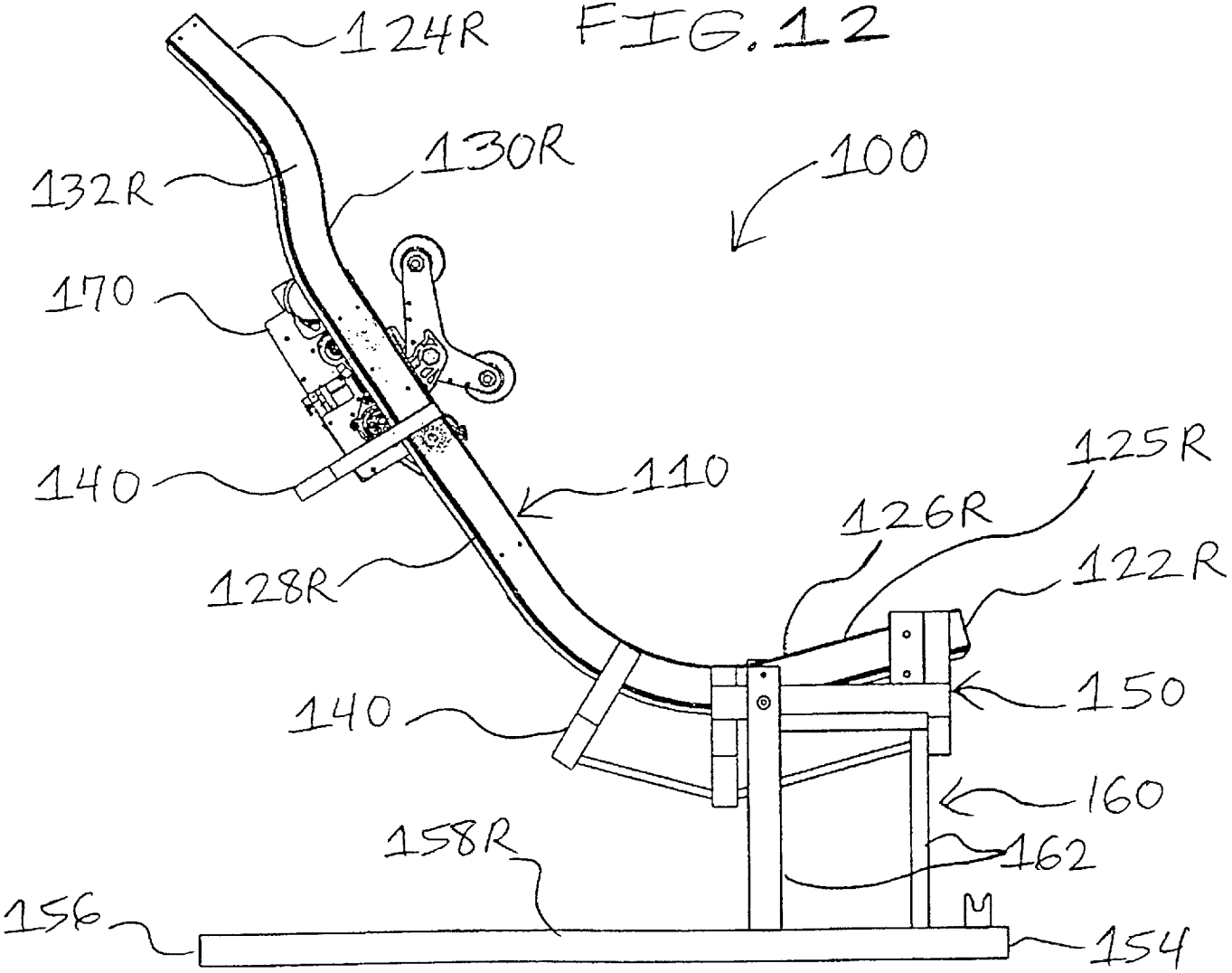
FIG. 12 is a right side view of the body massage apparatus for a massage chair of FIG. 10.

As a non-limiting example and best shown in FIGS. 10-12, the frame 110 of the body massage apparatus 100 includes a pair of opposing guide rails 120R, 120L, a plurality of guide rails stabilizing bars 140, and a base stand 150. The guide rails 120R, 120L are secured, attached, fastened, fixed or mounted to the base stand 150, and are positioned generally above the base stand 150. The base stand 150 supports the weights of the guide rails 120R, 120L, body massage device 170, and user (not shown) of the massage chair.

Preferably, the guide rails 120R, 120L are substantially similar or mirror images of one another. As best shown in FIGS. 10-12, each of the guide rails 120R, 120L includes a first end 122R, 122L, a second end 124R, 124L, a thigh body area portion 125R, 125L located adjacent the first end 122R, 122L, a seat or bottom body area portion 126R, 126L located adjacent the thigh body area portion 125R, 125L and away from the first end 122R, 122L, a back body area portion 128R, 128L extending upward from the bottom body area portion 126R, 126L, a head and neck body area portion 130R, 130L extending upward from the back body area portion 128R, 128L and located about the second end 124R, 124L, an outer side 132R, 132L, an inner side 134, and a guide channel 136 extending from the thigh body area portion 125R, 125L to the back body area portion 128R, 128L, preferably to the head and neck body area portion 130R, 130L, and running along the inner side 134 of the guide rail 120R, 120L. The guide channel 136 includes gear teeth 138 for engaging with at least one gear member from the body massage device 170 when the body massage device 170 moves upwardly, or alternatively downwardly, in a generally vertical direction from the first end 122R, 122L toward the second end 124R, 124L of the guide rail 120R, 120L and vice versa, respectively. Preferably, each of the guide rails 120R, 120L has a generally "L-shaped" configuration. In this configuration, the lower portion of the "L" includes the thigh body area portion 125R, 125L and bottom body area portion 126R, 126L, and the upper portion of the "L" includes the back body area portion 128R, 128L and head and neck body area portion 130R, 130L. As best shown in FIGS. 10 and 12, more preferably, each of the guide rails 120R, 120L has a reclining "L-shaped" configuration.

As best shown in FIGS. 10-17, the plurality of guide rails stabilizing bars 140 help to stabilize the positioning of the guide rails 120R, 120L relative to one another. Each of the guide rails stabilizing bars 140 has a first end 142, a second end 144, and a body portion 146 extending from the first end 142 to the second end 144. Preferably, each of the guide rails stabilizing bars 140 has a generally "U-shaped" configuration. The guide rails stabilizing bars 140 are secured, attached, fastened, fixed or mounted at predetermined locations along the outer sides 132R, 132L of the guide rails 120R, 120L.

As best shown in FIGS. 10-12, the base stand 150 includes a base 152 and a guide rails support structure 160. The base 152 includes a first or front end 154, a second or rear end 156, and a pair of opposing sides 158R, 158L. The guide rails support structure 160 is secured, attached, fastened, fixed or mounted about the front end 154 of the base 152, and is positioned above the base 152. The guide rails support structure 160 includes a plurality of vertical bars or members 162 and a plurality of horizontal bars or members 164. The plurality of vertical bars 162 extend upward from the pair of opposing sides 158R, 158L of the base 152, and, along with the plurality of horizontal bars 164, form a support frame with a "square-shaped" or "rectangular-shaped" box configuration.

Since the base stand 150 supports the weights of the guide rails 120R, 120L, body massage device 170, and user of the massage chair, the base stand 150 is preferably made or manufactured of a strong material, such as, but not limited to, steel, metal, wood, hard plastic, any combination of the listed materials, and any material or combination of materials known to one of ordinary skill in the art. Also, the guide rails 120R, 120L may be made or manufactured of steel, metal, wood, plastic, any combination of the listed materials, and any material or combination of materials known to one of ordinary skill in the art.

As best shown in FIGS. 13-17, the body massage device 170 includes a power source, at least one massage element, and at least one gear member. The body massage device 170 may be a conventional massage device or any applicable massage device that is known to one of ordinary skill in the art.

As a non-limiting example and as best shown in FIGS. 13-17, the body massage device 170 includes a pair of massage device moving members 172R, 172L, a pair of gear members 174R, 174L, a pair of massage arms 180R, 180L, a first motor 176, a second motor 178, a third motor 190, a rotational shaft 192 driven by the first motor 176, a pair of rotation to knocking translator members 194, a rotational shaft 195 driven by the second motor 178, a pair of rotation to kneading translator members 196, a rotational shaft 197 for vertical movement gears driving, a speed reduction belt 198 for the first motor 176, and a speed reduction belt 199 for the second motor 178.

Figure 13:
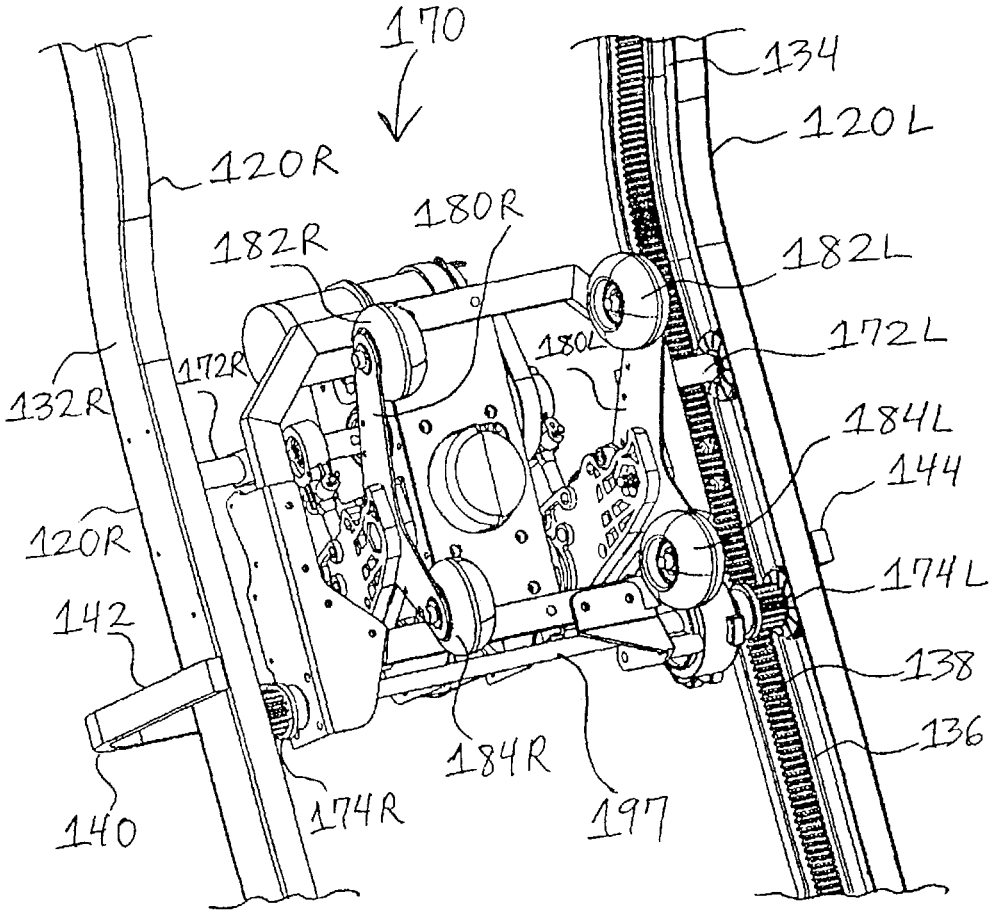
FIG. 13 is a front, perspective view of a massage device of the body massage apparatus for a massage chair of FIG. 10.
Figure 14:
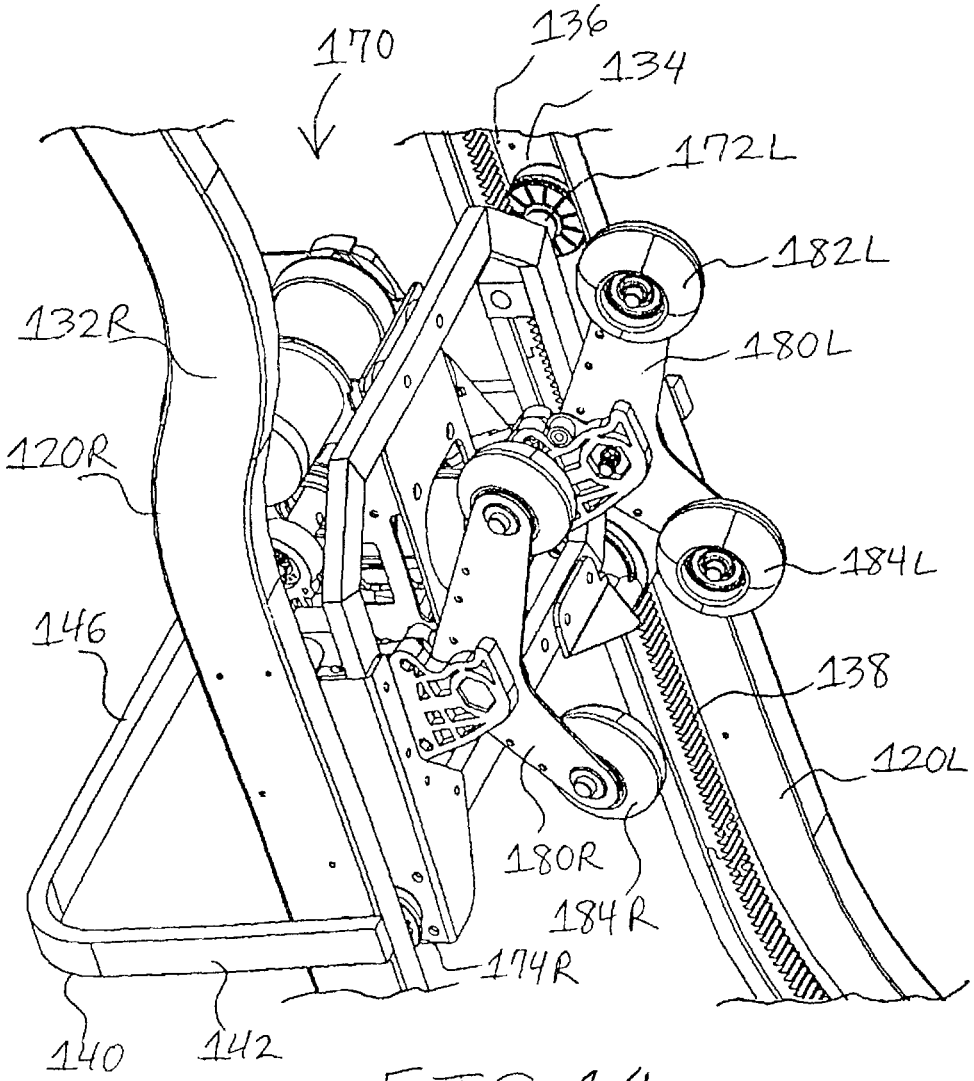
FIG. 14 is a front, right side, perspective view of a massage device of the body massage apparatus for a massage chair of FIG. 10.

As best shown in FIGS. 13 and 14, each of the pair of massage device moving members 172R, 172L is positioned within a corresponding guide channel 136 of a guide rail 120R, 120L, and helps the body massage device 170 move in a generally vertical direction along the guide channel 136.

As best shown in FIGS. 13 and 14, each of the pair of gear members 174R, 174L is positioned within a corresponding guide channel 136 of a guide rail 120R, 120L, and engages with the teeth 138 located in the corresponding guide channel 136.

As best shown in FIGS. 13-17, each of the pair of massage arms 180R, 180L includes a first or upper massage roller 182R, 182L and a second or lower massage roller 184R, 184L. Each of the pair of massage arms 180R, 180L can move vertically. As a non-limiting example, each of the pair of massage arms 180R, 180L may be able to move both vertically and laterally. The massage rollers 182R, 182L, 184R, 184L provide massage benefits or effects to a back body area, a bottom body area, and a thigh body area of the user when the body massage device 170 is moved to, near or about that particular body area. The massage rollers 182R, 182L, 184R, 184L may also provide massage benefits or effects to a head and neck area of the user when the body massage device 170 is moved to, near or about the head and neck area. It will be understood by one of ordinary skill in the art that the timing of the pattern of the raising and lowering may be varied on each roller 182R, 182L, 184R, 184L, such as by adjusting the degree of rotation of one or more of the following: rotational shaft 192 driven by the first motor 176, pair of rotation to knocking translator members 194, rotational shaft 195 driven by the second motor 178, pair of rotation to kneading translator members 196, speed reduction belt 198 for the first motor 176, and speed reduction belt 199 for the second motor 178. Also, it will be understood by one of ordinary skill in the art that the rate of speed of rotation as well as the direction of rotation of the rollers 182R, 182L, 184R, 184L may be adjusted by varying the motor speed or direction. Preferably, heat is applied to some, most or all of the massage rollers 182R, 182L, 184R, 184L and massage arms 180R, 180L to help blood circulation of the user. Heat can be applied to massage rollers 182R, 182L, 184R, 184L and massage arms 180R, 180L by any device (not shown) and/or method known to one of ordinary skill in the art.

Figure 15:
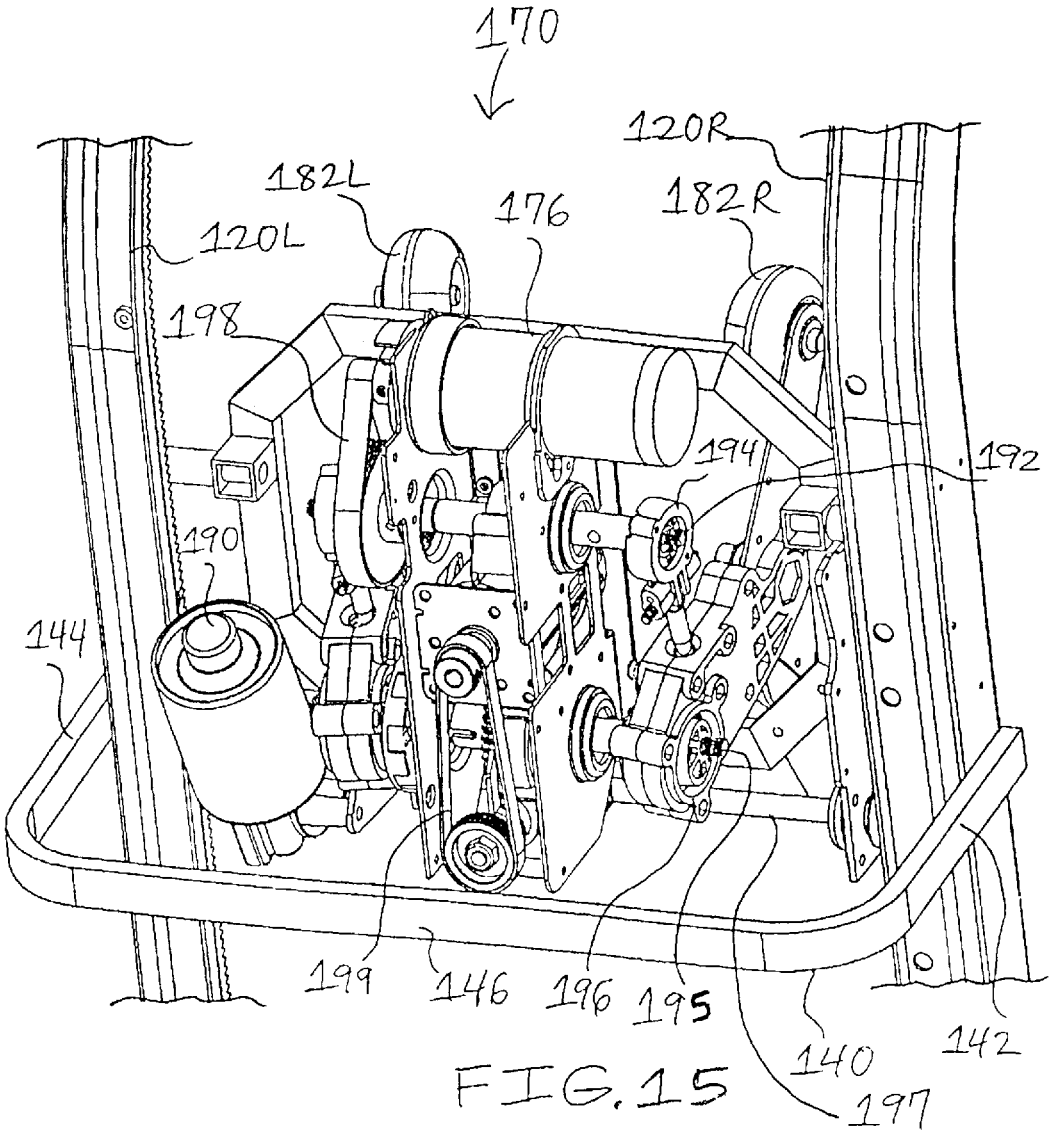
FIG. 15 is a rear, perspective view of a massage device of the body massage apparatus for a massage chair of FIG. 10.
Figure 16:
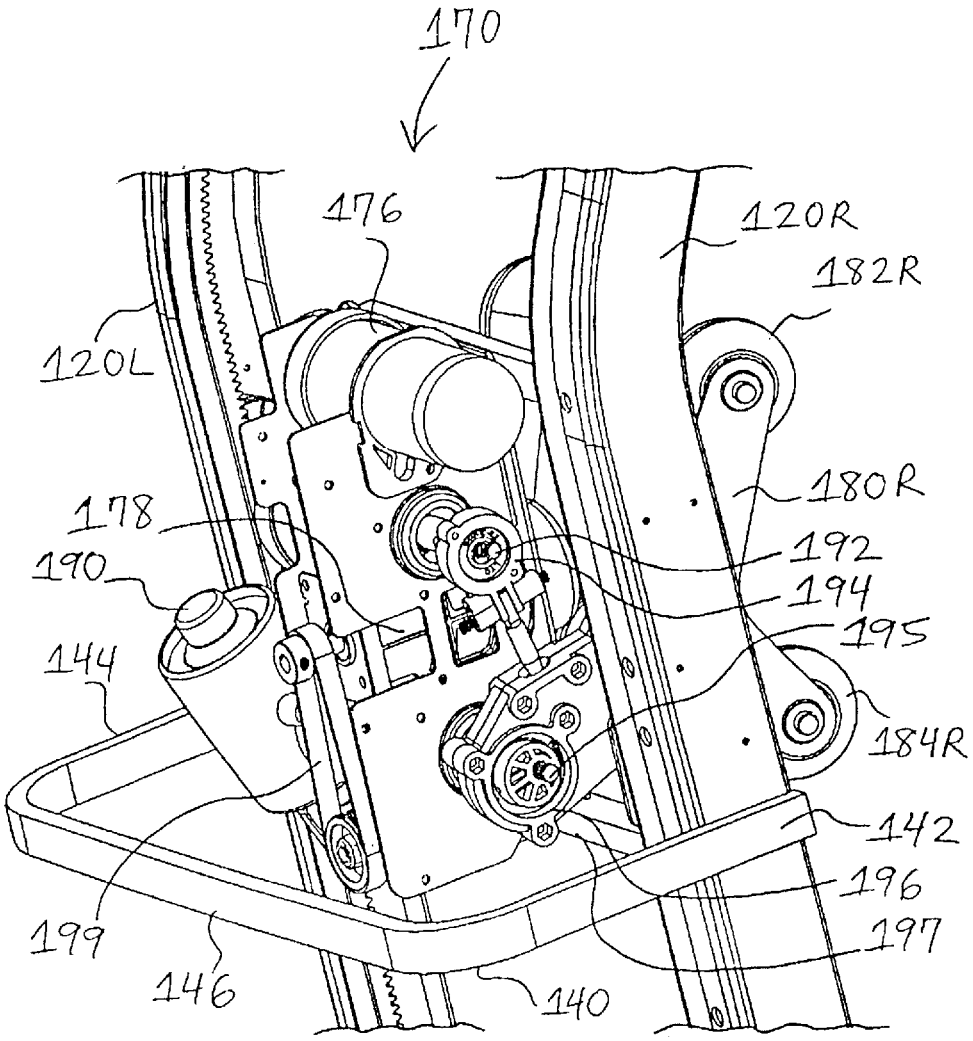
FIG. 16 is a rear, right side, perspective view of a massage device of the body massage apparatus for a massage chair of FIG. 10.

As best shown in FIGS. 15-17, the first and second motors 176, 178 provide power to the pair of massage arms 180R, 180L, respectively, while the third motor 190 provides power for the generally vertical movement of the body massage device 170.

As best shown in FIGS. 15-17, the rotational shaft 192 driven by the first motor 176 causes the first massage arm 180R to be activated and to carry out its massage actions when this rotational shaft 192 is rotated.

As best shown in FIGS. 15-17, each of the pair of rotation to knocking translator members 194 assists the corresponding massage arm 180R, 180L and corresponding massage roller(s) 182R, 182L, 184R, 184L to carry out its knocking massage actions when the corresponding rotational shaft 192, 195 is rotated.

As best shown in FIGS. 15-17, the rotational shaft 195 driven by the second motor 178 causes the second massage arm 180L to be activated and to carry out its massage actions when this rotational shaft 195 is rotated.

As best shown in FIGS. 15-17, each of the pair of rotation to kneading translator members 196 assists the corresponding massage arm 180R, 180L and corresponding massage roller(s) 182R, 182L, 184R, 184L to carry out its kneading massage actions when the corresponding rotational shaft 192, 195 is rotated.

As best shown in FIGS. 15-17, the rotational shaft 197 for vertical movement gears driving causes the body massage device 170 to move upwardly, or alternatively downwardly, when this rotational shaft 197 is rotated.

As best shown in FIG. 15, the speed reduction belt 198 for the first motor 176 adjusts the speed of the first massage arm 180R.

As best shown in FIGS. 15-17, the speed reduction belt 199 for the second motor 178 adjusts the speed of the second massage arm 180L.

When in use or in operation, the user (not shown) may activate the body massage device 170 of the body massage apparatus 100 for a massage chair by or via pushing, touching, using voice command for use on or with, using a mechanical or remote control (preferably a touchscreen-based control device or system, such as, but not limited to, a touchscreen-based control system 2100) for use on or with, or any other activation method known to one of ordinary skill in the art, an activation, start, control or command button, touch area, box or panel, or any other activation method or element known to one of ordinary skill in the art. Preferably, the user is able to control the generally vertical movement of the body massage device 170 and massage rollers 182R, 182L, 184R, 184L upwardly, or alternatively downwardly, along the guide rails 120R, 120L such that the body massage device 170 and massage rollers 182R, 182L, 184R, 184L are positioned about, near or at a desired body part area, such as the thighs, bottom, lower back, upper back, and head and neck, of the user so that desired body part area of the user can receive massage effects or benefits from the massage rollers 182R, 182L, 184R, 184L when desired. Preferably, the user is also able to control the timing, movement, etc. of the massage rollers 182R, 182L, 184R, 184L such that that the massage rollers 182R, 182L, 184R, 184L can provide different massage effects or benefits, such as knocking, keading, etc., to the desired body part area of the user at a particular moment or time.

Referring to FIG. 18, the massage chair 200 includes a body massage apparatus and at least one health monitoring device or system 210. The body massage apparatus is preferably body massage apparatus 100, described above, that includes the frame 110 and body massage device 170, or is a body massage apparatus that is substantially similar to body massage apparatus 100.

As a non-limiting example shown in FIG. 18, the at least one health monitoring device or system 210 is a portable, wrist blood pressure and heart rate monitoring device 210 that is manufactured and/or programmed to measure or obtain the blood pressure and heart rate of the user right at or near the massage chair 200 when the user is preferably positioned on the massage chair 200. The blood pressure and heart rate monitoring device 210 is compact, convenient, and does not interfere with the massage functions of the massage chair 200. The blood pressure and heart rate monitoring device 210 provides blood pressure and heart rate measurements, and alerts the user and/or other persons, such as, but not limited to, an individual who is monitoring the user's blood pressure and heart rate. The measurement data 212 that is obtained from the user is displayed either on the device screen 214 or on a remote control 216 of the massage chair 200. The blood pressure and heart rate monitoring device 210 can be quickly connected to or disconnected from the massage chair 200 via a connector or cord 218, such as, but not limited to, a detachable DC power supply cord.

As an alternative to the blood pressure and heart rate monitoring device 210 of this embodiment, the at least one health monitoring device 210 may be a blood pressure monitoring or measuring device and a heart rate monitoring or measuring device that are separate from one another, or just either of those devices. As another alternative to the blood pressure and heart rate monitoring device 210 of this embodiment, the at least one health monitoring device 210 may encompass any individual or combinations of health monitoring functions, such as, but not limited to, blood pressure monitoring and/or measuring, heart rate monitoring or measuring, cholesterol monitoring or measuring, fat monitoring or measuring, and blood sugar monitoring or measuring. Alternatively, the at least one health monitoring device 210 may be or include any health monitoring device(s) that is/are known to one of ordinary skill in the art.

Figure 27:
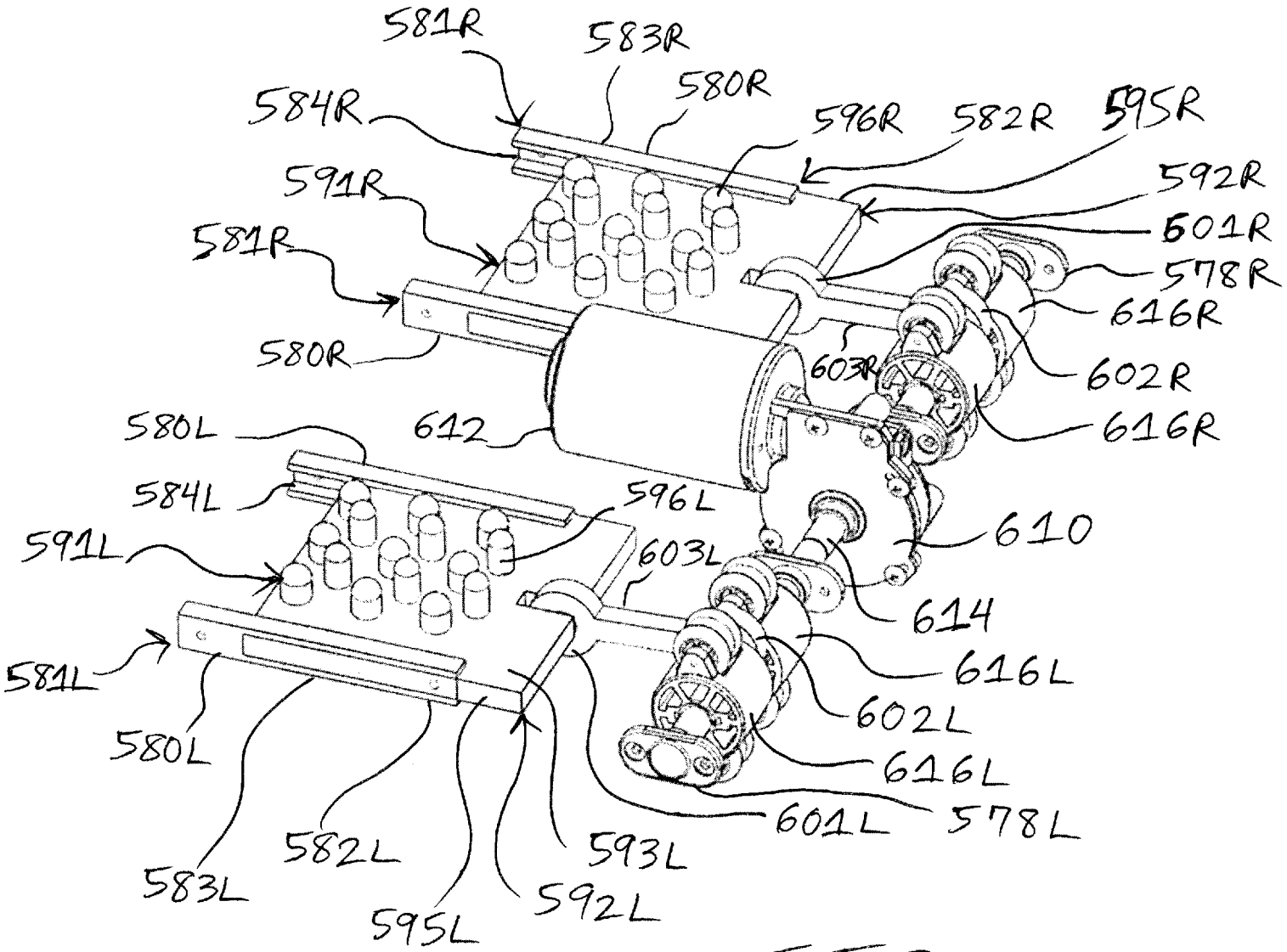
FIG. 27 is a rear, left side, perspective view of the calves massage device of FIG. 25, without partial housing frames.
Figure 28:
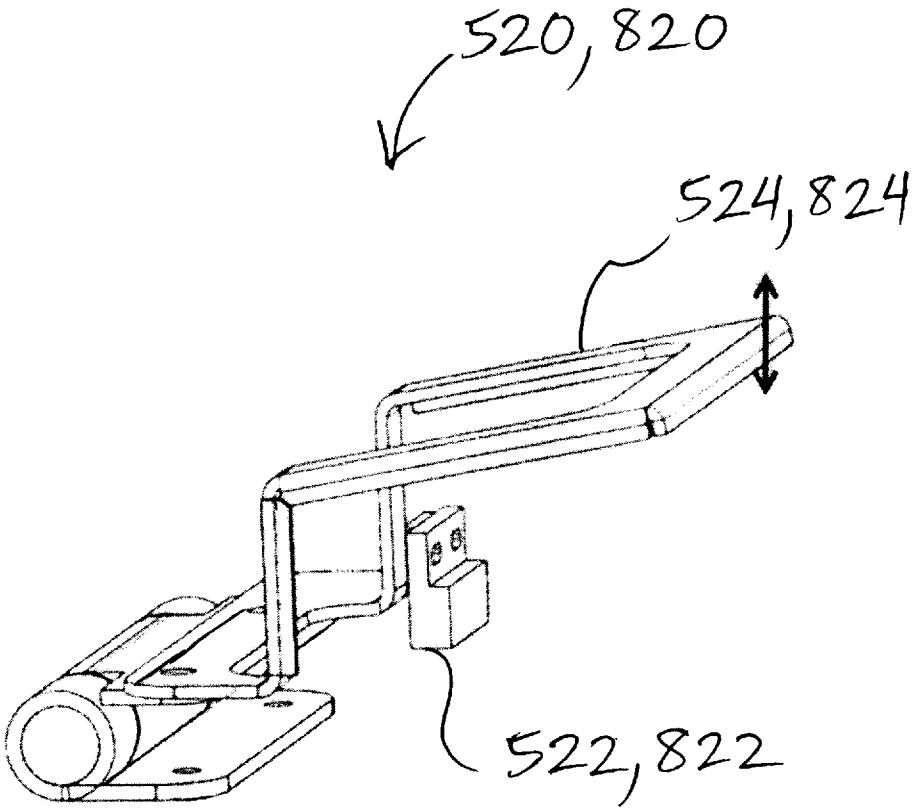
FIG. 28 is a perspective view of a spring-loaded pedal of the legs and feet massage apparatus of FIGS. 21 and 30.
Figure 29:
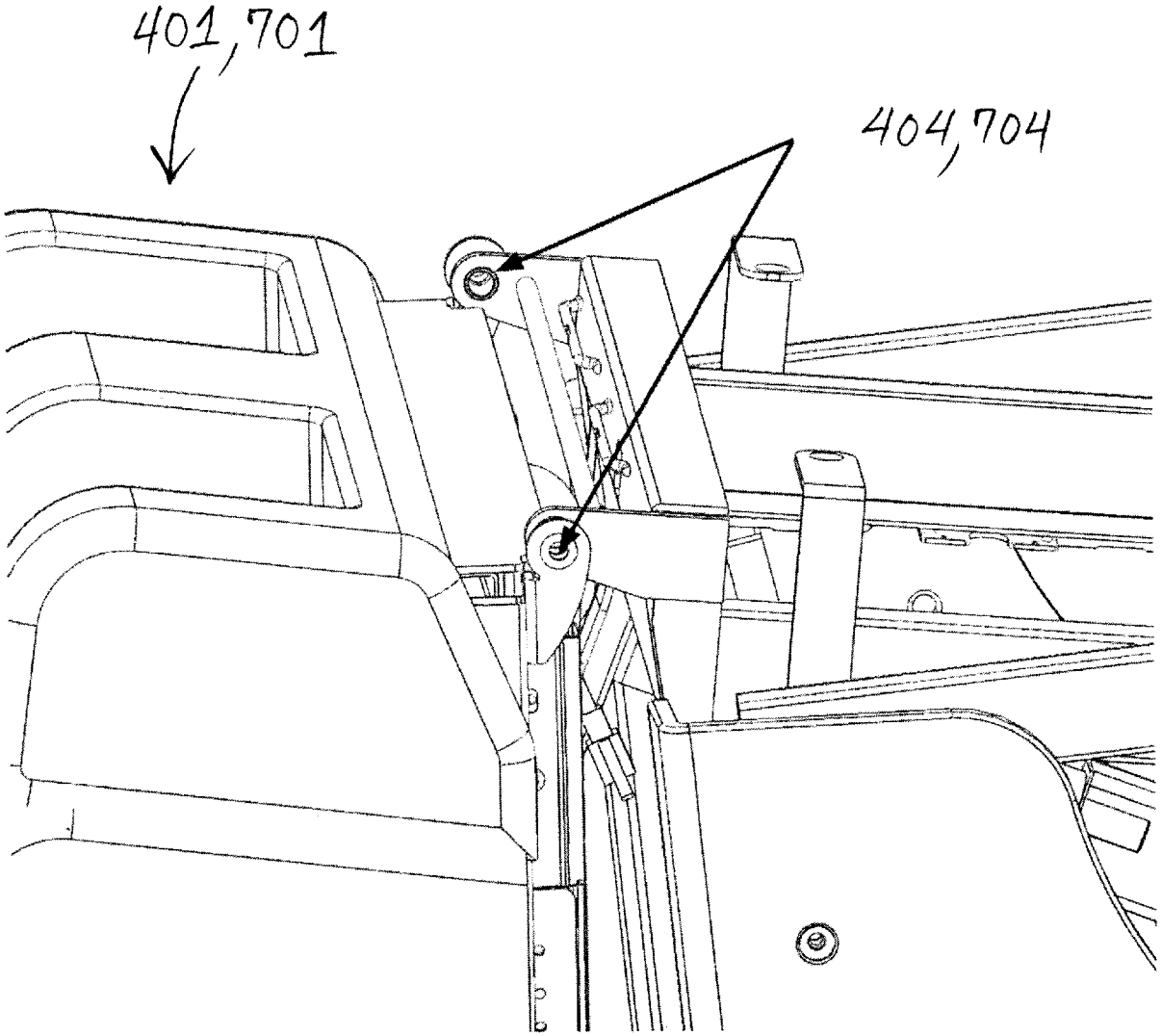
FIG. 29 is a perspective view of a securing device according to the present invention.

Referring to FIGS. 21-29 and as an additional aspect of the present invention, the invention is directed to another legs and feet massage apparatus 401 for providing massage benefits or effects to the legs and/or feet of a user U. As shown in FIG. 29, the legs and feet massage apparatus 401 may be secured, attached, fastened, fixed or mounted to a chair (such as at or about a lower end of a body frame, similar to what is shown in FIG. 20), preferably a massage chair, by a securing device, such as, but not limited to, securing device 404. In addition, some, most or all of the legs and feet massage apparatus 401 may be positioned inside or under a chair covering material (preferably the same or substantially the same as the chair covering material disclosed in other aspects of the present invention).

As a first embodiment of this additional aspect and as shown in FIGS. 21-29, the legs and feet massage apparatus 401 includes a legs and feet frame 410, a feet massage device 460 (preferably motorized), and a calves massage device 560 (preferably motorized). The legs and feet massage apparatus 401 may also include a linear extension actuator (not shown in this embodiment but a substantially similar linear extension actuator 830 is shown in another embodiment), a linear sliding device 540, a pair of rotating wheels 550R, 550L, a foot detection sensor/switch 522, a plurality of arrays or arrangements of fluid-actuated devices 660R, 660L (such as, but not limited to, airbags, air cells, water bags, water cells, gel bags, gel cells, and any combination thereof), and/or at least one pressure sensor 670 (not shown) related to fluid-actuated devices 660R, 660L. Each array or arrangement of fluid-actuated devices 660R, 660L is positioned about the corresponding side of a calf and/or corresponding side of a foot of the user during operation.

As other embodiments of this additional aspect, a massage apparatus related to the legs and/or feet includes a frame, such as, but not limited to, the legs and feet frame 410, and either the feet massage device 460 (preferably motorized) or calves massage device 560 (preferably motorized). Embodiments with either the feet massage device 460 (preferably motorized) or calves massage device 560 (preferably motorized) may or may not also include the linear extension actuator (not shown in this embodiment but a substantially similar linear extension actuator 830 is shown in another embodiment), linear sliding device 540, pair of rotating wheels 550R, 550L, foot detection sensor/switch 522, a plurality of arrays or arrangements of fluid-actuated devices 660R, 660L (such as, but not limited to, airbags, air cells, water bags, water cells, gel bags, gel cells, and any combination thereof), and/or at least one pressure sensor 670 (not shown) related to fluid-actuated devices 660R, 660L.

Figure 21:
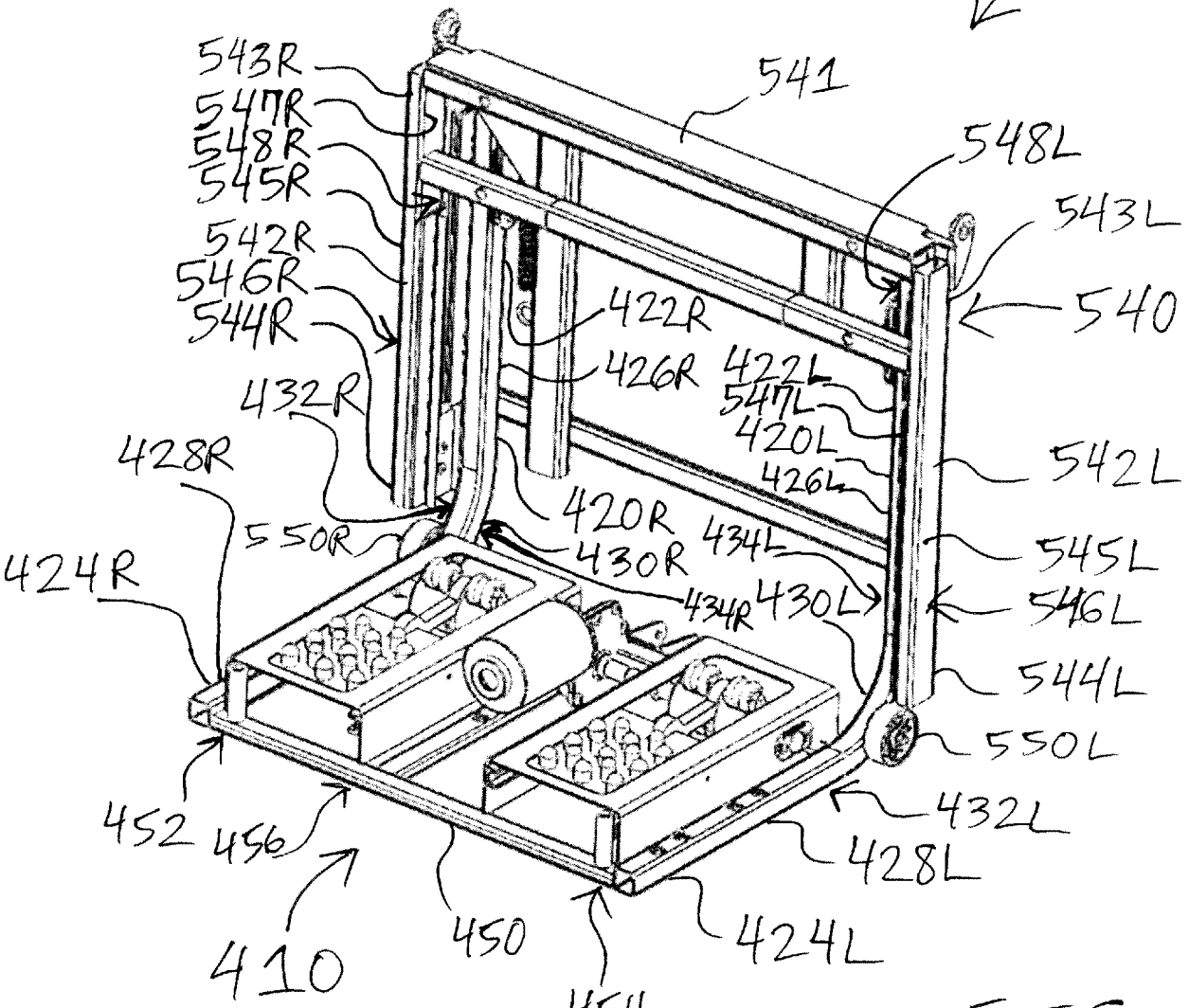
FIG. 21 is a front, left side, perspective view of an embodiment of another legs and feet massage apparatus according to the present invention.

As best shown in FIG. 21, the legs and feet frame 410 includes a pair of opposing guide bars 420R, 420L, an upper connecting bar 541, and a lower connecting bar 450. The pair of opposing guide bars 420R, 420L provide linear motion and guiding for frame extention and retraction to fit with users of different heights or leg lengths and also provide the motions for foot and body stretching massage effects.

Preferably, the guide bars 420R, 420L are substantially similar or mirror images of one another. As best shown in FIG. 21, each of the guide bars 420R, 420L includes: an upper or first end 422R, 422L; a lower or second end 424R, 424L; an upper or vertical section 426R, 426L located adjacent the upper end 422R, 422L; a lower or horizontal section 428R, 428L located about the lower end 424R, 424L; a bend section 430R, 430L connecting the vertical section 426R, 426L and horizontal section 428R, 428L of the corresponding guide bars 420R, 420L; an outer side 432R, 432L; and an inner side 434R, 434L. In this configuration, the extendable or lower portion of the frame has an "L" shape that includes the horizontal section 428R, 428L and a portion of the bend section 430R, 430L, and the upper portion of the "L" includes the vertical section 426R, 426L and also a portion of the bend section 430R, 430L.

As best shown in FIG. 21, the lower connecting bar 450 has a first end 452, a second end 454, and a body portion 456 extending from the first end 452 to the second end 454. The lower connecting bar 450 is secured, attached, fastened, fixed or mounted to the lower ends 424R, 424L of the guide bars 420R, 420L. The upper connecting bar 541 and lower connecting bar 450 help to stabilize the legs and feet frame 410 and the positioning of the guide bars 420R, 420L relative to one another.

As a non-limiting example and as shown in FIGS. 21-25, the feet massage device 460 preferably includes a first or right foot massage device 462R, a second or left foot massage device 462L, a feet roller motor gearbox 510, a feet roller motor 512, and a driving, rotational shaft 514.

As best shown in FIGS. 21-24, each of the first or right and second or left foot massage devices 462R, 462L includes a partial housing frame 470R, 470L, a pair of plate guiders 480R, 480L, a massage plate 490R, 490L with raised accupressure points 496R, 496L, shaft support bearings or bushings 478R, 478L, a circular-to-linear motion translator 500R, 500L, a pair of larger rollers 516R, 516L mounted on the driving, rotational shaft 514, and smaller rollers 517R, 517L of acupressure points 518R, 518L (preferably via uneven surface of smaller rollers 517R, 517L) located on or about the outer surface of the body of each larger roller 516R, 516L.

Figure 22:
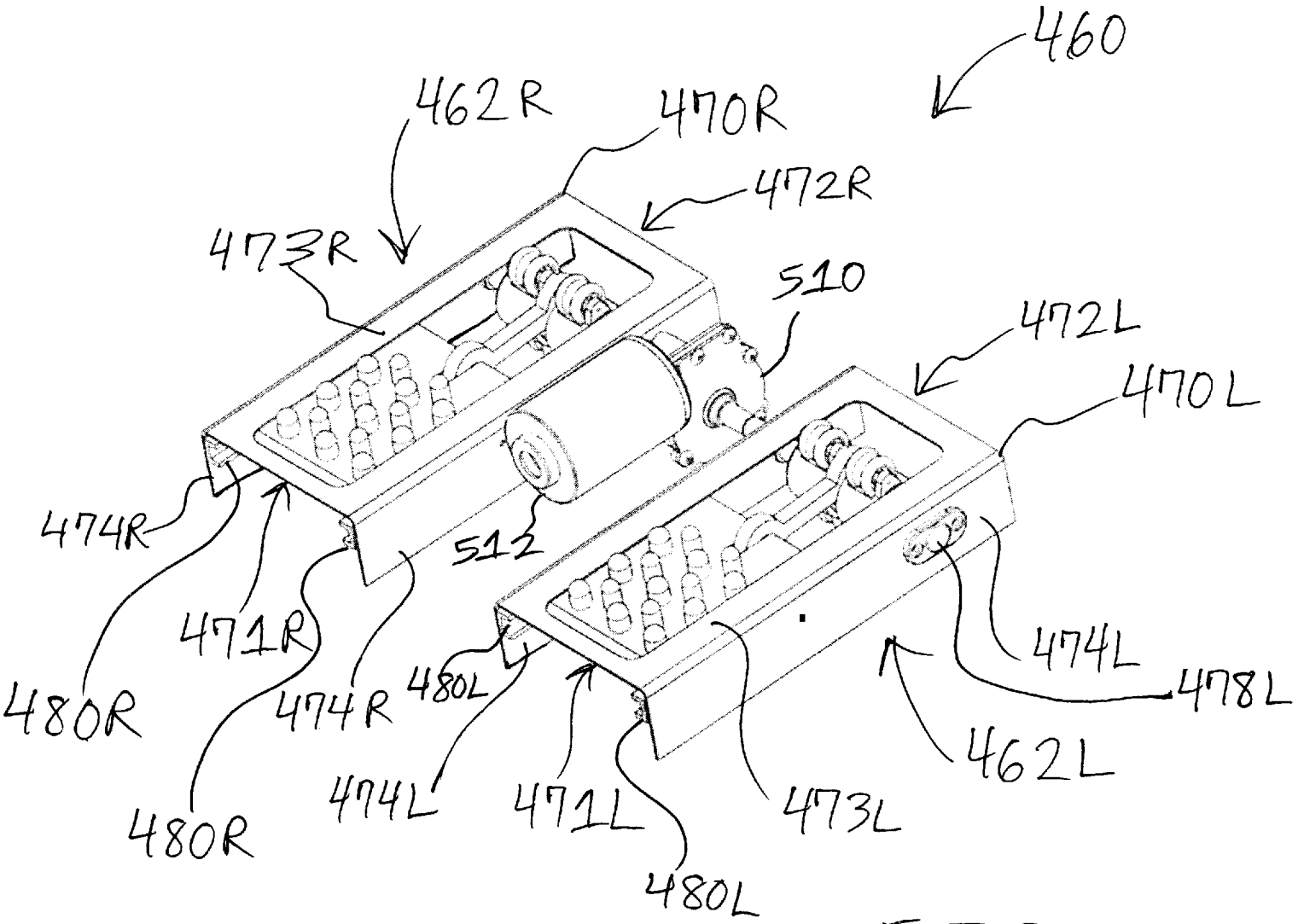
FIG. 22 is a front, left side, top, perspective view of a feet massage device of the legs and feet massage apparatus of FIG. 21.
Figure 23:
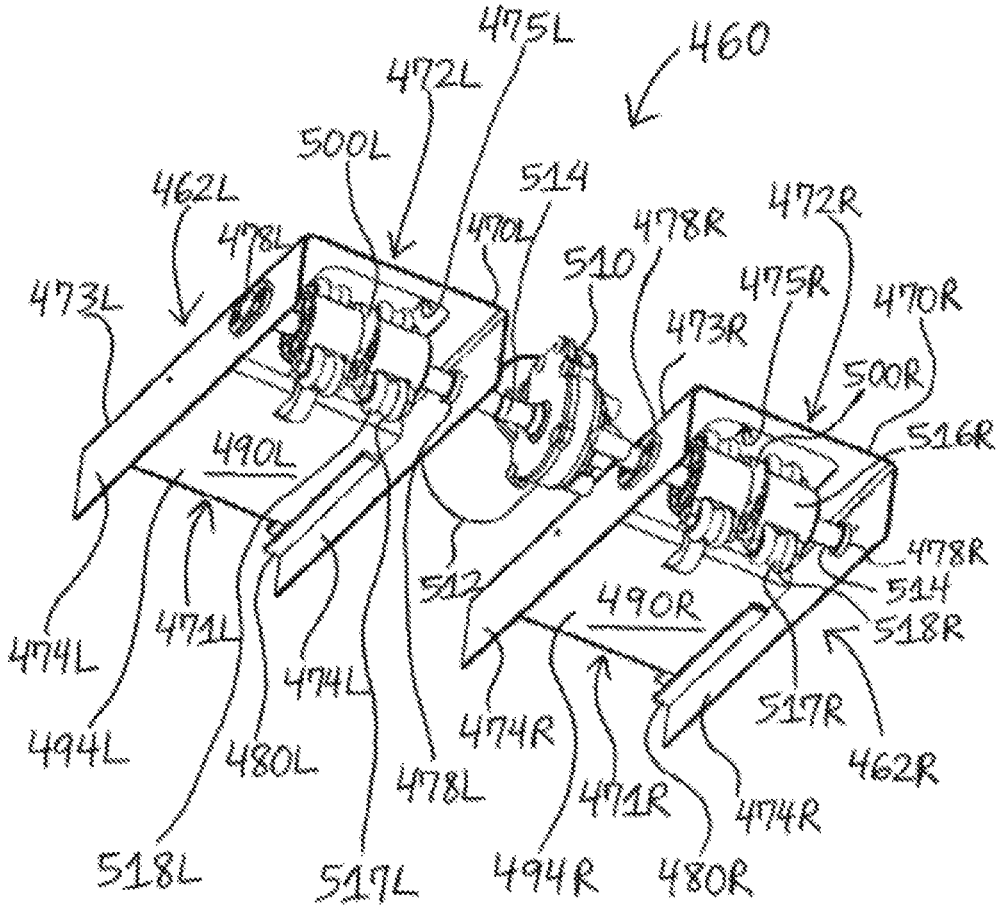
FIG. 23 is a rear, left side, bottom, perspective view of the feet massage device of FIG. 22.

As best shown in FIGS. 21-23, each partial housing frame 470R, 470L has a first or front end 471R, 471L, a second or rear end 472R, 472L, a top 473R, 473L, a pair of sides 474R, 474L, and a cutout window 475R, 475L. The cutout window 475R, 475L allows the raised accupressure points 496R, 496L on the massage plate 490R, 490L to protrude sufficiently above the top 473R, 473L such that the raised accupressure points 496R, 496L are able to provide massage effects or benefits to the corresponding sole of the user's feet during operation.

Figure 24:
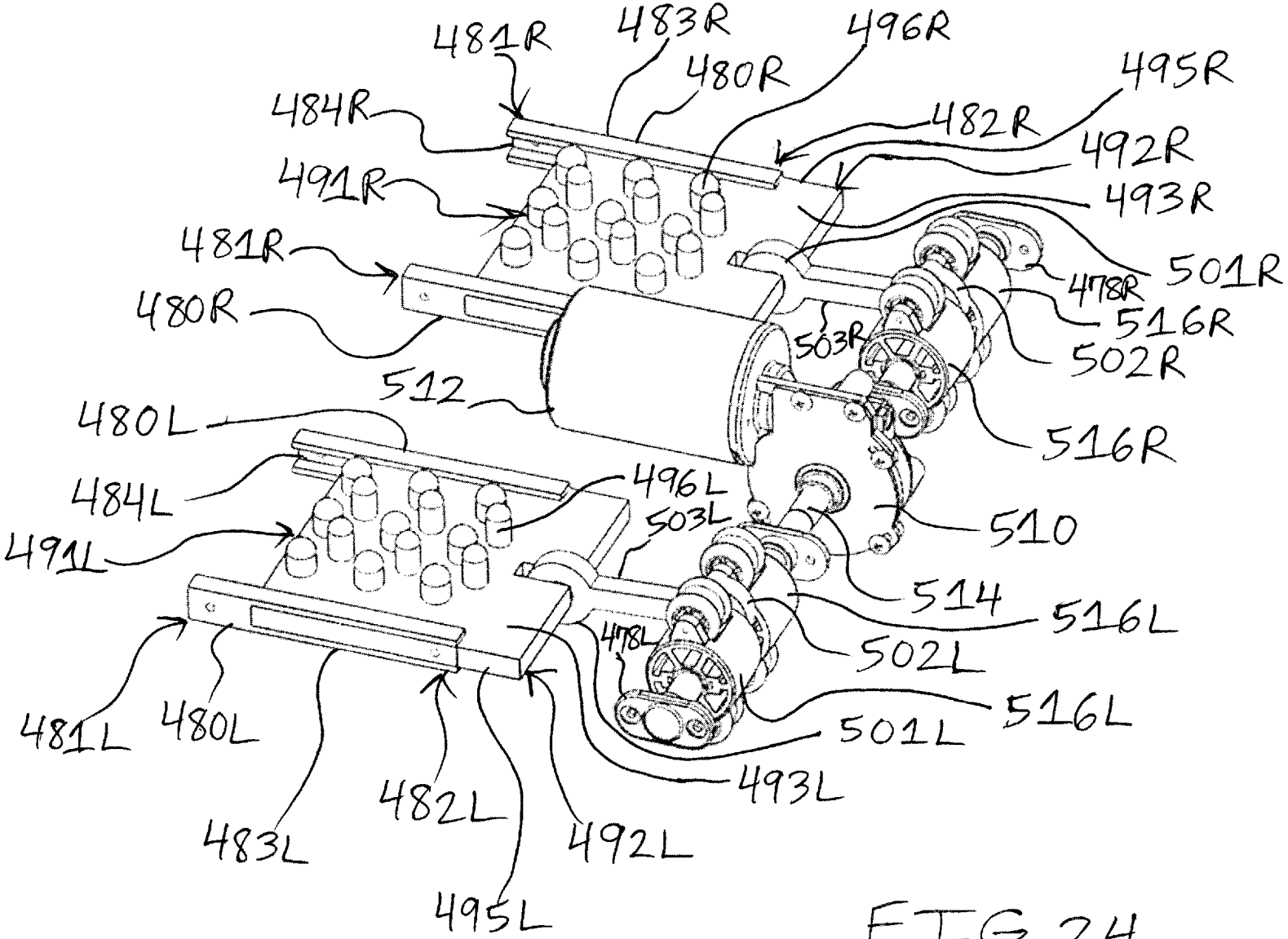
FIG. 24 is a rear, left side, perspective view of the feet massage device of FIG. 21, without partial housing frames.

As best shown in FIGS. 22-24, each of the pair of plate guiders 480R, 480L has a first or front end 481R, 481L, a second or rear end 482R, 482L, a body 483R, 483L extending between the ends 481R, 481L, 482R, 482L, and a channel 484R, 484L for receiving and guiding the massage plate 490R, 490L during operation. The pair of plate guiders 480R, 480L are secured, attached, fastened, fixed or mounted under the corresponding top 473R, 473L of the partial housing frame 470R, 470L, and help to guide the massage plate 490R, 490L move forwardly, or alternatively rearwardly, during operation.

As best shown in FIGS. 22-24, each massage plate 490R, 490L has a first or front end 491R, 491L, a second or rear end 492R, 492L, a top surface 493R, 493L, a bottom surface 494R, 494L, a pair of sides 495R, 495L, and raised accupressure points 496R, 496L. The sides 495R, 495L of the massage plate 490R, 490L are positioned within the channel 484R, 484L of the corresponding pair of plate guiders 480R, 480L such that the massage plate 490R, 490L, with the raised accupressure points 496R, 496L, may be displaced, moved or slid forwardly, or alternatively rearwardly, during operation via the corresponding rotational direction of the driving, rotational shaft 514 and large rollers 516R, 516L.

As best shown in FIGS. 21-23, the shaft support bearings or bushings 478R, 478L are secured, attached, fastened, fixed or mounted to the sides 474R, 474L of the partial housing frame 470R, 470L, and supports the driving, rotational shaft 514.

As best shown in FIG. 24, each circular-to-linear motion translator 500R, 500L has a first or front end 501R, 501L, a second or rear end 502R, 502L, and a body 503R, 503L extending between the ends 501R, 501L, 502R, 502L. The first or front end 501R, 501L is operationally connected to or in operational communication with the second or rear end 492R, 492L of the massage plate 490R, 490L, while the second or rear end 502R, 502L is operationally connected to or in operational communication with the larger rollers 516R, 516L such that the circular-to-linear motion translator 500R, 500L helps to displace, move or slide the massage plate 490R, 490L forwardly, or alternatively rearwardly, during operation via the corresponding rotational direction of the driving, rotational shaft 514 and larger rollers 516R, 516L.

As best shown in FIGS. 22-24, the feet roller motor gearbox 510 is preferably adapted for reducing speed and increasing torque. The feet roller motor gearbox 510 is in operational communication with or connected to the feet roller motor 512 such that the feet roller motor gearbox 510 is powered by the feet roller motor 512 to rotate the larger rollers 516R, 516L and the smaller rollers 517R, 517L of acupressure points 518R, 518L located on or about the outer surface of the body of each larger roller 516R, 516L via the driving, rotational shaft 514. The feet roller motor gearbox 510 may be any applicable gearbox or gear device known to one of ordinary skill in the art.

As best shown in FIGS. 22-24, the feet roller motor 512 activates the the feet roller motor gearbox 510 for operation. The feet roller motor 512 is preferably a bi-directional motor, and may be any applicable motor known to one of ordinary skill in the art.

In this non-limiting example, as best shown in FIGS. 22-24, the driving, rotational shaft 514 is operational connected to or with the feet roller motor gearbox 510, feet roller motor 512, larger rollers 516R, 516L, smaller rollers 517R, 517L of acupressure points 518R, 518L, and circular-to-linear motion translator 500R, 500L. The driving, rotational shaft 514 is preferably positioned about the rear ends 472R, 472L of the partial housing frames 470R, 470L. There are two larger rollers 516R and two larger rollers 516L, and there are two smaller rollers 517R, 517L located on or about the outer surface of the body of each larger roller 516R, 516L. It is preferred that each of the smaller rollers 517R, 517L have uneven surface and rotate approximately on or about the outer surface of the body of the corresponding larger roller 516R, 516L to provide acupressure points 518R, 518L.

As a non-limiting example and as shown in FIG. 28, the foot detection sensor/switch 522 (not shown in this embodiment) may be secured, attached, fastened, fixed or mounted on a spring-loaded pedal 520 that is positioned within and about the second or rear end 472R, 472L of one of the partial housing frames 470R, 470L. It is preferred that the spring of the spring-loaded pedal 520 always pushes up. A cantilever 524 of the spring-loaded pedal 520 is preferably positioned above the corresponding larger roller(s) 516R, 516L and smaller rollers 517R, 517L. When an applicable foot of the user U presses on the spring-loaded pedal 520, an output sensor/switch changes. This change is detected by a microprocessor and software and extend the linear extension actuator automatically. This will automatically adjust the footrest (combination of the legs and feet frame 410 and linear sliding device 540) to fit with the user's height or leg length.

As a non-limiting example and as shown in FIG. 21, the first or right foot massage device 462R and second or left foot massage device 462L are secured, attached, fastened, fixed or mounted to and supported by the legs and feet frame 410 within the area defined by the horizontal sections 428R, 428L of the guide bars 420R, 420L. The feet roller motor gearbox 510 and feet roller motor 512 are positioned between the first or right foot massage device 462R and second or left foot massage device 462L at about the rear ends 472R, 472L of the partial housing frames 470R, 470L of the first or right and second or left foot massage devices 462R, 462L.

Figure 25:
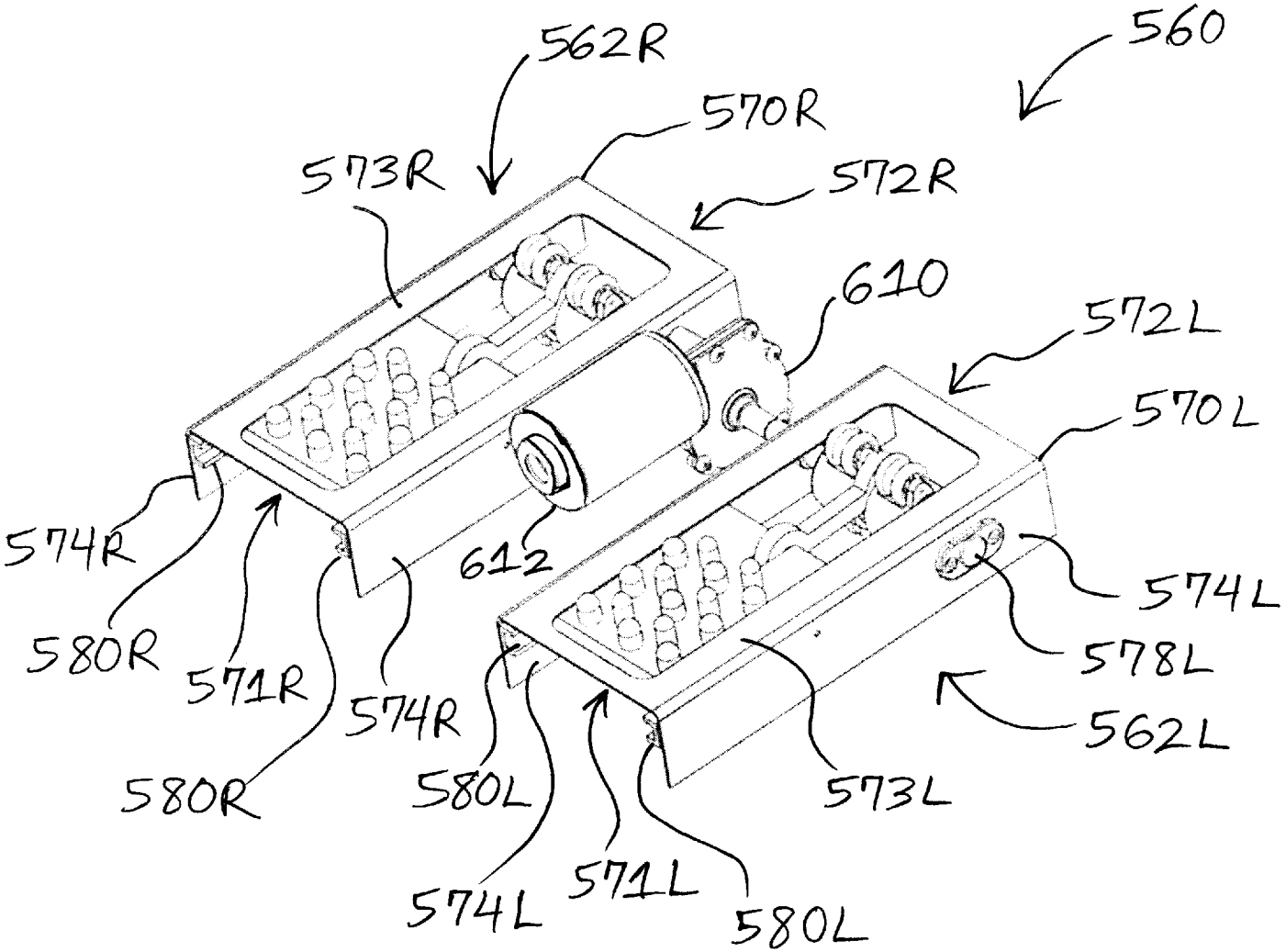
FIG. 25 is a front, left side, top, perspective view of a calves massage device of the legs and feet massage apparatus of FIG. 21.
Figure 26:
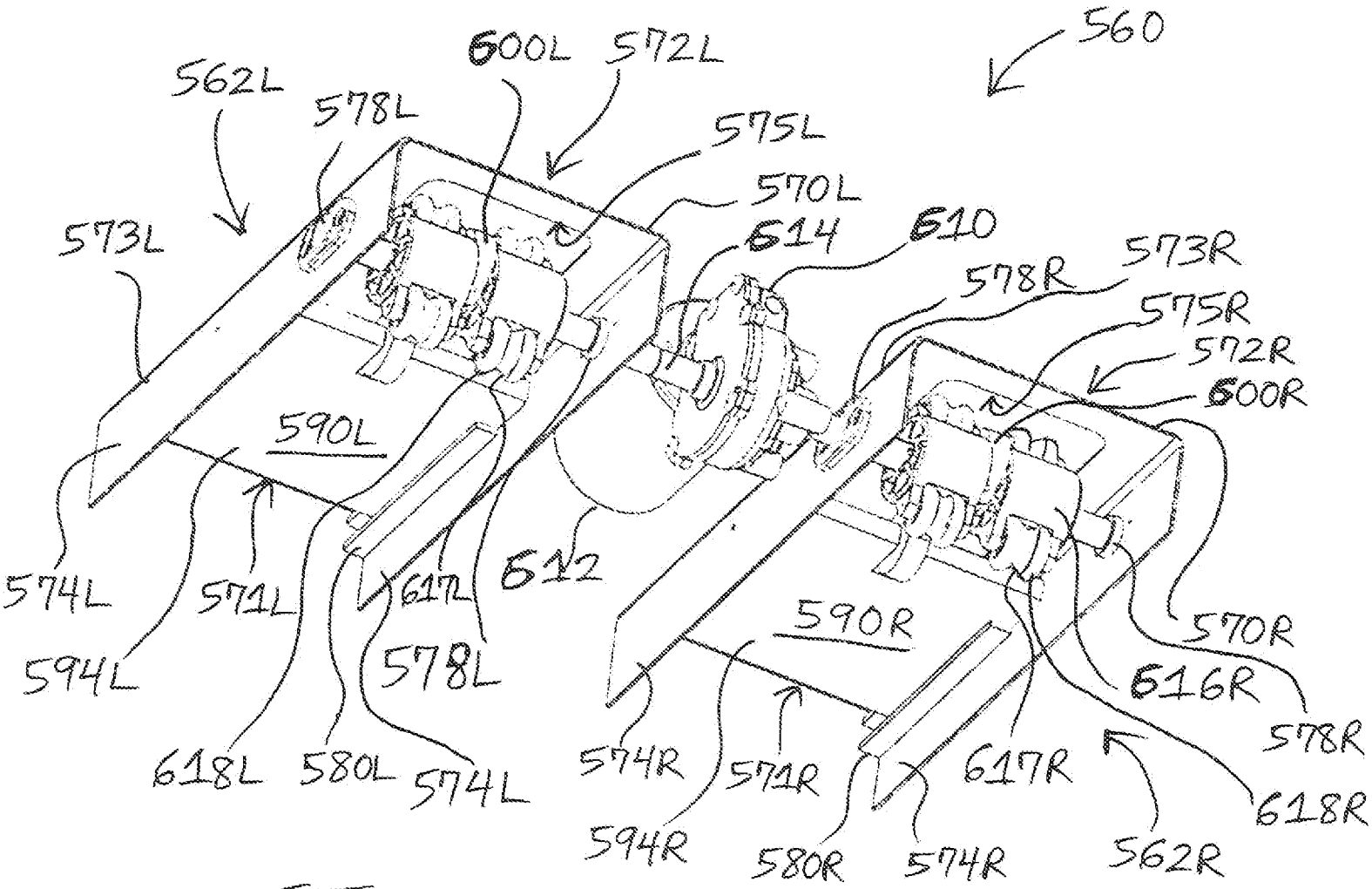
FIG. 26 is a rear, left side, bottom, perspective view of the calves massage device of FIG. 25.

As a non-limiting example and as shown in FIGS. 25-27, the calves massage device 560 is preferably the same as or substantially similar (especially in structure and in function) to the feet massage device 460, and preferably includes a first or right calf massage device 562R, a second or left calf massage device 562L, a calves roller motor gearbox 610, a calves roller motor 612, and a driving, rotational shaft 614.

As best shown in FIGS. 25-27, each of the first or right and second or left calves massage devices 562R, 562L includes a partial housing frame 570R, 570L, a pair of plate guiders 580R, 580L, a massage plate 590R, 590L with raised accupressure points 596R, 596L, shaft support bearings or bushings 578R, 578L, a circular-to-linear motion translator 600R, 600L, a pair of larger rollers 616R, 616L mounted on the driving, rotational shaft 614, and smaller rollers 617R, 617L of acupressure points 618R, 618L located on or about the outer surface of the body of each larger roller 616R, 616L.

As best shown in FIGS. 25 and 26, each partial housing frame 570R, 570L has a first or front end 571R, 571L, a second or rear end 572R, 572L, a top 573R, 573L, a pair of sides 574R, 574L, and a cutout window 575R, 575L. The cutout window 575R, 575L allows the raised accupressure points 596R, 596L on the massage plate 590R, 590L to protrude sufficiently above the top 573R, 573L such that the raised accupressure points 596R, 596L are able to provide massage effects or benefits to the corresponding back of the user's calves during operation.

As best shown in FIGS. 25-27, each of the pair of plate guiders 580R, 580L has a first or front end 581R, 581L, a second or rear end 582R, 582L, a body 583R, 583L extending between the ends 581R, 581L, 582R, 582L, and a channel 584R, 584L for receiving and guiding the massage plate 590R, 590L during operation. The pair of plate guiders 580R, 580L are secured, attached, fastened, fixed or mounted under the corresponding top 573R, 573L of the partial housing frame 570R, 570L, and help to guide the massage plate 590R, 590L move upwardly, or alternatively downwardly, during operation.

As best shown in FIGS. 26 and 27, each massage plate 590R, 590L has a first or front end 591R, 591L, a second or rear end 592R, 592L, a top surface 593R, 593L, a bottom surface 594R, 594L, a pair of sides 595R, 595L, and raised accupressure points 596R, 596L. The sides 595R, 595L of the massage plate 590R, 590L are positioned within the channel 584R, 584L of the corresponding pair of plate guiders 580R, 580L such that the massage plate 590R, 590L, with the raised accupressure points 596R, 596L, may be displaced, moved or slid forwardly, or alternatively rearwardly, during operation via the corresponding rotational direction of the driving, rotational shaft 614 and larger rollers 616R, 616L. Preferably, heat is applied to some, most or all of the acupressure points 596R, 596L to help blood circulation of the user. Heat can be applied to acupressure points 596R, 596L by any device (not shown) and/or method known to one of ordinary skill in the art.

As best shown in FIGS. 25-27, the shaft support bearings or bushings 578R, 578L are secured, attached, fastened, fixed or mounted to the sides 574R, 574L of the partial housing frame 570R, 570L, and supports the driving, rotational shaft 614.

As best shown in FIG. 27, each circular-to-linear motion translator 600R, 600L has a first or front end 601R, 601L, a second or rear end 602R, 602L, and a body 603R, 603L extending between the ends 601R, 601L, 602R, 602L. The first or front end 601R, 601L is operationally connected to or in operational communication with the second or rear end 592R, 592L of the massage plate 590R, 590L, while the second or rear end 602R, 602L is operationally connected to or in operational communication with the larger rollers 616R, 616L such that the circular-to-linear motion translator 600R, 600L helps to displace, move or slide the massage plate 590R, 590L upwardly, or alternatively downwardly, during operation via the corresponding rotational direction of the driving, rotational shaft 614 and larger roller 616R, 616L.

As best shown in FIGS. 25-27, the calves roller motor gearbox 610 is preferably adapted for reducing speed and increasing torque. The calves roller motor gearbox 610 is in operational communication with or connected to the calves roller motor 612 such that the calves roller motor gearbox 610 is powered by the calves roller motor 612 to rotate the larger rollers 616R, 616L and the smaller rollers 617R, 617L of acupressure points 618R, 618L located on or about the outer surface of the body of each larger roller 616R, 616L via the driving, rotational shaft 614. The calves roller motor gearbox 610 may be any applicable gearbox or gear device known to one of ordinary skill in the art.

As best shown in FIGS. 25-27, the calves roller motor 612 activates the the calves roller motor gearbox 610 for operation. The calves roller motor 612 is preferably a bi-directional motor, and may be any applicable motor known to one of ordinary skill in the art.

In this non-limiting example and as best shown in FIGS. 25-27, the driving, rotational shaft 614 is operational connected to or with the calves roller motor gearbox 610, calves roller motor 612, larger rollers 616R, 616L, smaller rollers 617R, 617L of acupressure points 618R, 618L, and circular-to-linear motion translator 600R, 600L. The driving, rotational shaft 614 is preferably positioned about the rear ends 572R, 572L of the partial housing frames 570R, 570L. There are two larger rollers 616R and two larger rollers 616L, and there are two smaller rollers 617R, 617L located on or about the outer surface of the body of each corresponding larger roller 616R, 616L. It is preferred that the smaller rollers 617R, 617L have uneven surface and rotate approximately on or about the outer surface of the body of the corresponding larger roller 616R, 616L to provide acupressure points 618R, 618L.

As a non-limiting example, the first or right calf massage device 562R and second or left calf massage device 562L are secured, attached, fastened, fixed or mounted to and supported by the legs and feet frame 410 within the area defined by the vertical sections 426R, 426L of the guide bars 420R, 420L (not shown). The calves roller motor gearbox 610 and calves roller motor 612 are positioned between the first or right calf massage device 562R and second or left calf massage device 562L at about the rear ends 572R, 572L of the partial housing frames 570R, 570L of the first or right and second or left calf massage devices 562R, 562L.

Figure 30:
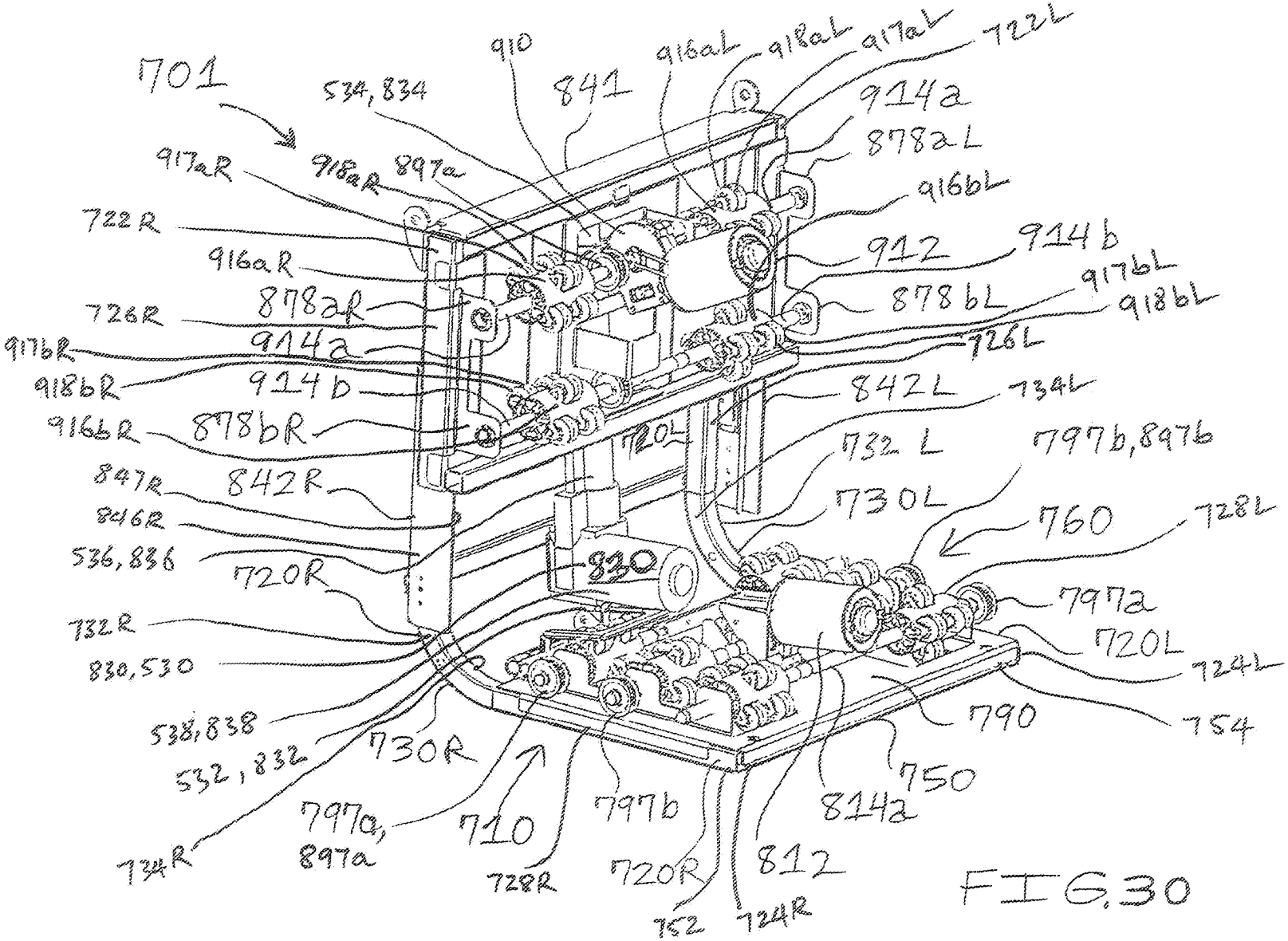
FIG. 30 is a front, right side, perspective view of an embodiment of a further legs and feet massage apparatus according to the present invention.

The linear extension actuator (not shown in this embodiment but a substantially similar linear extension actuator 830 is shown in another embodiment in FIG. 30) includes a first end 532, a second end 534, an extendable and retractable body 536 disposed between the ends 532, 534, and an actuator motor 538. The extendable and retractable body 536 can be extended from and/or retracted to an original position via the actuator motor 538. The linear extension actuator may be any applicable actuator or linear extension actuator known to one of ordinary skill in the art.

As best shown in FIG. 21, the linear sliding device 540 includes a pair of vertical bars 542R, 542L and a connecting bar 541. Preferably, the vertical bars 542R, 542L are substantially similar or mirror images of one another. Each vertical bar 542R, 542L includes an upper or first end 543R, 543L, a lower or second end 544R, 544L, a body 545R, 545L, an outer side 546R, 546L, an inner side 547R, 547L, and a channel or groove 548R, 548L. The body 545R, 545L is disposed between the first end 543R, 543L and second end 544R, 544L. The connecting bar 541 is secured, attached, fastened, fixed or mounted to the upper ends 543R, 543L of the vertical bar 542R, 542L. The linear sliding device 540 is slidably engaged with the upper or vertical section 426R, 426L of the guide bars 420R, 420L via the channel 548R, 548L. The linear sliding device 540, along with the set of driving, rotational shaft 614, larger rollers 616R, 616L, and smaller rollers 617R, 617L of acupressure points 618R, 618L, can be raised upwardly from and/or lowered downwardly to an original position via the linear extension actuator such that users with different heights or leg lengths can be accommodated on the same massage chair.

As best shown in FIG. 21, the pair of rotating wheels 550R, 550L are adapted for providing support to the extension and retraction of the linear sliding device 540 via the linear extension actuator. Preferably each rotating wheel 550R, 550L is positioned on the corresponding outer side 432R, 432L and bend section 430R, 430L of the guide bars 420R, 420L.

As best shown in FIGS. 41-43, 45 and 48, each of the plurality of arrays or arrangements of fluid-actuated devices 660R, 660L is positioned about the corresponding side of a calf and/or corresponding side of a foot of the user. The fluid-actuated devices 660R, 660L may be airbags, air cells, bags or cells filled with water, gel and the like, any fluid-actuated devices known to one of ordinary skill in the art, or any combination thereof. Preferably, the fluid-actuated devices 660R, 660L are airbags or air cells, wherein the airbags or air cells are any applicable airbags or air cells known to one of ordinary skill in the art. As an alternative to an array or arrangement of fluid-actuated devices 660R, 660L, a single fluid-actuated device (not shown) of a size that is similar to, substantially similar to, or exactly the same as the size of the entire array or arrangement of fluid-actuated devices 660R, 660L may be included in the legs and feet massage apparatus 401 or other massage apparatuses related to the foot(feet) and calf(ves) that are disclosed in this application.

The at least one pressure sensor (not shown) related to fluid-actuated devices 660R, 660L is able to measure and determine the pressure applied by the fluid-actuated devices 660R, 660L to the user's related body part such that the applied pressure can be maintained, increased or decreased. The at least one pressure sensor 970 can be any pressure sensor known to one of ordinary skill in the art.

In use, with regard to providing massage benefits or effects to the bottoms or soles of the feet of the user U, the footrest (combination of the legs and feet frame 410 and linear sliding device 540) preferably automatically adjusts to fit with the user's height or leg length when the applicable foot of the user U presses on the spring-loaded pedal 520. The first or right foot massage device 462R and second or left foot massage device 462L can then be activated for operation by the feet roller motor 512 activating or powering the feet roller motor gearbox 510 to rotate the driving, rotational shaft 514 such that the larger rollers 516R, 516L mounted on the driving, rotational shaft 514 and the smaller rollers 517R, 517L of acupressure points 518R, 518L located on or about the outer surface of the body of each larger roller 516R, 516L are also rotated and then able to provide massage benefits or effects to the bottoms or soles of the feet of the user U. Different parts or sections of the bottoms or soles of the feet of the user U are able to receive massage benefits or effects at different particular moments or times by the massage plate 490R, 490L, with the raised accupressure points 496R, 496L, being displaced, moved or slid forwardly, or alternatively rearwardly, as a result of the circular-to-linear motion translator 500R, 500L being displaced, moved or slid forwardly, or alternatively rearwardly, via the corresponding rotational direction of the driving, rotational shaft 514.

In use, with regard to providing massage benefits or effects to the backs of the calves of the user U, the footrest (combination of the legs and feet frame 410 and linear sliding device 540) preferably automatically adjusts to fit with the user's height or leg length when the applicable foot of the user U presses on the spring-loaded pedal 520. The first or right calf massage device 562R and second or left calf massage device 562L can then be activated for operation by the calves roller motor 612 activating or powering the calves roller motor gearbox 610 to rotate the driving, rotational shaft 614 such that the larger rollers 616R, 616L mounted on the driving, rotational shaft 614 and the smaller rollers 617R, 617L of acupressure points 618R, 618L located on or about the outer surface of the body of each larger roller 616R, 616L are also rotated and then able to provide massage benefits or effects to the backs of the calves of the user U. Different parts or sections of the backs of the calves of the user U are able to receive massage benefits or effects at different particular moments or times by the massage plate 590R, 590L, with the raised accupressure points 596R, 596L, being displaced, moved or slid upwardly, or alternatively downwardly, as a result of the circular-to-linear motion translator 600R, 600L being displaced, moved or slid upwardly, or alternatively downwardly, via the corresponding rotational direction of the driving, rotational shaft 614.

The first or right foot massage device 462R and second or left foot massage device 462L can be activated for operation in tandem with, or separately from, the activation for operation of the first or right calf massage device 562R and second or left calf massage device 562L by a software program and/or a mechanical mechanism or device.

Referring to FIGS. 29-32 and as a different embodiment from the legs and feet massage apparatus 401 of this additional aspect, the legs and feet massage apparatus 701 differs from the legs and feet massage apparatus 401 in that the legs and feet massage apparatus 701 does not include the partial housing frames 470R, 470L, 570R, 570L, pairs of plate guiders 480R, 480L, 580R, 580L, massage plates 490R, 490L, 590R, 590L with raised accupressure points 496R, 496L, 596R, 596L, circular-to-linear motion translators 500R, 500L, 600R, 600L, and a pair of rotating wheels 550R, 550L. As shown in FIG. 29, the legs and feet massage apparatus 701 may be secured, attached, fastened, fixed or mounted to a chair (such as at or about a lower end of a body frame, similar to what is shown in FIGS. 18-20), preferably a massage chair, by a securing device, such as, but not limited to, securing device 704. In addition, some, most or all of the legs and feet massage apparatus 701 may be positioned inside or under a chair covering material (preferably the same or substantially the same as the chair covering material disclosed in other aspects of the present invention).

In addition, the legs and feet massage apparatus 701 differs from the legs and feet massage apparatus 401 in that the legs and feet massage apparatus 701 includes: a plate 790; a plurality of sets of driving, rotational shafts 814*a*, 814*b*, 814*c*, larger rollers 816*a*R, 816*a*L, 816*b*R, 816*b*L, 816*c*R, 816*c*L, smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L, and shaft support bearings or bushings 778*a*R, 778*a*L, 778*b*R, 778*b*L, 778*c*R, 778*c*L related to providing feet massage (instead of one set of driving, rotational shaft 514, larger rollers 516R, 516L, smaller rollers 517R, 517L of acupressure points 518R, 518L, and shaft support bearings or bushings 478R, 478L related to providing feet massage with regard to the legs and feet massage apparatus 401); and a plurality of sets of driving, rotational shafts 914*a*, 914*b*, larger rollers 916*a*R, 916*a*L, 916*b*R, 916*b*, smaller rollers 917*a*R, 917*a*L, 917*b*R, 917*b*L of acupressure points 918*a*R, 918*a*L, 918*b*R, 918*b*L, and shaft support bearings or bushings 878*a*R, 878*a*L, 878*b*R, 878*b*L related to providing calves massage (instead of one set of driving, rotational shaft 614, larger rollers 616R, 616L, smaller rollers 617R, 617L of acupressure points 618R, 618L, and shaft support bearings or bushings 578R, 578L related to providing calves massage with regard to the legs and feet massage apparatus 401).

Figure 31:
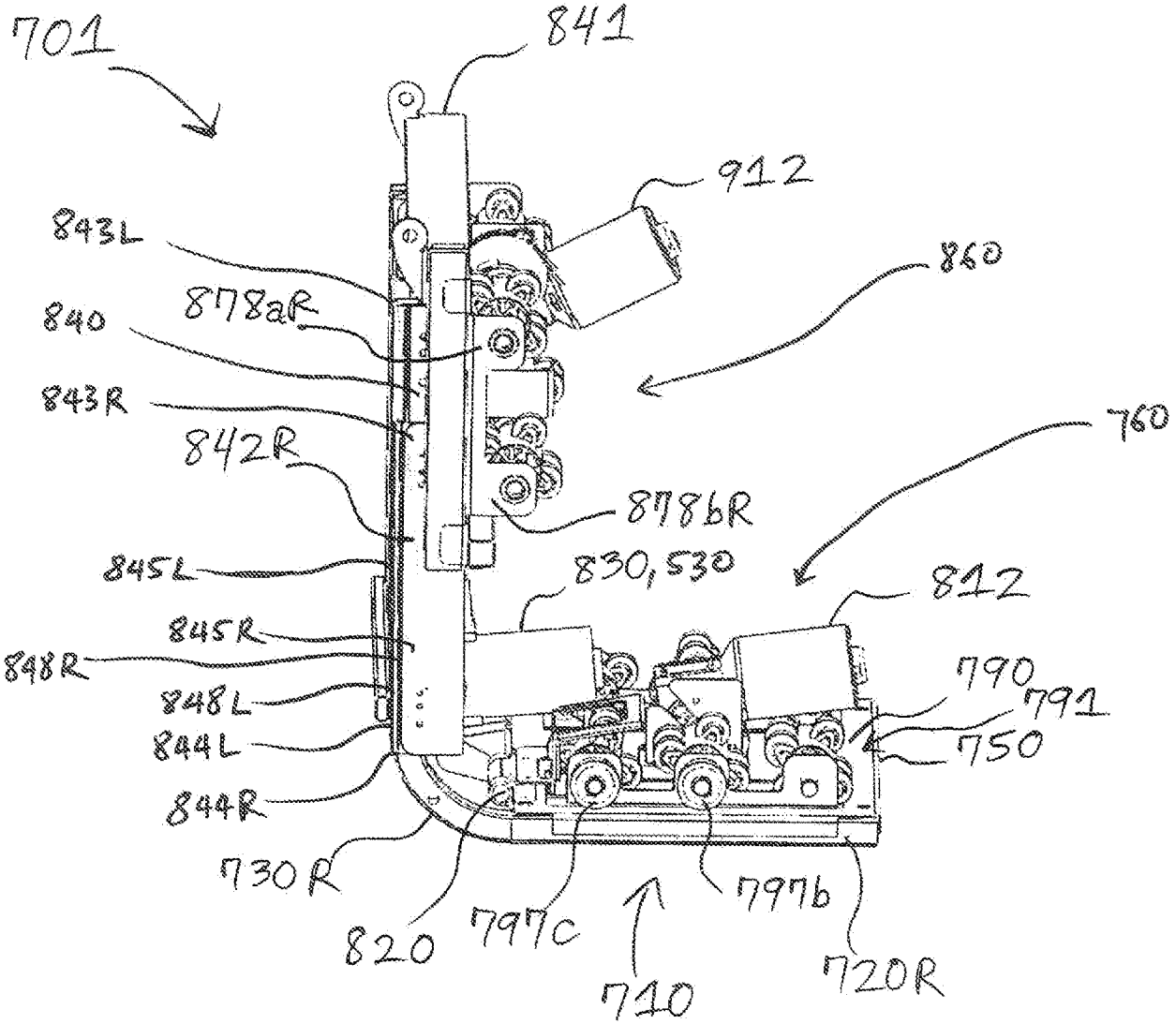
FIG. 31 is a right side view of the legs and feet massage apparatus of FIG. 30.
Figure 32:
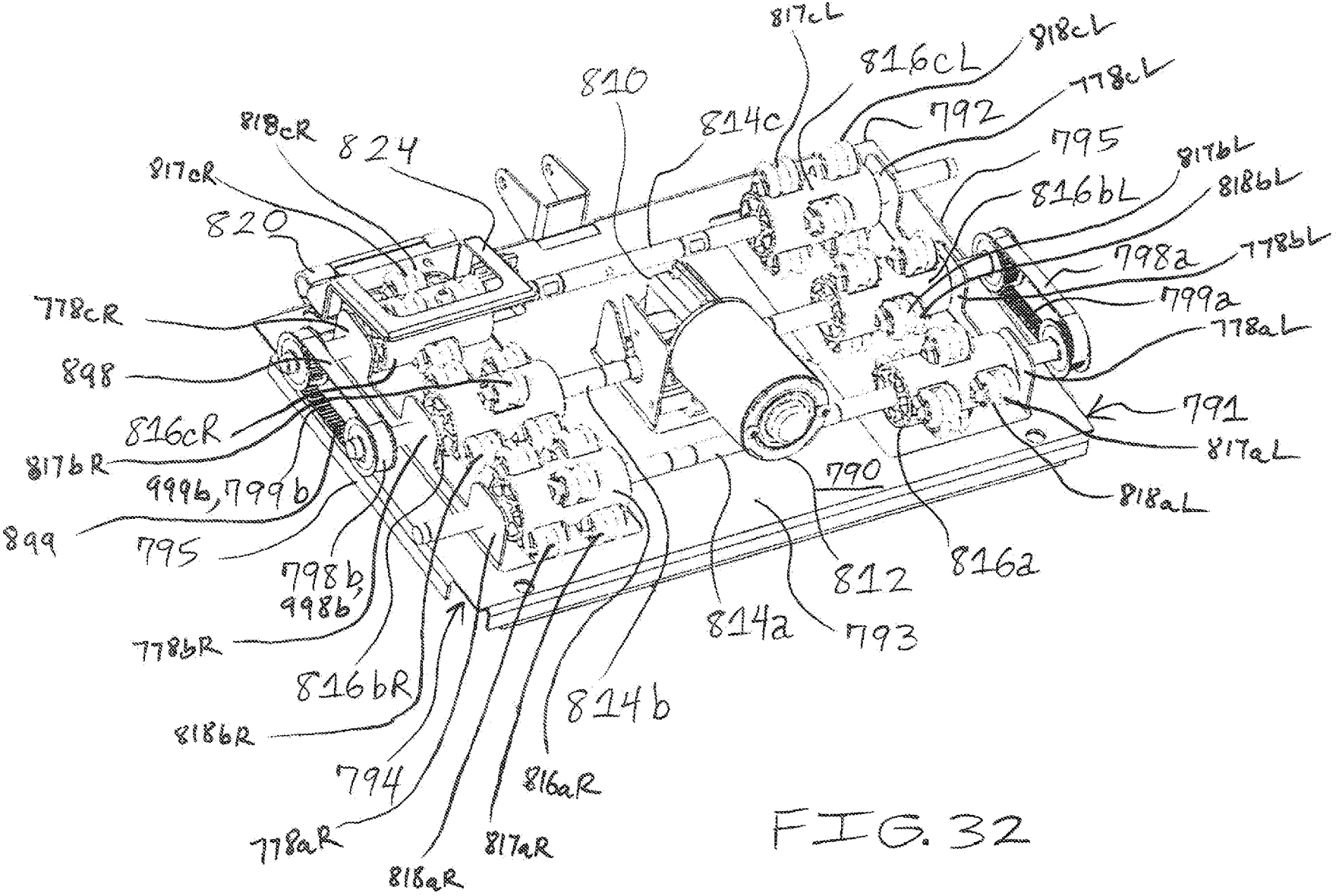
FIG. 32 is a front, right side, perspective view of a feet massage device of the legs and feet massage apparatus of FIG. 30.

In this non-limiting example of the different embodiment and as best shown in FIGS. 30-32, there are three driving, rotational shafts 814*a*, 814*b*, 814*c* related to feet massage that are positioned parallel to one another, operationally connected to one another by the system of pulley gears 797*a*, 797*b*, 797*c* and belts 798*a*, 798*b* with teeth 799*a*, 799*b*, and run at the same speed. There are two driving, rotational shafts 914*a*, 914*b* related to calves massage that are positioned parallel to one another, operationally connected to one another by the system of pulley gears 897*a*, 897*b* and belt 898 with teeth 899 (not shown but preferably substantially similar to or exactly the same as other belts 798*a*, 798*b* with teeth 799*a*, 799*b*), and run at the same speed. The advantages of this non-limiting example are to reduce the plurality of motors that may be required, the cost, the power consumption, and the space.

As best shown in FIGS. 30-32, the legs and feet massage apparatus 701 includes a legs and feet frame 710, a feet massage device 760 (preferably motorized), and a calves massage device 860 (preferably motorized). The legs and feet massage apparatus 701 may also include a linear extension actuator 830, a linear sliding device 840, a foot detection sensor/switch 822, a plurality of arrays or arrangements of fluid-actuated devices 960R, 960L (such as, but not limited to, airbags, air cells, water bags, water cells, gel bags, gel cells, and any combination thereof), and/or at least one pressure sensor (not shown) related to fluid-actuated devices 960R, 960L. Each array or arrangement of fluid-actuated devices 960R, 960L is positioned about the corresponding side of a calf and/or corresponding side of a foot of the user during operation.

As other embodiments of this additional aspect, a massage apparatus related to the legs and/or feet includes a frame, such as, but not limited to, the legs and feet frame 710, and either the feet massage device 760 (preferably motorized) or calves massage device 860 (preferably motorized). Embodiments with either the feet massage device 760 (preferably motorized) or calves massage device 860 (preferably motorized) may or may not also include the linear extension actuator 830, linear sliding device 840, foot detection sensor/switch 822, a plurality of arrays or arrangements of fluid-actuated devices 960R, 960L (such as, but not limited to, airbags, air cells, water bags, water cells, gel bags, gel cells, and any combination thereof), and/or at least one pressure sensor (not shown) related to fluid-actuated devices 960R, 960L.

As best shown in FIGS. 30 and 31, the legs and feet frame 710 includes a pair of opposing guide bars 720R, 720L, an upper connecting bar 841, and a lower connecting bar 750. The pair of opposing guide bars 720R, 720L provide linear motion and guiding for frame extention and retraction to fit with users of different heights or leg lengths and also provide the motions for foot and body stretching massage effects. It is preferred that the legs and feet frame 710 is the same or substantially the same as the legs and feet frame 410.

Preferably, the guide bars 720R, 720L are substantially similar or mirror images of one another. As best shown in FIGS. 30 and 31, each of the guide bars 720R, 720L includes: an upper or first end 722R, 722L; a lower or second end 724R, 724L; an upper or vertical section 726R, 726L located adjacent the upper end 722R, 722L; a lower or horizontal section 728R, 728L located about the lower end 724R, 724L; a bend section 730R, 730L connecting the vertical section 726R, 726L and horizontal section 728R, 728L of the corresponding guide bars 720R, 720L; an outer side 732R, 732L; and an inner side 734R, 734L. In this configuration, the extendable or lower portion of the frame has an "L" shape that includes the horizontal section 728R, 728L and a portion of the bend section 730R, 730L, and the upper portion of the "L" includes the vertical section 726R, 726L and also a portion of the bend section 730R, 730L.

As best shown in FIGS. 30 and 31, lower connecting bar 750 has a first end 752, a second end 754, and a body portion 756 extending from the first end 752 to the second end 754. The lower connecting bar 750 is secured, attached, fastened, fixed or mounted to the lower ends 724R, 724L of the guide bars 720R, 720L. The upper connecting bar 841 and lower connecting bar 750 help to stabilize the legs and feet frame 710 and the positioning of the guide bars 720R, 720L relative to one another.

As a non-limiting example and as shown in FIGS. 30-32, the feet massage device 760 preferably includes a plate 790, a plurality of sets of driving, rotational shafts 814*a*, 814*b*, 814*c*, larger rollers 816*a*R, 816*a*L, 816*b*R, 816*b*L, 816*c*R, 816*c*L, smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L, and shaft support bearings 778*a*R, 778*a*L, 778*b*R, 778*b*L, 778*c*R, 778*c*L, a system of pulley gears 797*a*, 797*b*, 797*c* and belts 798*a*, 798*b* with teeth 799*a*, 799*b*, a feet roller motor gearbox 810, and a feet roller motor 812.

As best shown in FIGS. 30-32, the plate 790 has a first or front end 791, a second or rear end 792, a top surface 793, a bottom surface 794, and a pair of sides 795. The plate 790 is secured, attached, fastened, fixed or mounted to the lower or horizontal section 728R, 728L of the guide bars 720R, 720L.

As best shown in FIG. 32, the plurality of sets of driving, rotational shafts 814*a*, 814*b*, 814*c*, larger rollers 816*a*R, 816*a*L, 816*b*R, 816*b*L, 816*c*R, 816*c*L, smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L, and shaft support bearings 778*a*R, 778*a*L, 778*b*R, 778*b*L, 778*c*R, 778*c*L are three sets, and are secured, attached, fastened, fixed or mounted to the top surface 793 of the plate 790. However, other non-limiting examples may be one set, or two or four or more sets. As best shown in FIG. 32, the three driving, rotational shafts 814*a*, 814*b*, 814*c* related to feet massage are positioned parallel to one another, operationally connected to one another by the system of pulley gears 797*a*, 797*b*, 797*c* and belts 798*a*, 798*b* with teeth 799*a*, 799*b*, and run at the same speed. Each driving, rotational shaft 814*a*, 814*b*, 814*c* is operational connected to or with larger rollers 816*a*R, 816*a*L, 816*b*R, 816*b*L, 816*c*R, 816*c*L, and smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L located on or about the outer surface of the body of the larger rollers 816*a*R, 816*a*L, 816*b*R, 816*b*L, 816*c*R, 816*c*L such that the larger rollers 816*a*R, 816*b*R, 816*c*R (with corresponding smaller rollers 817*a*R, 817*b*R, 817*c*R positioned on or about the outer surface of the body of each larger roller 816*a*R, 816*b*R, 816*c*R) are in alignment with one another for providing massage effects or benefits to a right foot of the user U while larger rollers 816*a*L, 816*b*L, 816*c*L (with corresponding smaller rollers 817*a*L, 817*b*L, 817*c*L positioned on or about the outer surface of the body of each larger roller 816*a*L, 816*b*L, 816*c*L) are in alignment with one another for providing massage effects or benefits to a left foot of the user U. It is preferred that the smaller rollers 817*a*R, 817*a*L, 817*b*R, 817*b*L, 817*c*R, 817*c*L have uneven surface and rotate approximately on or about the outer surface of the body of the larger rollers 816*a*R, 816*a*L, 816*b*R, 816*b*L, 816*c*R, 816*c*L to provide acupressure points 818*a*R, 818*a*L, 818*b*R, 818*b*L, 818*c*R, 818*c*L. In addition, the second or middle driving, rotational shaft 814*b* is operational connected to or with the feet roller motor gearbox 810 and feet roller motor 812 such that the second or middle driving, rotational shaft 814*b* can be rotated when the feet roller motor gearbox 810 and feet roller motor 812 are activated for operation. Furthermore, the second or middle driving, rotational shaft 814*b* and its corresponding pulley gear 797*b*, at one end of the second or middle driving, rotational shaft 814*b*, are operational connected to or with the first or front driving, rotational shaft 814*a* and its pulley gear 797*a* via a first belt 798*a* with teeth 799*a*, while the second or middle driving, rotational shaft 814*b* and its pulley gear 797*b*, at the other end of the second or middle driving, rotational shaft 814*b*, are also operational connected to or with the third or rear driving, rotational shaft 814*c* and its pulley gear 797*c* via a second belt 998*b* with teeth 999*b*. It is preferred that each set of driving, rotational shafts 814*a*, 814*b*, 814*c*, larger rollers 816*a*R, 816*a*L, 816*b*R, 816*b*L, 816*c*R, 816*c*L, and smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L is similar in structure and function to the set of driving, rotational shaft 514, larger rollers 516R, 516L, and smaller rollers 517R, 517L of acupressure points 518R, 518L.

As best shown in FIGS. 30-32, the shaft support bearings 778*a*R, 778*a*L, 778*b*R, 778*b*L, 778*c*R, 778*c*L are secured, attached, fastened, fixed or mounted to or about the corresponding sides 795 of the plate 790, and supports the driving, rotational shafts 814*a*, 814*b*, 814*c*.

As best shown in FIGS. 30-32, the feet roller motor gearbox 810 is preferably adapted for reducing speed and increasing torque. The feet roller motor gearbox 810 is in operational communication with or connected to the feet roller motor 812 such that the feet roller motor gearbox 810 is powered by the feet roller motor 812 to rotate the larger rollers 816*a*R, 816*a*L, 816*b*R, 816*b*L, 816*c*R, 816*c*L and the smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L located on or about the outer surface of the body of each larger roller 816*a*R, 816*a*L, 816*b*R, 816*b*L, 816*c*R, 816*c*L via the corresponding driving, rotational shafts 814*a*, 814*b*, 814*c*. The feet roller motor gearbox 810 may be any applicable gearbox or gear device known to one of ordinary skill in the art. It is preferred that the feet roller motor gearbox 810 is the same or substantially the same as the feet roller motor gearbox 510 and calves roller motor gearbox 610.

As best shown in FIGS. 30-32, the feet roller motor 812 activates the the feet roller motor gearbox 810 for operation. The feet roller motor 812 is preferably a bi-directional motor, and may be any applicable motor known to one of ordinary skill in the art. It is preferred that the feet roller motor 812 is the same or substantially the same as the feet roller motor 512 and calves roller motor 612.

As a non-limiting example and as shown in FIGS. 28 and 32, the foot detection sensor/switch 822 may be secured, attached, fastened, fixed or mounted on a spring-loaded pedal 820 that is positioned within and about the second or rear end 792 and one of the sides 795 of the plate 790. It is preferred that the spring of the spring-loaded pedal 820 always pushes up. A cantilever 824 of the spring-loaded pedal 820 is preferably positioned above the corresponding larger roller 816*c*R, 816*c*L and smaller rollers 817*c*R, 817*c*L. When an applicable foot of the user U presses on the spring-loaded pedal 820, an output sensor/switch changes. This change is detected by a microprocessor and software and extend the linear extension actuator 830 automatically. This will automatically adjust the footrest (combination of the legs and feet frame 710 and linear sliding device 840) to fit with the user's height or leg length. It is preferred that the spring-loaded pedal 820 with the foot detection sensor/switch 822 is the same or substantially the same as the spring-loaded pedal 520 with the foot detection sensor/switch 522.

As best shown in FIGS. 30 and 31, the linear extension actuator 830 includes a first end 832, a second end 834, an extendable and retractable body 836 disposed between the ends 832, 834, and an actuator motor 838. The extendable and retractable body 836 can be extended from and/or retracted to an original position via the actuator motor 838. The linear extension actuator 830 may be any applicable actuator or linear extension actuator known to one of ordinary skill in the art. It is preferred that the linear extension actuator 830 is the same or substantially the same as the linear extension actuator.

As best shown in FIGS. 30 and 31, the linear sliding device 840 includes a pair of vertical bars 842R, 842L and a connecting bar 841. Preferably, the vertical bars 842R, 842L are substantially similar or mirror images of one another. Each vertical bar 842R, 842L includes an upper or first end 843R, 843L, a lower or second end 844R, 844L, a body 845R, 845L, an outer side 846R, 846L, an inner side 847R, 847L, and a channel or groove 848R, 848L. The body 845R, 845L is disposed between the first end 843R, 843L and second end 844R, 844L. The linear sliding device 840 is slidably engaged with the upper or vertical section 726R, 726L of the guide bars 720R, 720L via the channel 848R, 848L. The linear sliding device 840, along with the set of driving, rotational shafts 914*a*, 914*b*, larger rollers 916*a*R, 916*a*L, 916*b*R, 916*b*L, and smaller rollers 917*a*R, 917*a*L, 917*b*R, 917*b*L of acupressure points 918*a*R, 918*a*L, 918*b*R, 918*b*L, can be raised upwardly from and/or lowered downwardly to an original position via the linear extension actuator 830 such that users with different heights or leg lengths can be accommodated on the same massage chair. It is preferred that the linear sliding device 840 is the same or substantially the same as the linear sliding device 540.

As a non-limiting example and as shown in FIGS. 30 and 31, the calves massage device 860 preferably includes a plurality of sets of driving, rotational shafts 914*a*, 914*b*, larger rollers 916*a*R, 916*a*L, 916*b*R, 916*b*L, smaller rollers 917*a*R, 917*a*L, 917*b*R, 917*b*L of acupressure points 918*a*R, 918*a*L, 918*b*R, 918*b*L, and shaft support bearings 878*a*R, 878*a*L, 878*b*R, 878*b*L, a system of pulley gears 897*a*, 897*b* and belt 898 with teeth 899, a calves roller motor gearbox 910, and a calves roller motor 912.

As best shown in FIGS. 30 and 31, the plurality of sets of driving, rotational shafts 914*a*, 914*b*, larger rollers 916*a*R, 916*a*L, 916*b*R, 916*b*L, smaller rollers 917*a*R, 917*a*L, 917*b*R, 917*b*L of acupressure points 918*a*R, 918*a*L, 918*b*R, 918*b*L, and shaft support bearings 878*a*R, 878*a*L, 878*b*R, 878*b*L are two sets, and are secured, attached, fastened, fixed or mounted to the outer sides 846R, 846L and upper or first ends 843R, 843L of the vertical bars 842R, 842L of the linear sliding device 840. However, other non-limiting examples may be one set, or three or more sets. As best shown in FIGS. 30-31, the two driving, rotational shafts 914*a*, 914*b* related to calves massage are positioned parallel to one another, operationally connected to one another by the system of pulley gears 897*a*, 897*b* and one belt 898 (not shown) with teeth 899 (not shown), and run at the same speed. Each driving, rotational shaft 914*a*, 914*b* is operational connected to or with larger rollers 916*a*R, 916*a*L, 916*b*R, 916*b*L, and smaller rollers 917*a*R, 917*a*L, 917*b*R, 917*b*L of acupressure points 918*a*R, 918*a*L, 918*b*R, 918*b*L located on or about the outer surface of the body of the larger rollers 916*a*R, 916*a*L, 916*b*R, 916*b*L such that the larger rollers 916*a*R, 916*b*R (with corresponding smaller rollers 917*a*R, 917*b*R positioned on or about the outer surface of the body of each larger roller 916*a*R, 916*b*R) are in alignment with one another for providing massage effects or benefits to a right calf of the user U while larger rollers 916*a*L, 916*b*L (with corresponding smaller rollers 917*a*L, 917*b*L positioned on or about the outer surface of the body of each larger roller 916*a*L, 916*b*L) are in alignment with one another for providing massage effects or benefits to a left calf of the user U. It is preferred that the smaller rollers 917*a*R, 917*a*L, 917*b*R, 917*b*L have uneven surface and rotate approximately on or about the outer surface of the body of the larger rollers 916*a*R, 916*a*L, 916*b*R, 916*b*L to provide acupressure points 918*a*R, 918*a*L, 918*b*R, 918*b*L. In addition, the first or upper driving, rotational shaft 914*a* is operational connected to or with the calves roller motor gearbox 910 and calves roller motor 912 such that the first or upper driving, rotational shaft 914*a* can be rotated when the calves roller motor gearbox 910 and calves roller motor 912 are activated for operation. Furthermore, the first or upper driving, rotational shaft 914*a* and its corresponding pulley gear 897*a* are operational connected to or with the second or lower driving, rotational shaft 914*b* and its pulley gear 897*b* via a belt 898 with teeth 899. It is preferred that each set of driving, rotational shafts 914*a*, 914*b*, larger rollers 916*a*R, 916*a*L, 916*b*R, 916*b*L, and smaller rollers 917*a*R, 917*a*L, 917*b*R, 917*b*L of acupressure points 918*a*R, 918*a*L, 918*b*R, 918*b*L is similar in structure and function to the set of driving, rotational shaft 514, larger rollers 516R, 516L, and smaller rollers 517R, 517L of acupressure points 518R, 518L and also to each set of driving, rotational shafts 814*a*, 814*b*, 814*c*, larger rollers 816*a*R, 816*a*L, 816*b*R, 816*b*L, 816*c*R, 816*c*L, and smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L.

As best shown in FIGS. 30 and 31, the shaft support bearings 878*a*R, 878*a*L, 878*b*R, 878*b*L are secured, attached, fastened, fixed or mounted to or about the outer sides 846R, 846L and upper or first ends 843R, 843L of the vertical bars 842R, 842L of the linear sliding device 840, and supports the driving, rotational shafts 914*a*, 914*b*. It is preferred that the shaft support bearings 878*a*R, 878*a*L, 878*b*R, 878*b*L are similar in structure and function as the shaft support bearings 778*a*R, 778*a*L, 778*b*R, 778*b*L, 778*c*R, 778*c*L.

As best shown in FIGS. 30 and 31, the calves roller motor gearbox 910 is preferably adapted for reducing speed and increasing torque. The calves roller motor gearbox 910 is in operational communication with or connected to the calves roller motor 912 such that the calves roller motor gearbox 910 is powered by the calves roller motor 912 to rotate the larger rollers 916*a*R, 916*a*L, 916*b*R, 916*b*L and the smaller rollers 917*a*R, 917*a*L, 917*b*R, 917*b*L of acupressure points 918*a*R, 918*a*L, 918*b*R, 918*b*L located on or about the outer surface of the body of each larger roller 916*a*R, 916*a*L, 916*b*R, 916*b*L via the corresponding driving, rotational shafts 914*a*, 914*b*. The calves roller motor gearbox 910 may be any applicable gearbox or gear device known to one of ordinary skill in the art. It is preferred that the calves roller motor gearbox 910 is the same or substantially the same as the calves roller motor gearbox 610, and feet roller motor gearbox 510, 810.

As best shown in FIGS. 30 and 31, the calves roller motor 912 activates the the calves roller motor gearbox 910 for operation. The calves roller motor 912 is preferably a bi-directional motor, and may be any applicable motor known to one of ordinary skill in the art. It is preferred that the calves roller motor 912 is the same or substantially the same as the calves roller motor 612 and feet roller motor 512, 812.

As best shown in FIGS. 41-43, 45 and 48, each of the plurality of arrays or arrangements of fluid-actuated devices 960R, 960L is positioned about the corresponding side of a calf and/or corresponding side of a foot of the user during operation. The fluid-actuated devices 960R, 960L may be airbags, air cells, bags or cells filled with water, gel and the like, any fluid-actuated devices known to one of ordinary skill in the art, or any combination thereof. Preferably, the fluid-actuated devices 960R, 960L are airbags or air cells, wherein the airbags or air cells are any applicable airbags or air cells known to one of ordinary skill in the art. As an alternative to an array or arrangement of fluid-actuated devices 960R, 960L, a single fluid-actuated device (not shown) of a size that is similar to, substantially similar to, or exactly the same as the size of the entire array or arrangement of fluid-actuated devices 960R, 960L may be included in the feet and calves massage apparatus 701 or other massage apparatuses related to the foot(feet) and calf(ves) that are disclosed in this application.

The at least one pressure sensor (not shown) related to fluid-actuated devices 960R, 960L is able to measure and determine the pressure applied by the fluid-actuated devices 960R, 960L to the user's related body part such that the applied pressure can be maintained, increased or decreased. The at least one pressure sensor 970 can be any pressure sensor known to one of ordinary skill in the art.

In use, with regard to providing massage benefits or effects to the bottoms or soles of the feet of the user U, the footrest (combination of the legs and feet frame 710 and linear sliding device 840) preferably automatically adjusts to fit with the user's height or leg length when the applicable foot of the user U presses on the spring-loaded pedal 820. The feet massage device 760 can then be activated for operation by the feet roller motor 812 activating or powering the feet roller motor gearbox 810 to rotate the driving, rotational shafts 814*a*, 814*b*, 814*c* such that the larger rollers 816*a*R, 816*a*L, 816*b*R, 816*b*L, 816*c*R, 816*c*L mounted on the corresponding driving, rotational shaft 814*a*, 814*b*, 814*c* and the smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L located on or about the outer surface of the body of each corresponding larger roller 816*a*R, 816*a*L, 816*b*R, 816*b*L, 816*c*R, 816*c*L are also rotated and then able to provide massage benefits or effects to the bottoms or soles of the feet of the user U. Different parts or sections of the bottoms or soles of the feet of the user U are able to receive massage benefits or effects from the smaller rollers 817*a*R, 817*a*L, 817*b*R, 817*b*L, 817*c*R, 817*c*L of acupressure points 818*a*R, 818*a*L, 818*b*R, 818*b*L, 818*c*R, 818*c*L.

In use, with regard to providing massage benefits or effects to the backs of the calves of the user U, the footrest (combination of the legs and feet frame 710 and linear sliding device 840) preferably automatically adjusts to fit with the user's height or leg length when the applicable foot of the user U presses on the spring-loaded pedal 820. The calves massage device 860 can then be activated for operation by the calves roller motor 912 activating or powering the calves roller motor gearbox 910 to rotate the driving, rotational shafts 914*a*, 914*b* such that the larger rollers 916*a*R, 916*a*L, 916*b*R, 916*b*L mounted on the driving, rotational shafts 914*a*, 914*b* and the smaller rollers 917*a*R, 917*a*L, 917*b*R, 917*b*L of acupressure points 918*a*R, 918*a*L, 918*b*R, 918*b*L located on or about the outer surface of the body of each corresponding larger roller 916*a*R, 916*a*L, 916*b*R, 916*b*L are also rotated and then able to provide massage benefits or effects to the backs of the calves of the user U. Different parts or sections of the backs of the calves of the user U are able to receive massage benefits or effects from the smaller rollers 917*a*R, 917*a*L, 917*b*R, 917*b*L of acupressure points 918*a*R, 918*a*L, 918*b*R, 918*b*L.

Referring to FIGS. 33-36 and 48 and as a further aspect of the present invention, the invention is directed to a hands and arms massage apparatus 1001 for providing massage benefits or effects to the hands and arms of a user U. The hands and arms massage apparatus 1001 may be secured, attached, fastened, fixed or mounted to armrest frames or arm panels 1010R, 1010L preferably at the area or location, shown in FIG. 33, of a chair, such as, but not limited to, a massage chair.

As a first embodiment of this further aspect and as shown in FIGS. 33-36, the hands and arms massage apparatus 1001 includes a pair of hand and arm massage devices 1060R, 1060L (preferably motorized), two arrays or arrangements of fluid-actuated devices 1160R, 1160L (such as, but not limited to, airbags, air cells, water bags, water cells, gel bags, gel cells, and any combination thereof), and/or at least one pressure sensor (not shown) related to fluid-actuated devices 1160R, 1160L. Each array or arrangement of fluid-actuated devices 1160R, 1160L is positioned above a corresponding hand and arm massage device 1060R, 1060L during operation. Some, most or all of each of the pair of hand and arm massage devices 1060R, 1060L may be positioned inside or under a chair covering material (preferably the same or substantially the same as the chair covering material disclosed in other aspects of the present invention). In addition, some, most or all of each of the two arrays or arrangements of fluid-actuated devices 1160R, 1160L may be positioned inside or under a chair covering material (preferably the same or substantially the same as the chair covering material disclosed in other aspects of the present invention).

As another embodiment of this further aspect, a massage apparatus related to the hand(s) and arm(s) includes one hand and arm massage device 1060R or 1060L (preferably motorized) and one array or arrangement of fluid-actuated devices 1160R or 1160L, which is positioned above the hand and arm massage device 1060R or 1060L during operation. As a further embodiment of this further aspect, a massage apparatus related to the hand(s) and arm(s) includes one or more hand and arm massage device 1060R, 1060L (preferably motorized) but does not include any fluid-actuated device 1160R, 1160L or any array or arrangement of fluid-actuated devices 1160R, 1160L.

As a non-limiting example and as shown in FIGS. 33-36 with regard to the first embodiment of this further aspect, the hand and arm massage devices 1060R, 1060L are a first or right hand and arm massage device 1060R and a second or left hand and arm massage device 1060L wherein each of the massage devices 1060R, 1060L is secured, attached, fastened, fixed or mounted to and supported by a corresponding armrest frame or arm panel 1010R, 1010L.

Figure 34:
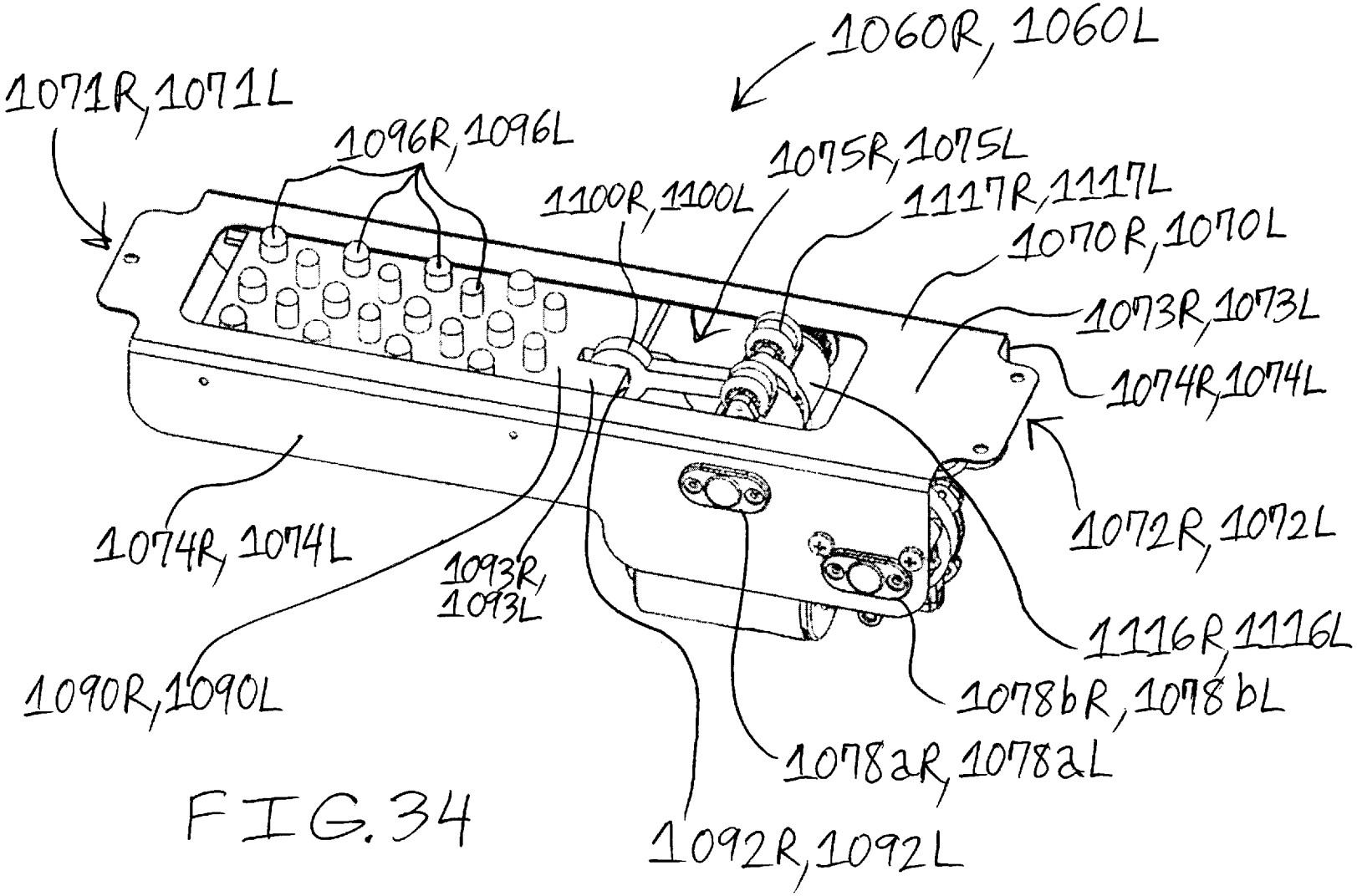
FIG. 34 is a left side, perspective view of a hand and arm massage device of the hands and arms massage apparatus of FIG. 33.
Figure 36:
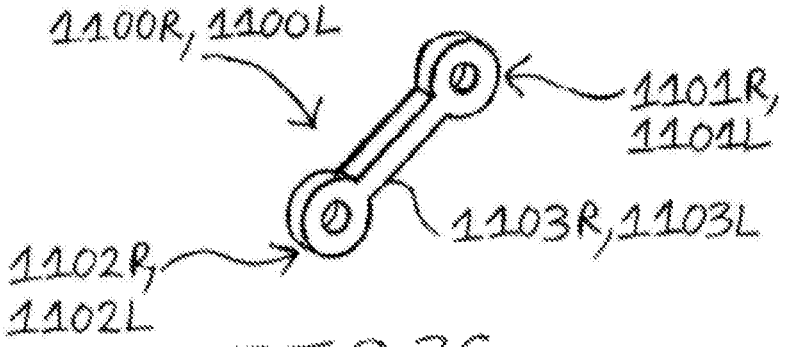
FIG. 36 is a perspective view of a circular-to-linear motion translator of the hand and arm massage device of FIG. 34.
Figure 35:
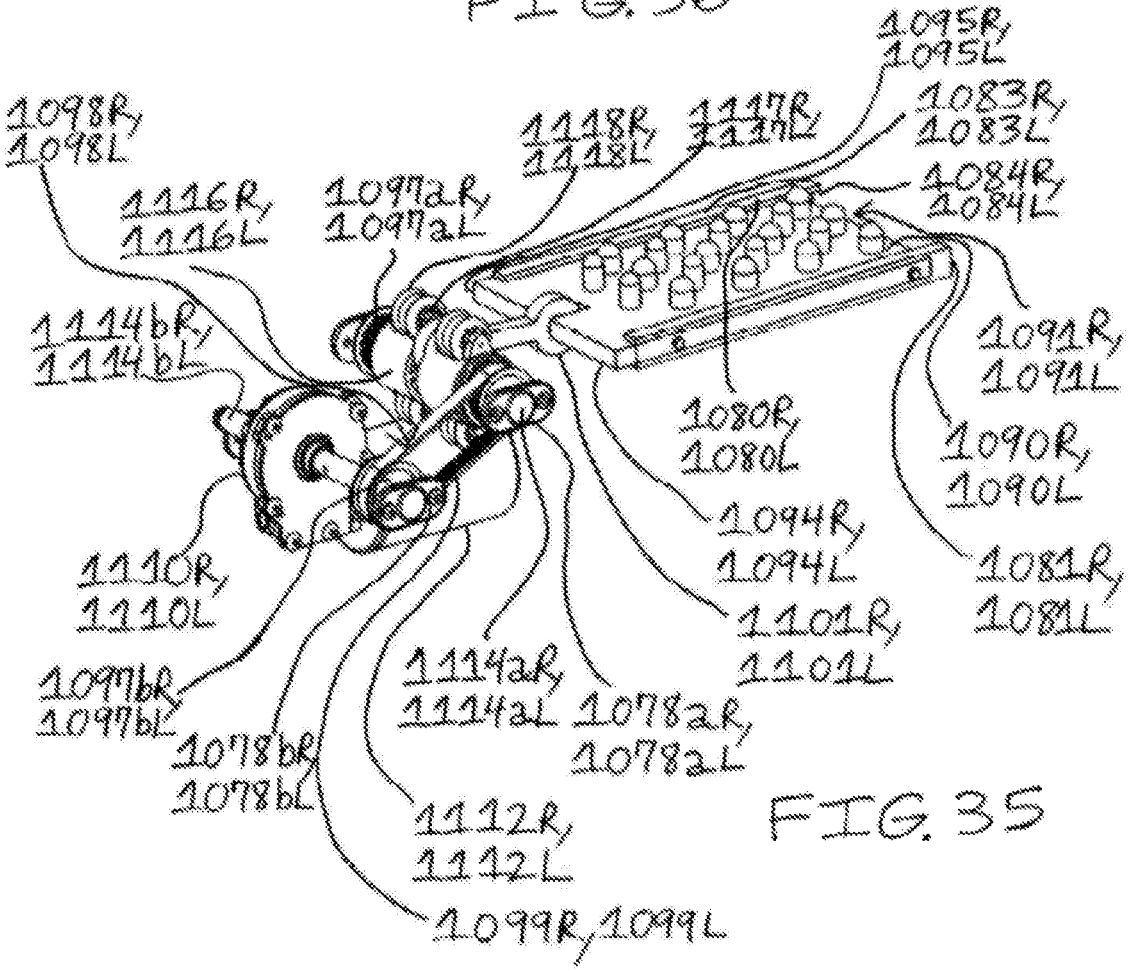
FIG. 35 is a rear, right side, perspective view of the hand and arm massage device of FIG. 34, without a partial housing frame.

As best shown in FIGS. 34-36, each of the first or right hand and arm massage device 1060R and second or left hand and arm massage device 1060L includes a partial housing frame 1070R, 1070L, a pair of plate guiders 1080R, 1080L, a massage plate 1090R, 1090L with raised accupressure points 1096R, 1096L, shaft support bearings or bushings 1078*a*R, 1078*a*L, 1078*b*R, 1078*b*L, a circular-to-linear motion translator 1100R, 1100L, a pair of larger rollers 1116R, 1116L mounted on a driving, rotational shaft 1114*a*R, 1114*a*L, smaller rollers 1117R, 1117L of acupressure points 1118R, 1118L (preferably via uneven surface of smaller rollers 1117R, 1117L) located on or about the outer surface of the body of each larger roller 1116R, 1116L, a hand and arm roller motor gearbox 1110R, 1110L, and a hand and arm roller motor 1112R, 1112L.

As best shown in FIG. 34, the partial housing frame 1070R, 1070L has a first or front end 1071R, 1071L, a second or rear end 1072R, 1072L, a top 1073R, 1073L, a pair of sides 1074R, 1074L, and a cutout window 1075R, 1075L. The cutout window 1075R, 1075L allows the raised accupressure points 1096R, 1096L on the massage plate 1090R, 1090L to protrude sufficiently above the top 1073R, 1073L such that the raised accupressure points 1096R, 1096L are able to provide massage effects or benefits to the corresponding hand and arm of the user during operation. The partial housing frame 1070R, 1070L is secured, attached, fastened, fixed or mounted to a corresponding armrest frame or arm panel 1010R, 1010L by screw(s) (not shown), any device(s) known to one of ordinary skill in the art, any method(s) known to one of ordinary skill in the art, or any combination thereof.

As best shown in FIG. 35, each of the plate guiders 1080R, 1080L has a first or front end 1081R, 1081L, a second or rear end 1082R, 1082L, a body 1083R, 1083L extending between the ends 1081R, 1081L, 1082R, 1082L, and a channel 1084R, 1084L for receiving and guiding the massage plate 1090R, 1090L during operation. The pair of plate guiders 1080R, 1080L are secured, attached, fastened, fixed or mounted under the corresponding top 1073R, 1073L of the partial housing frame 1070R, 1070L, and help to guide the massage plate 1090R, 1090L move forwardly, or alternatively rearwardly, during operation. The pair of plate guiders 1080R, 1080L are secured, attached, fastened, fixed or mounted under the corresponding top 1073R, 1073L by screw(s) (not shown), any device(s) known to one of ordinary skill in the art, any method(s) known to one of ordinary skill in the art, or any combination thereof. Preferably, each plate guider 1080R, 1080L may be straight or curved.

As best shown in FIGS. 34 and 35, the massage plate 1090R, 1090L has a first or front end 1091R, 1091L, a second or rear end 1092R, 1092L, a top surface 1093R, 1093L, a bottom surface 1094R, 1094L, a pair of sides 1095R, 1095L, and raised accupressure points 1096R, 1096L. The sides 1095R, 1095L of the massage plate 1090R, 1090L are positioned within the channel 1084R, 1084L of the corresponding pair of plate guiders 1080R, 1080L such that the massage plate 1090R, 1090L, with the raised accupressure points 1096R, 1096L, may be displaced, moved or slid forwardly, or alternatively rearwardly, during operation via the corresponding rotational direction of the driving, rotational shaft 1114*a*R, 1114*a*L and large rollers 1116R, 1116L. Preferably, heat is applied to some, most or all of the acupressure points 1096R, 1096L to help blood circulation of the user. Heat can be applied to acupressure points 1096R, 1096L by any device (not shown) and/or method known to one of ordinary skill in the art.

As best shown in FIGS. 34 and 35, each of the shaft support bearings or bushings 1078*a*R, 1078*a*L, 1078*b*R, 1078*b*L is secured, attached, fastened, fixed or mounted to a corresponding side 1074R, 1074L of the partial housing frame 1070R, 1070L, and supports the corresponding driving, rotational shaft 1114*a*R, 1114*a*L, 1114*b*R, 1114*b*L.

As best shown in FIGS. 34-36, the circular-to-linear motion translator 1100R, 1100L has a first or front end 1101R, 1101L, a second or rear end 1102R, 1102L, and a body 1103R, 1103L extending between the ends 1101R, 1101L, 1102R, 1102L. The first or front end 1101R, 1101L is operationally connected to or in operational communication with the second or rear end 1092R, 1092L of the massage plate 1090R, 1090L, while the second or rear end 1102R, 1102L is operationally connected to or in operational communication with the larger rollers 1116R, 1116L such that the circular-to-linear motion translator 1100R, 1100L helps to displace, move or slide the massage plate 1090R, 1090L forwardly, or alternatively rearwardly, during operation via the corresponding rotational direction of the first driving, rotational shaft 1114*a*R, 1114*a*L and larger rollers 1116R, 1116L.

As best shown in FIG. 35, the pair of larger rollers 1116R, 1116L are mounted on a driving, rotational shaft 1114*a*R, 1114*a*L, and two smaller rollers 1117R, 1117L are positioned at predetermined locations on or about the outer surface of the body of each of the larger rollers 1116R, 1116L. It is preferred that each of the smaller rollers 1117R, 1117L has an uneven surface and rotate approximately on or about the outer surface of the body of the corresponding larger roller 1116R, 1116L to provide acupressure points 1118R, 1118L.

As best shown in FIG. 35, the hand and arm roller motor gearbox 1110R, 1110L is preferably adapted for reducing speed and increasing torque. The hand and arm roller motor gearbox 1110R, 1110L is in operational communication with or connected to the corresponding hand and arm roller motor 1112R, 1112L such that the hand and arm roller motor gearbox 1110R, 1110L is powered by the hand and arm roller motor 1112R, 1112L to rotate the corresponding larger rollers 1116R, 1116L and the corresponding smaller rollers 1117R, 1117L of acupressure points 1118R, 1118L via the first driving, rotational shaft 1114*a*R, 1114*a*L. The hand and arm roller motor gearbox 1110R, 1110L may be any applicable gearbox or gear device known to one of ordinary skill in the art.

As best shown in FIG. 35, the hand and arm roller motor 1112R, 1112L activates the corresponding hand and arm roller motor gearbox 1110R, 1110L for operation. The hand and arm roller motor 1112R, 1112L is preferably a bi-directional motor, and may be any applicable motor known to one of ordinary skill in the art.

As best shown in FIG. 35, the second driving, rotational shaft 1114*b*R, 1114*b*L is operational connected to or with a corresponding hand and arm roller motor gearbox 1110R, 1110L and hand and arm roller motor 1112R, 1112L while the first driving, rotational shaft 1114*a*R, 1114*a*L is operational connected to or with the corresponding larger rollers 1116R, 1116L, smaller rollers 1117R, 1117L of acupressure points 1118R, 1118L, and circular-to-linear motion translator 1100R, 1100L. Each set of the first and second driving, rotational shafts 1114*a*R, 1114*b*R, 1114*a*L, 1114*b*L is preferably positioned about the second or rear end 1072R, 1072L of the partial housing frame 1070R, 1070L. The second driving, rotational shaft 1114*b*R, 1114*b*L is operational connected to or with the first driving, rotational shaft 1114*a*R, 1114*a*L via a system of pulley gears 1097*a*R, 1097*a*L, 1097*b*R, 1097*b*L and belt 1098R, 1098L with teeth 1099R, 1099L.

Figure 33:
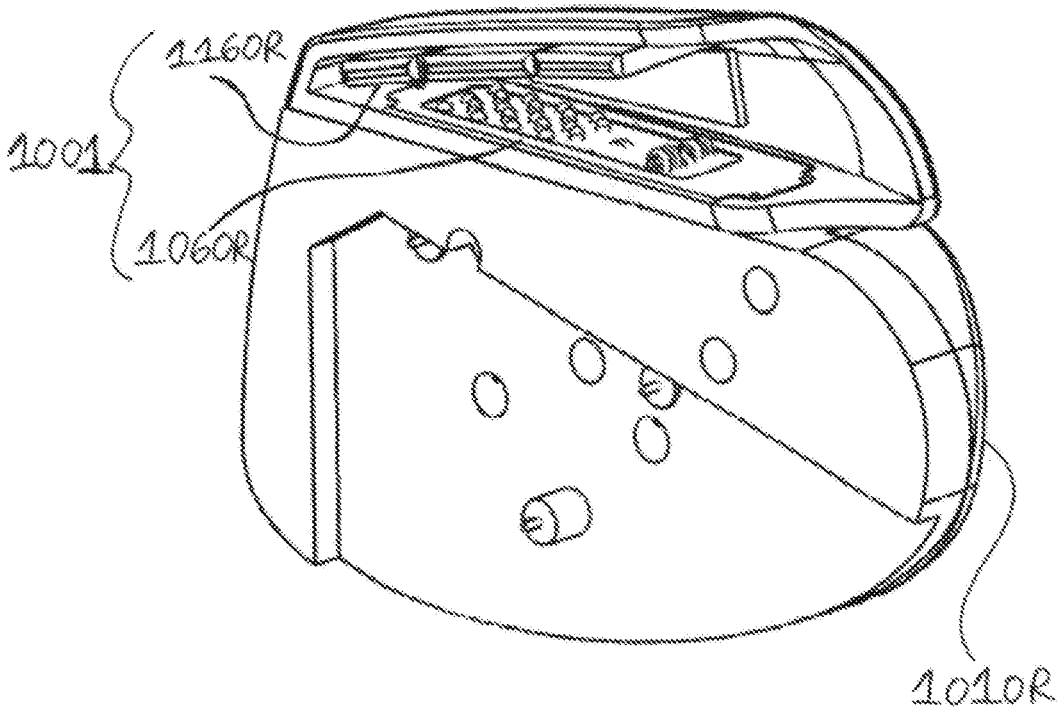
FIG. 33 is a rear, side, perspective view of an embodiment of a hands and arms massage apparatus according to the present invention, wherein the hands and arms massage apparatus is secured, attached, fastened, fixed or mounted to a right armrest frame or arm panel.

As best shown in FIG. 33, each of the two arrays or arrangements of fluid-actuated devices 1160R, 1160L is positioned above a corresponding hand and arm massage device 1060R, 1060L during operation. The fluid-actuated devices 1160R, 1160L may be airbags, air cells, bags or cells filled with water, gel and the like, any fluid-actuated devices known to one of ordinary skill in the art, or any combination thereof. Preferably, the fluid-actuated devices 1160R, 1160L are airbags or air cells, wherein the airbags or air cells are any applicable airbags or air cells known to one of ordinary skill in the art. As an alternative to an array or arrangement of fluid-actuated devices 1160R, 1160L, a single fluid-actuated device (not shown) of a size that is similar to, substantially similar to, or exactly the same as the size of the entire array or arrangement of fluid-actuated devices 1160R, 1160L may be included in the hands and arms massage apparatus 1001 or other massage apparatuses related to the hand(s) and arm(s) that are disclosed in this application.

The at least one pressure sensor (not shown) related to fluid-actuated devices 1160R, 1160L is able to measure and determine the pressure applied by the fluid-actuated devices 1160R, 1160L to the user's related body part such that the applied pressure can be maintained, increased or decreased. The at least one pressure sensor can be any pressure sensor known to one of ordinary skill in the art.

In use, with regard to providing massage benefits or effects to the hands and arms of the user U, each of the first or right and second or left hand and arm massage devices 1060R, 1060L can be activated for operation by the hand and arm roller motor 1112R, 1112L activating or powering the hand and arm roller motor gearbox 1110R, 1110L to rotate the second driving, rotational shaft 1114*b*R, 1114*b*L and system of pulley gears 1097*a*R, 1097*a*L, 1097*b*R, 1097*b*L and belt 1098R, 1098L with teeth 1099R, 1099L such that the first driving, rotational shaft 1114*a*R, 1114*a*L, larger rollers 1116R, 1116L, and the smaller rollers 1117R, 1117L of acupressure points 1118R, 1118L located on or about the outer surface of the body of each corresponding larger roller 1116R, 1116L are also rotated and then able to provide massage benefits or effects to the hands and arms of the user U. Different parts or sections of the hands and arms of the user U are able to receive massage benefits or effects from the smaller rollers 1117R, 1117L of acupressure points 1118R, 1118L. Each of the two arrays or arrangements of fluid-actuated devices 1160R, 1160L provides roller massage intensity control of the massage to the corresponding hand and arm of the user U. As a non-limiting example, more or an increase in air pressure in airbags or air cells 1160R, 1160L will result in more or an increase in roller pressure or intensity on the hand and arm of the user U. Air bag pressure or intensity is controlled by square wave, pulse width modulation (PWM) control. The massage intensity provided by the smaller rollers 1117R, 1117L is created by how much the fluid-actuated devices 1160R, 1160L are pushing down on the corresponding hand and/or arm of the user U. The pushing force is controlled by a pulse width modulation of the in-line air valve (not shown).

Referring to FIGS. 37-40 and as a different embodiment from the hands and arms massage apparatus 1001 of this further aspect, the hands and arms massage apparatus 1201 differs from the hands and arms massage apparatus 1001 in that the hands and arms massage apparatus 1201 does not include the pairs of plate guiders 1080R, 1080L, massage plates 1090R, 1090L with raised accupressure points 1096R, 1096L, and circular-to-linear motion translators 1100R, 1100L. The hands and arms massage apparatus 1201 may be secured, attached, fastened, fixed or mounted to armrest frames or arm panels 1210R, 1210L (such as, but not limited to, the areas or locations shown in FIG. 37), of a chair, such as, but not limited to, a massage chair.

In addition, as best shown in FIGS. 37-40, the hands and arms massage apparatus 1201 differs from the hands and arms massage apparatus 1001 in that the hands and arms massage apparatus 1201 includes four sets of driving, rotational shafts 1314*a*R, 1314*a*L, 1314*b*R, 1314*b*L, 1314*c*R, 1314*c*L, 1314*d*R, 1314*d*L, larger rollers 1316*a*R, 1316*a*L, 1316*b*R, 1316*b*L, 1316*c*R, 1316*c*L, 1316*d*R, 1316*d*L, smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L, shaft support bearings or bushings 1278*a*R, 1278*a*L, 1278*b*R, 1278*b*L, 1278*c*R, 1278*c*L, 1278*d*R, 1278*d*L, 1278*e*R, 1278*e*L, and belts 1298*a*R, 1298*a*L, 1298*b*R, 1298*b*L, 1298*c*R, 1298*c*L, 1298*d*R, 1298*d*L with teeth 1299*a*R, 1299*a*L, 1299*b*R, 1299*b*L, 1299*c*R, 1299*c*L, 1299*d*R, 1299*d*L, (instead of one set of driving, rotational shafts 1114*a*R, 1114*a*L, 1114*b*R, 1114*b*L, larger rollers 1116R, 1116L, smaller rollers 1117R, 1117L of acupressure points 1118R, 1118L, shaft support bearings or bushings 1078*a*R, 1078*a*L, 1078*b*R, 1078*b*L, and belt 1098R, 1098L with teeth 1099R, 1099L with regard to the hands and arms massage apparatus 1001).

As best shown in FIGS. 37-40, the hands and arms massage apparatus 1201 includes a pair of hand and arm massage devices 1260R, 1260L (preferably motorized), two arrays or arrangements of fluid-actuated devices 1360R, 1360L (such as, but not limited to, airbags, air cells, water bags, water cells, gel bags, gel cells, and any combination thereof), and/or at least one pressure sensor (not shown) related to fluid-actuated devices 1360R, 1360L. Each array or arrangement of fluid-actuated devices 1360R, 1360L is positioned above a corresponding hand and arm massage device 1260R, 1260L during operation. Some, most or all of each of the pair of hand and arm massage devices 1260R, 1260L may be positioned inside or under a chair covering material (preferably the same or substantially the same as the chair covering material disclosed in other aspects of the present invention). In addition, some, most or all of each of the two arrays or arrangements of fluid-actuated devices 1360R, 1360L may be positioned inside or under a chair covering material (preferably the same or substantially the same as the chair covering material disclosed in other aspects of the present invention).

As another embodiment of this further aspect, a massage apparatus related to the hand(s) and arm(s) includes one hand and arm massage device 1260R or 1260L (preferably motorized) and one array or arrangement of fluid-actuated devices 1360R or 1360L, which is positioned above the hand and arm massage device 1260R or 1260L during operation. As a further embodiment of this further aspect, a massage apparatus related to the hand(s) and arm(s) includes one or more hand and arm massage device 1260R, 1260L (preferably motorized) but does not include any fluid-actuated device 1360R, 1360L or any array or arrangement of fluid-actuated devices 1360R, 360L.

As a non-limiting example and as shown in FIGS. 37-40 with regard to the different embodiment of this further aspect, the hand and arm massage devices 1260R, 1260L are a first or right hand and arm massage device 1260R and a second or left hand and arm massage device 1260L wherein each of the massage devices 1260R, 1260L is secured, attached, fastened, fixed or mounted to and supported by a corresponding armrest frame or arm panel 1210R, 1210L.

As best shown in FIGS. 37-40, each of the first or right hand and arm massage device 1260R and second or left hand and arm massage device 1260L includes a partial housing frame 1270R, 1270L, five driving, rotational shafts 1314*a*R, 1314*a*L, 1314*b*R, 1314*b*L, 1314*c*R, 1314*c*L, 1314*d*R, 1314*d*L, 1314*e*R, 1314*e*L, shaft support bearings or bushings 1278*a*R, 1278*a*L, 1278*b*R, 1278*b*L, 1278*c*R, 1278*c*L, 1278*d*R, 1278*d*L, 1278*e*R, 1278*e*L, larger rollers 1316*a*R, 1316*a*L, 1316*b*R, 1316*b*L, 1316*c*R, 1316*c*L, 1316*d*R, 1316*d*L secured, attached, fastened, fixed or mounted on the driving, rotational shaft 1314*a*R, 1314*a*L, 1314*b*R, 1314*b*L, 1314*c*R, 1314*c*L, 1314*d*R, 1314*d*L, 1314*e*R, 1314*e*L, smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L (preferably via uneven surface of smaller rollers 1317*a*R, 1317*a*L, 1317*b*R, 1317*b*L, 1317*c*R, 1317*c*L, 1317*d*R, 1317*d*L) located on or about the outer surface of the body of each larger roller 1316*a*R, 1316*a*L, 1316*b*R, 1316*b*L, 1316*c*R, 1316*c*L, 1316*d*R, 1316*d*L, a hand and arm roller motor gearbox 1310R, 1310L, and a hand and arm roller motor 1312R, 1312L.

Figure 38:
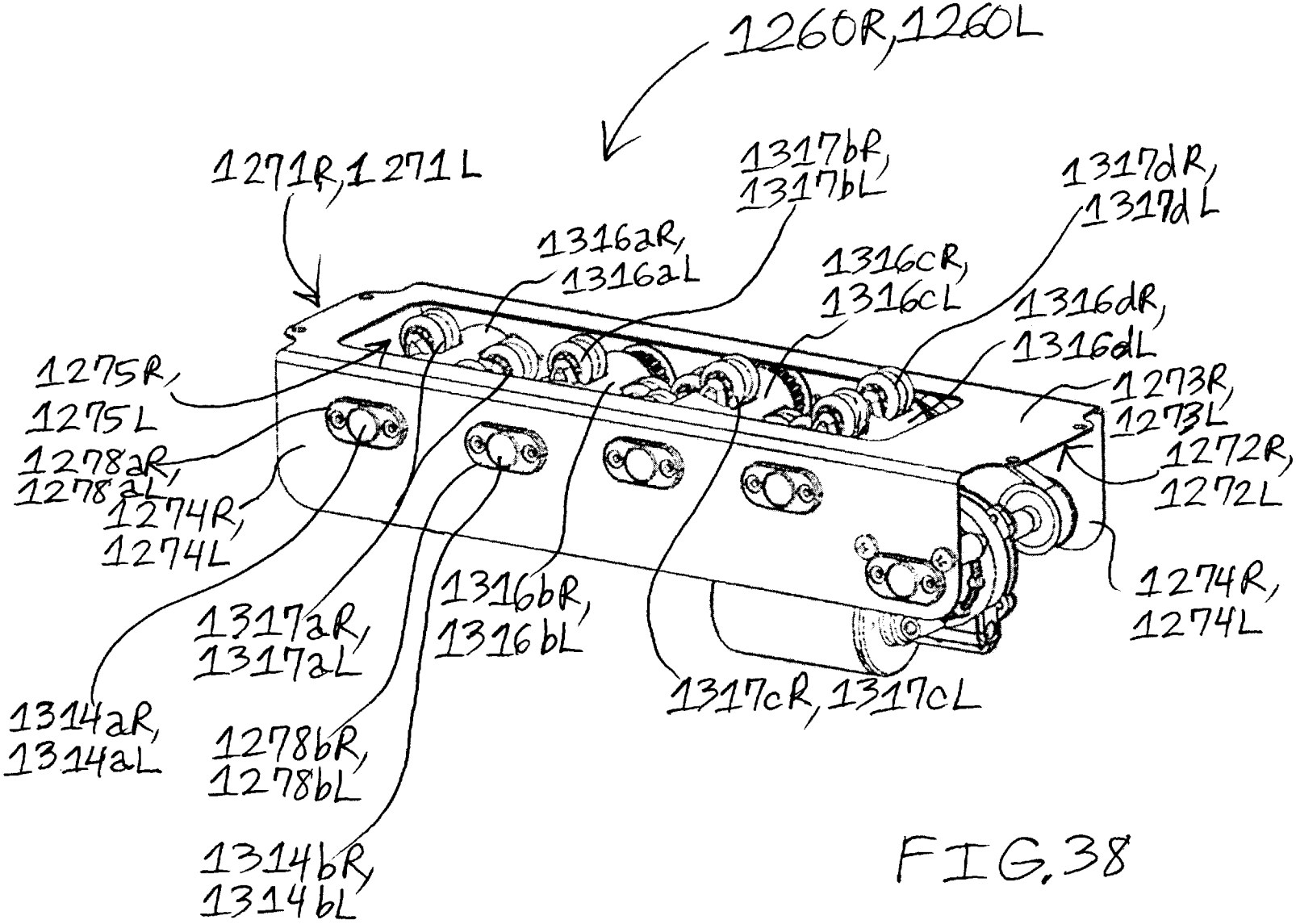
FIG. 38 is a left side, perspective view of a hand and arm massage device of the hands and arms massage apparatus of FIG. 37.

As best shown in FIG. 38, the partial housing frames 1270R, 1270L has a first or front end 1271R, 1271L, a second or rear end 1272R, 1272L, a top 1273R, 1273L, a pair of sides 1274R, 1274L, and a cutout window 1275R, 1275L. The cutout window 1275R, 1275L allows the smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L to protrude sufficiently above the top 1273R, 1273L such that the acupressure points 1318*a*R, 1318*a*L, 1318*b*R, 1318*b*L, 1318*c*R, 1318*c*L, 1318*d*R, 1318*d*L are able to provide massage effects or benefits to the corresponding hand and arm of the user during operation. The partial housing frame 1270R, 1270L is secured, attached, fastened, fixed or mounted to a corresponding armrest frame or arm panel 1210R, 1210L by screw(s) (not shown), any device(s) known to one of ordinary skill in the art, any method(s) known to one of ordinary skill in the art, or any combination thereof. It is preferred that the partial housing frames 1270R, 1270L are the same or substantially the same as the partial housing frames 1070R, 1070L.

Figure 39:
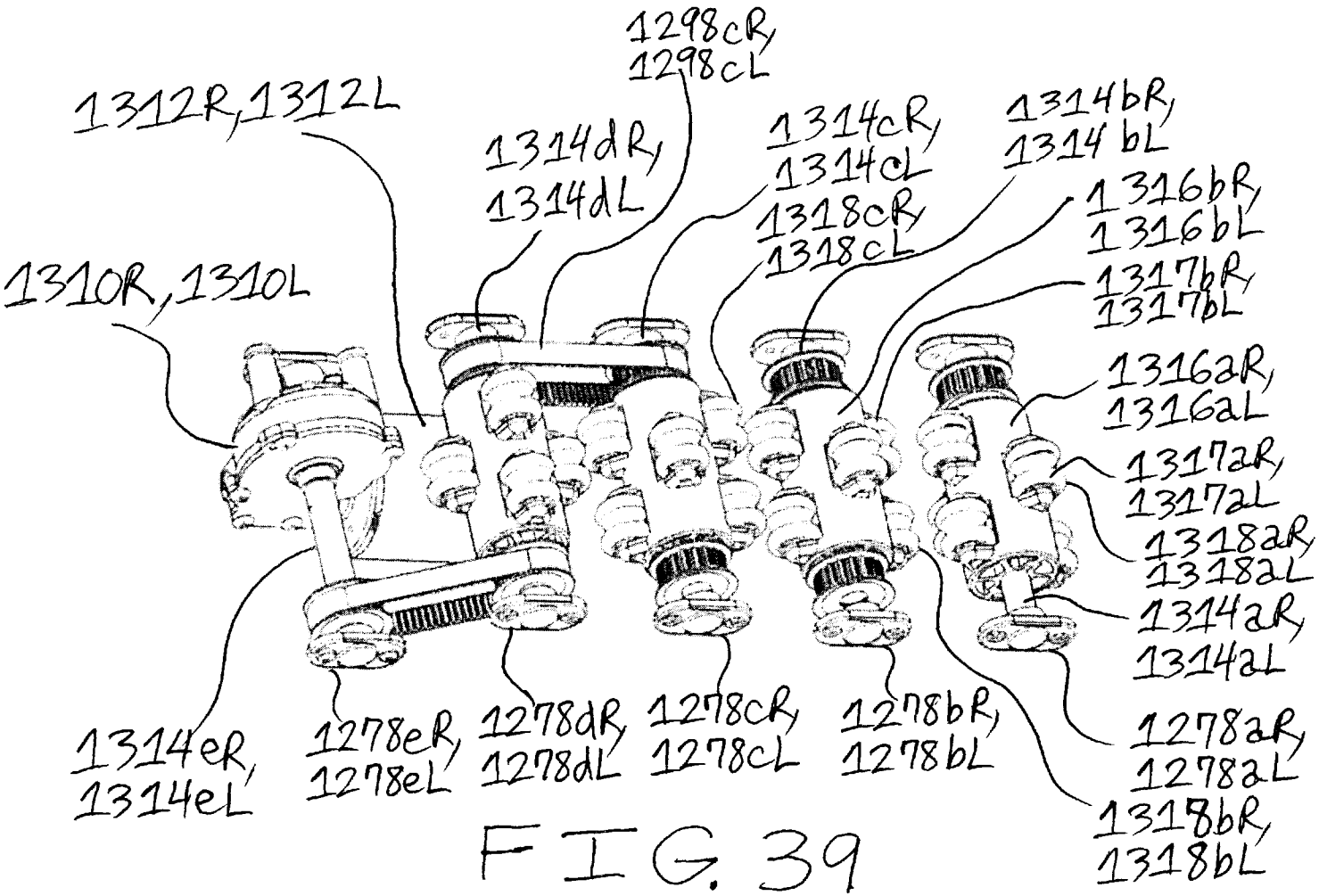
FIG. 39 is a rear, right side, perspective view of the hand and arm massage device of FIG. 38, without a partial housing frame.
Figure 40:
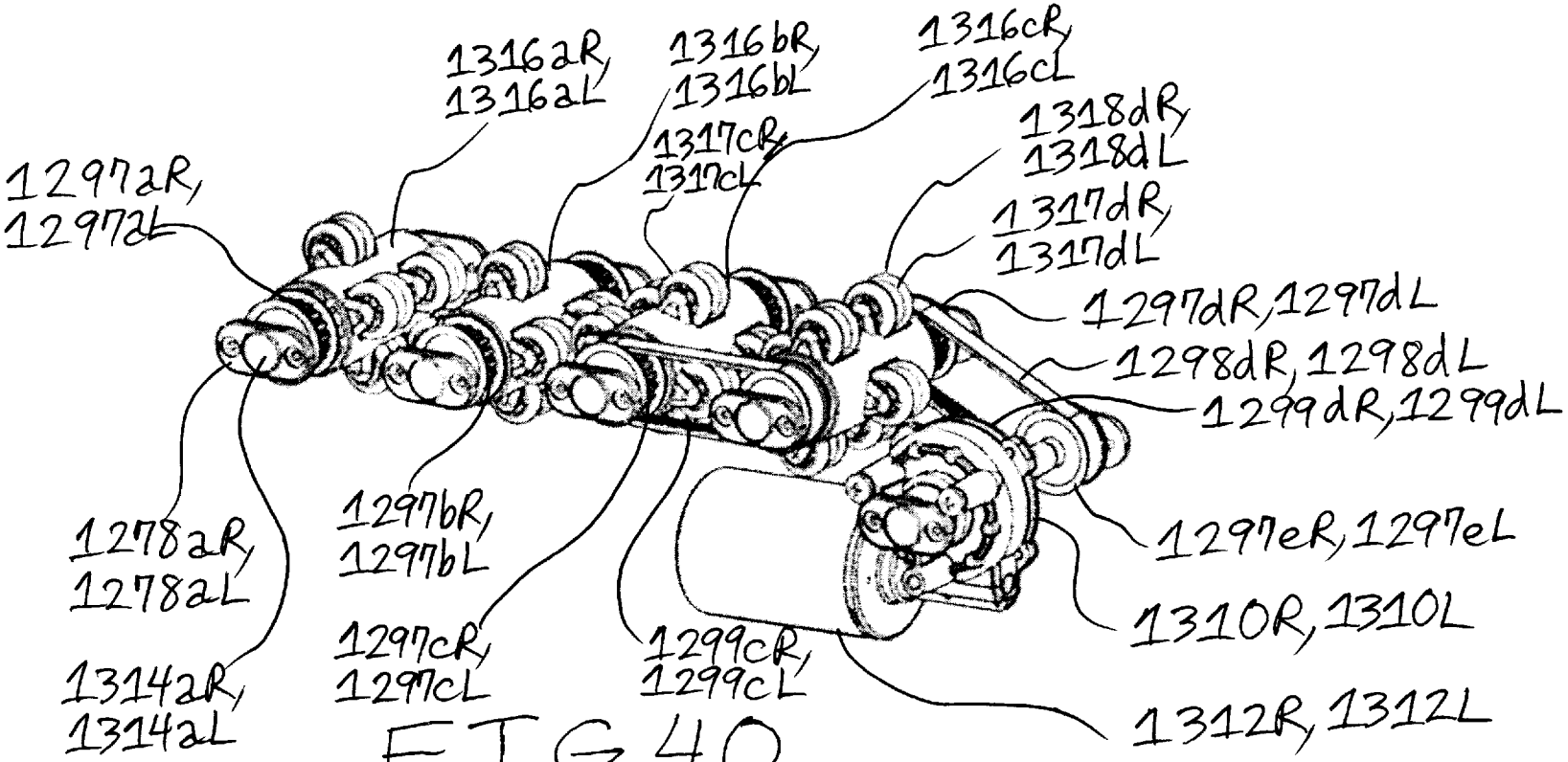
FIG. 40 is a rear, left side, perspective view of the hand and arm massage device of FIG. 38, without a partial housing frame.

As best shown in FIGS. 38-40, there are four sets of driving, rotational shafts 1314*a*R, 1314*a*L, 1314*b*R, 1314*b*L, 1314*c*R, 1314*c*L, 1314*d*R, 1314*d*L, larger rollers 1316*a*R, 1316*a*L, 1316*b*R, 1316*b*L, 1316*c*R, 1316*c*L, 1316*d*R, 1316*d*L, smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L, and shaft support bearings or bushings 1278*a*R, 1278*a*L, 1278*b*R, 1278*b*L, 1278*c*R, 1278*c*L, 1278*d*R, 1278*d*L, 1278*e*R, 1278*e*L, and are secured, attached, fastened, fixed or mounted to the sides 1274R, 1274L of the partial housing frames 1270R, 1270L in an arrangement such that the smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L protrude sufficiently above the cutout window 1275R, 1275L of the partial housing frames 1270R, 1270L during operation. However, other non-limiting examples may be one set, two sets, three sets or more than four sets. As best shown in FIGS. 39 and 40, the five driving, rotational shafts 1314*a*R, 1314*a*L, 1314*b*R, 1314*b*L, 1314*c*R, 1314*c*L, 1314*d*R, 1314*d*L, 1314*e*R, 1314*e*L are positioned parallel to one another, operationally connected to one another by the system of pulley gears 1297*a*R, 1297*a*L, 1297*b*R, 1297*b*L, 1297*c*R, 1297*c*L, 1297*d*R, 1297*d*L, 1297*e*R, 1297*e* and belts 1298*a*R, 1298*a*L, 1298*b*R, 1298*b*L, 1298*c*R, 1298*c*L, 1298*d*R, 1298*d*L with teeth 1299*a*R, 1299*a*L, 1299*b*R, 1299*b*L, 1299*c*R, 1299*c*L, 1299*d*R, 1299*d*L, and run at the same speed. The advantages of this non-limiting example are to reduce the plurality of motors that may be required, the cost, the power consumption, and the space.

As best shown in FIGS. 38-40 and similar to the system of driving, rotational shafts 814*a*, 814*b*, 814*c*, pulley gears 797*a*, 797*b*, 797*c*, and belts 798*a*, 798*b* with teeth 799*a*, 799*b* related to the legs and feet massage apparatus 701 described above, each of the four (out of 5) driving, rotational shafts 1314*a*R, 1314*a*L, 1314*b*R, 1314*b*L, 1314*c*R, 1314*c*L, 1314*d*R, 1314*d*L is operational connected to or with larger rollers 1316*a*R, 1316*a*L, 1316*b*R, 1316*b*L, 1316*c*R, 1316*c*L, 1316*d*R, 1316*d*L, and smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L located on or about the outer surface of the body of the larger rollers 1316*a*R, 1316*a*L, 1316*b*R, 1316*b*L, 1316*c*R, 1316*c*L, 1316*d*R, 1316*d*L such that the larger rollers 1316*a*R, 1316*b*R, 1316*c*R, 1316*d*R (with corresponding smaller rollers 1317*a*R, 1317*b*R, 1317*c*R, 1317*d*R positioned on or about the outer surface of the body of each larger roller 1316*a*R, 1316*b*R, 1316*c*R, 1316*d*R) are in alignment with one another for providing massage effects or benefits to a right hand and arm of the user U while larger rollers 1316*a*L, 1316*b*L, 1316*c*L, 1316*d*L (with corresponding smaller rollers 1317*a*L, 1317*b*L, 1317*c*L, 1317*d*L positioned on or about the outer surface of the body of each larger roller 1316*a*L, 1316*b*L, 1316*c*L, 1316*d*L) are in alignment with one another for providing massage effects or benefits to a left hand and arm of the user U. It is preferred that the smaller rollers 1317*a*R, 1317*a*L, 1317*b*R, 1317*b*L, 1317*c*R, 1317*c*L, 1317*d*R, 1317*d*L have uneven surface and rotate approximately on or about the outer surface of the body of the larger rollers 1316*a*R, 1316*a*L, 1316*b*R, 1316*b*L, 1316*c*R, 1316*c*L, 1316*d*R, 1316*d*L to provide acupressure points 1318*a*R, 1318*a*L, 1318*b*R, 1318*b*L, 1318*c*R, 1318*c*L, 1318*d*R, 1318*d*L. In addition, each of the fifth or last driving, rotational shafts 1314*e*R, 1314*e*L is operational connected to or with the corresponding hand and arm roller motor gearbox 1310R, 1310L and hand and arm roller motor 1312R, 1312L such that the first, second, third, and fourth driving, rotational shafts 1314*a*R, 1314*a*L, 1314*b*R, 1314*b*L, 1314*c*R, 1314*c*L, 1314*d*R, 1314*d*L can be rotated when the corresponding hand and arm roller motor gearbox 1310R, 1310L and hand and arm roller motor 1312R, 1312L are activated for operation. Furthermore, the fifth or last driving, rotational shaft 1314*e*R, 1314*e*L and its corresponding pulley gear 1297*e*R, 1297*e*L, at one end of the fifth or last driving, rotational shaft 1314*e*R, 1314*e*L, are operational connected to or with the fourth driving, rotational shaft 1314*d*R, 1314*d*L and its pulley gear 1297*d*R, 1297*d*L via a fourth belt 1298*d* with teeth 1299*d*, while the fourth driving, rotational shaft 1314*d*R, 1314*d*L and its pulley gear 1297*d*R, 1297*d*L, at the other end of the fourth driving, rotational shaft 1314*d*R, 1314*d*L, are also operational connected to or with the third driving, rotational shaft 1314*c*R, 1314*c*L and its pulley gear 1297*c*R, 1297*c*L via a third belt 1298*c* with teeth 1299*c*, while the third driving, rotational shaft 1314*c*R, 1314*c*L and its pulley gear 1297*c*R, 1297*c*L, at the other end of the third driving, rotational shaft 1314*c*R, 1314*c*L, are also operational connected to or with the second driving, rotational shaft 1314*b*R, 1314*b*L and its pulley gear 1297*b*R, 1297*b*L via a second belt 1298*b* with teeth 1299*b*, and while the second driving, rotational shaft 1314*b*R, 1314*b*L and its pulley gear 1297*b*R, 1297*b*L, at the other end of the second driving, rotational shaft 1314*b*R, 1314*b*L, are also operational connected to or with the first or front driving, rotational shaft 1314*a*R, 1314*a*L and its pulley gear 1297*a*R, 1297*a*L via a first belt 1298*a* with teeth 1299*a*. It is preferred that each set of driving, rotational shafts 1314*a*R, 1314*a*L, 1314*b*R, 1314*b*L, 1314*c*R, 1314*c*L, 1314*d*R, 1314*d*L, larger rollers 1316*a*R, 1316*a*L, 1316*b*R, 1316*b*L, 1316*c*R, 1316*c*L, 1316*d*R, 1316*d*L, and smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L is similar in structure and function to one another.

As best shown in FIGS. 38-40, each of the shaft support bearings or bushings 1278*a*R, 1278*a*L, 1278*b*R, 1278*b*L, 1278*c*R, 1278*c*L, 1278*d*R, 1278*d*L, 1278*e*R, 1278*e*L is secured, attached, fastened, fixed or mounted to or about a corresponding side 1274R, 1274L of the partial housing frame 1270R, 1270L, and supports the corresponding driving, rotational shaft 1314*a*R, 1314*a*L, 1314*b*R, 1314*b*L, 1314*c*R, 1314*c*L, 1314*d*R, 1314*d*L. It is preferred that the shaft support bearings or bushings 1278*a*R, 1278*a*L, 1278*b*R, 1278*b*L, 1278*c*R, 1278*c*L, 1278*d*R, 1278*d*L, 1278*e*R, 1278*e*L are the same or substantially the same as the shaft support bearings or bushings 1078*a*R, 1078*a*L, 1078*b*R, 1078*b*L.

As best shown in FIGS. 38-40, there are four larger rollers 1316*a*R, 1316*b*R, 1316*c*R, 1316*d*R (1316*a*L, 1316*b*L, 1316*c*L, 1316*d*L), and there are four smaller rollers 1317*a*R, 1317*b*R, 1317*c*R, 1317*d*R (1317*a*L, 1317*b*L, 1317*c*L, 1317*d*L) located on or about the outer surface of the body of each corresponding larger roller 1316*a*R, 1316*b*R, 1316*c*R, 1316*d*R (1316*a*L, 1316*b*L, 1316*c*L, 1316*d*L). It is preferred that each of the smaller rollers 1317*a*R, 1317*b*R, 1317*c*R, 1317*d*R (1317*a*L, 1317*b*L, 1317*c*L, 1317*d*L) have an uneven surface and rotate approximately on or about the outer surface of the body of the corresponding larger roller 1316*a*R, 1316*b*R, 1316*c*R, 1316*d*R (1316*a*L, 1316*b*L, 1316*c*L, 1316*d*L) to provide acupressure points 1318*a*R, 1318*b*R, 1318*c*R, 1318*d*R (1318*a*L, 1318*b*L, 1318*c*L, 1318*d*L).

As best shown in FIGS. 38-40, the hand and arm roller motor gearboxes 1310R, 1310L is preferably adapted for reducing speed and increasing torque.

The hand and arm roller motor gearbox 1310R, 1310L is in operational communication with or connected to the corresponding hand and arm roller motor 1312R, 1312L such that the hand and arm roller motor gearbox 1310R, 1310L is powered by the hand and arm roller motor 1312R, 1312L to rotate the corresponding fifth or last driving, rotational shafts 1314*e*R, 1314*e*L and also, via the corresponding system of gears, belts and teeth, the operationally-connected larger rollers 1316*a*R, 1316*a*L, 1316*b*R, 1316*b*L, 1316*c*R, 1316*c*L, 1316*d*R, 1316*d*L and the smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L located on or about the outer surface of the body of each larger roller 1316*a*R, 1316*a*L, 1316*b*R, 1316*b*L, 1316*c*R, 1316*c*L, 1316*d*R, 1316*d*L. The hand and arm roller motor gearbox 1310R, 1310L may be any applicable gearbox or gear device known to one of ordinary skill in the art. It is preferred that the hand and arm roller motor gearboxes 1310R, 1310L are the same or substantially the same as the roller motor gearboxes 510, 610, 810, 910, 1110R, 1110L.

As best shown in FIGS. 38-40, the hand and arm roller motor 1312R, 1312L activates the corresponding hand and arm roller motor gearbox 1310R, 1310L for operation. The hand and arm roller motor 1312R, 1312L is preferably a bi-directional motor, and may be any applicable motor known to one of ordinary skill in the art. It is preferred that the hand and arm roller motors 1312R, 1312L are the same or substantially the same as the roller motors 512, 612, 812, 912, 1112R, 1112L.

Figure 37:
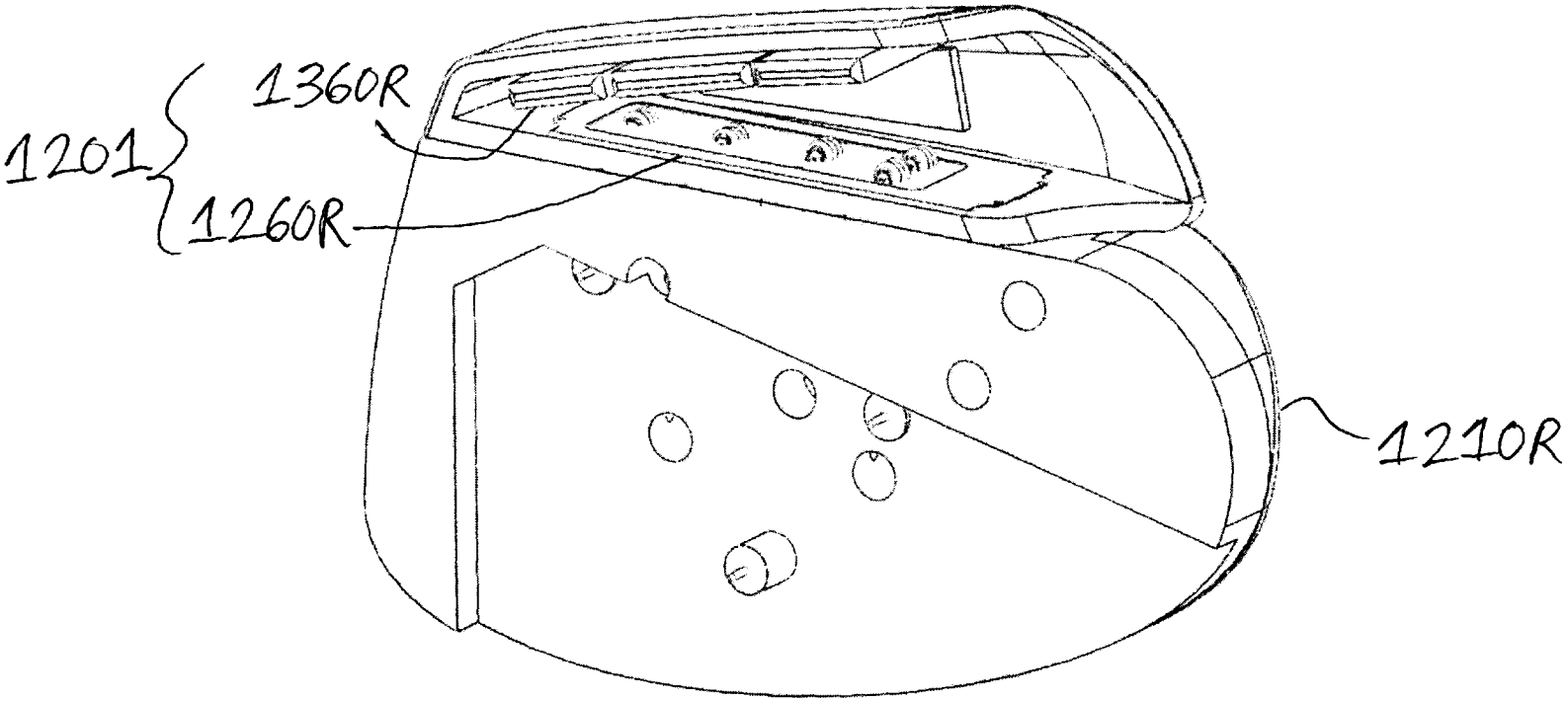
FIG. 37 is a rear, side, perspective view of an embodiment of another hands and arms massage apparatus according to the present invention, wherein the hands and arms massage apparatus is secured, attached, fastened, fixed or mounted to a right armrest frame or arm panel.

As best shown in FIG. 37, each of the two arrays or arrangements of fluid-actuated devices 1360R, 1360L is positioned above a corresponding hand and arm massage device 1260R, 1260L during operation. The fluid-actuated devices 1360R, 1360L may be airbags, air cells, bags or cells filled with water, gel and the like, any fluid-actuated devices known to one of ordinary skill in the art, and any combination thereof. Preferably, the fluid-actuated devices 1360R, 1360L are airbags or air cells, wherein the airbags or air cells are any applicable airbags or air cells known to one of ordinary skill in the art. As an alternative to an array or arrangement of fluid-actuated devices 1360R, 1360L, a single fluid-actuated device (not shown) of a size that is similar to, substantially similar to, or exactly the same as the size of the entire array or arrangement of fluid-actuated devices 1360R, 1360L may be included in the hands and arms massage apparatus 1201 or other massage apparatuses related to the hand(s) and arm(s) that are disclosed in this application. It is preferred that the fluid-actuated devices 1360R, 1360L are the same or substantially the same as the fluid-actuated devices 1160R, 1160L.

The at least one pressure sensor (not shown) related to fluid-actuated devices 1360R, 1360L is able to measure and determine the pressure applied by the fluid-actuated devices 1360R, 1360L to the user's related body part such that the applied pressure can be maintained, increased or decreased. The at least one pressure sensor can be any pressure sensor known to one of ordinary skill in the art.

In use, with regard to providing massage benefits or effects to the hands and arms of the user U, each of the first or right and second or left hand and arm massage devices 1260R, 1260L can be activated for operation by the hand and arm roller motor 1312R, 1312L activating or powering the hand and arm roller motor gearbox 1310R, 1310L to rotate the fifth or last driving, rotational shaft 1314*e*R, 1314*e*L and system of pulley gears 1297*e*R, 1297*e*L and belt 1298*d*R, 1298*d*L with teeth 1299*d*R, 1299*d*L such that the first, second, third and fourth driving, rotational shafts 1314*a*R, 1314*a*L, 1314*b*R, 1314*b*L, 1314*c*R, 1314*c*L, 1314*d*R, 1314*d*L, larger rollers 1316*a*R, 1316*a*L, 1316*b*R, 1316*b*L, 1316*c*R, 1316*c*L, 1316*d*R, 1316*d*L, and the smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L are also rotated and then able to provide massage benefits or effects to the hands and arms of the user U. Different parts or sections of the hands and arms of the user U are able to receive massage benefits or effects from the smaller rollers 1317*a*R, 1317*a*L, 1317*b*R, 1317*b*L, 1317*c*R, 1317*c*L, 1317*d*R, 1317*d*L of acupressure points 1318*a*R, 1318*a*L, 1318*b*R, 1318*b*L, 1318*c*R, 1318*c*L, 1318*d*R, 1318*d*L. Each of the two arrays or arrangements of fluid-actuated devices 1360R, 1360L provides roller massage intensity control of the massage to the corresponding hand and arm of the user U. As a non-limiting example, more or an increase in air pressure in airbags or air cells 1360R, 1360L will result in more or an increase in roller pressure on the hand and arm of the user U. Air bag pressure or intensity is controlled by square wave, pulse width modulation (PWM) control. The massage intensity provided by the smaller rollers 1317*a*R, 1317*a*L, 1317*b*R, 1317*b*L, 1317*c*R, 1317*c*L, 1317*d*R, 1317*d*L is created by how much the fluid-actuated devices 1360R, 1360L are pushing down on the corresponding hand and/or arm of the user U. The pushing force is controlled by a pulse width modulation of the in-line air valve (not shown).

Referring to FIGS. 41-45 and as an additional aspect of the present invention, the invention is directed to an armrest sliding adjustment apparatus 1451 for allowing at least one massage device directed to the hands, arms, biceps and/or triceps to be adjusted in a linear direction from one position to a second position to accommodate users of different arm lengths, heights, and/or upper body lengths. The armrest sliding adjustment apparatus 1451 may be secured, attached, fastened, fixed or mounted to or about the sides 1406R, 1406L of the seat or bottom body area portion 1404 of the chair frame 1402 of a chair, such as, but not limited to, a massage chair 1400, by screw(s) (not shown), any device(s) known to one of ordinary skill in the art, any method(s) known to one of ordinary skill in the art, or any combination thereof.

Figure 44:
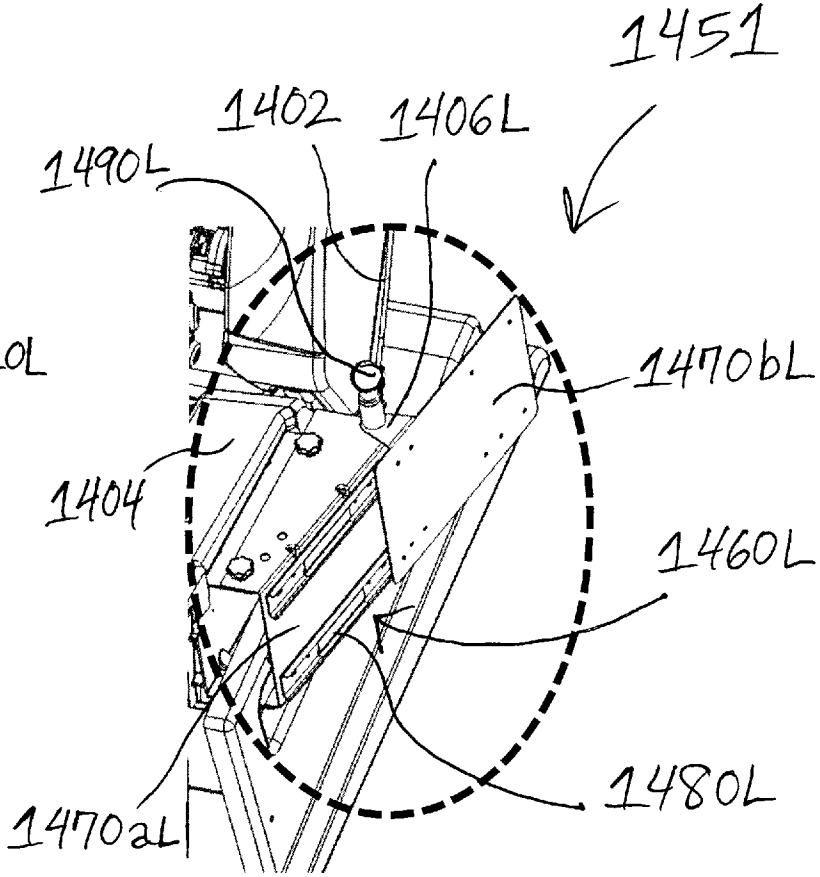
FIG. 44 is a close-up perspective view of the left armrest sliding adjustment device of FIG. 43, wherein the left armrest sliding adjustment device is positioned in another arm panel position.
Figure 43:
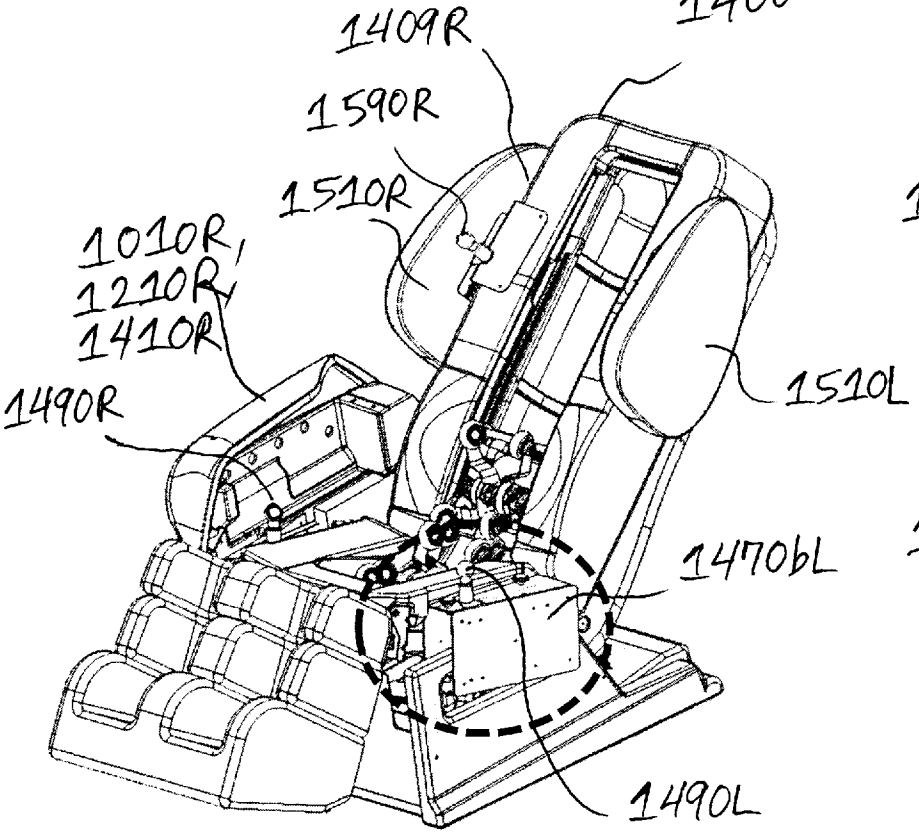
FIG. 43 is a front, left side, perspective view of the massage chair of FIG. 41, wherein the left armrest frame or arm panel has been completely removed to show the components of the left armrest sliding adjustment device, wherein the right armrest frame or arm panel has been partially removed to show some of the components of the right armrest sliding adjustment device, and wherein each of the right and left armrest sliding adjustment devices is positioned in a first, original or starting arm panel position.
Figure 45:
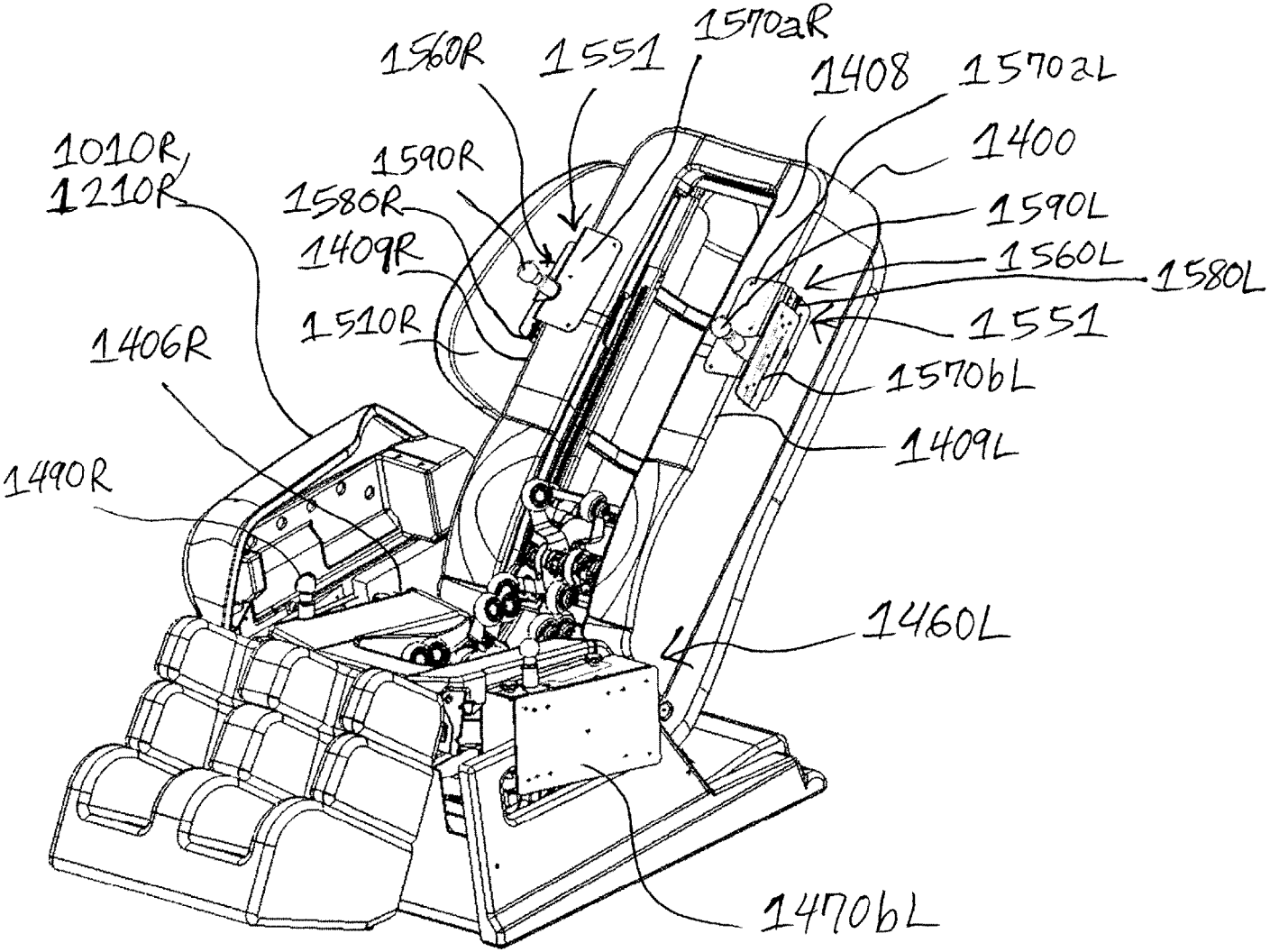
FIG. 45 is a front, left side, perspective view of the massage chair of FIG. 41, wherein the left armrest frame or arm panel has been completely removed to show the components of the left armrest sliding adjustment device, wherein the right armrest frame or arm panel has been partially removed to show some of the components of the right armrest sliding adjustment device, and wherein the left bicep and tricep panel has been completely removed to show the components of the left bicep and tricep panel sliding adjustment device.

As best shown in FIGS. 43-45, the armrest sliding adjustment apparatus 1451 includes a pair of armrest sliding adjustment devices 1460R, 1460L. Each armrest sliding adjustment device 1460R, 1460L includes two plates 1470*a*R, 1470*b*R, 1470*a*L, 1470*b*L, a sliding structure 1480R, 1480L positioned between the two plates 1470*a*R, 1470*b*R, 1470*a*L, 1470*b*L, and a latching device 1490R, 1490L.

As best shown in FIGS. 43-45, the first plate 1470*a*R, 1470*a*L is secured, attached, fastened, fixed or mounted to a corresponding side 1406R, 1406L of the seat or bottom body area portion 1404 of the chair frame 1402 by screw(s) (not shown), any device(s) known to one of ordinary skill in the art, any method(s) known to one of ordinary skill in the art, or any combination thereof, while the second plate 1470*b*R, 1470*b*L is secured, attached, fastened, fixed or mounted to the armrest frame or arm panel 1410R, 1410L by screw(s) (not shown), any device(s) known to one of ordinary skill in the art, any method(s) known to one of ordinary skill in the art, or any combination thereof.

As best shown in FIGS. 43-45, the sliding structure 1480R, 1480L allows the sliding adjustment motion to be able to take place. As a non-limiting example, the sliding structure 1480R, 1480L may be comprised of a female component (such as, but not limited to, a guide rail with a channel) and a male component (such as, but not limited to, an engagement rail) wherein the female component is secured, attached, fastened, fixed or mounted to the first plate 1470*a*R, 1470*a*L while the male component is secured, attached, fastened, fixed or mounted to the second plate 1470*b*R, 1470*b*L. In this non-limiting example, the male component engages with the female component to allow the sliding adjustment motion to be able to take place.

Figure 42:
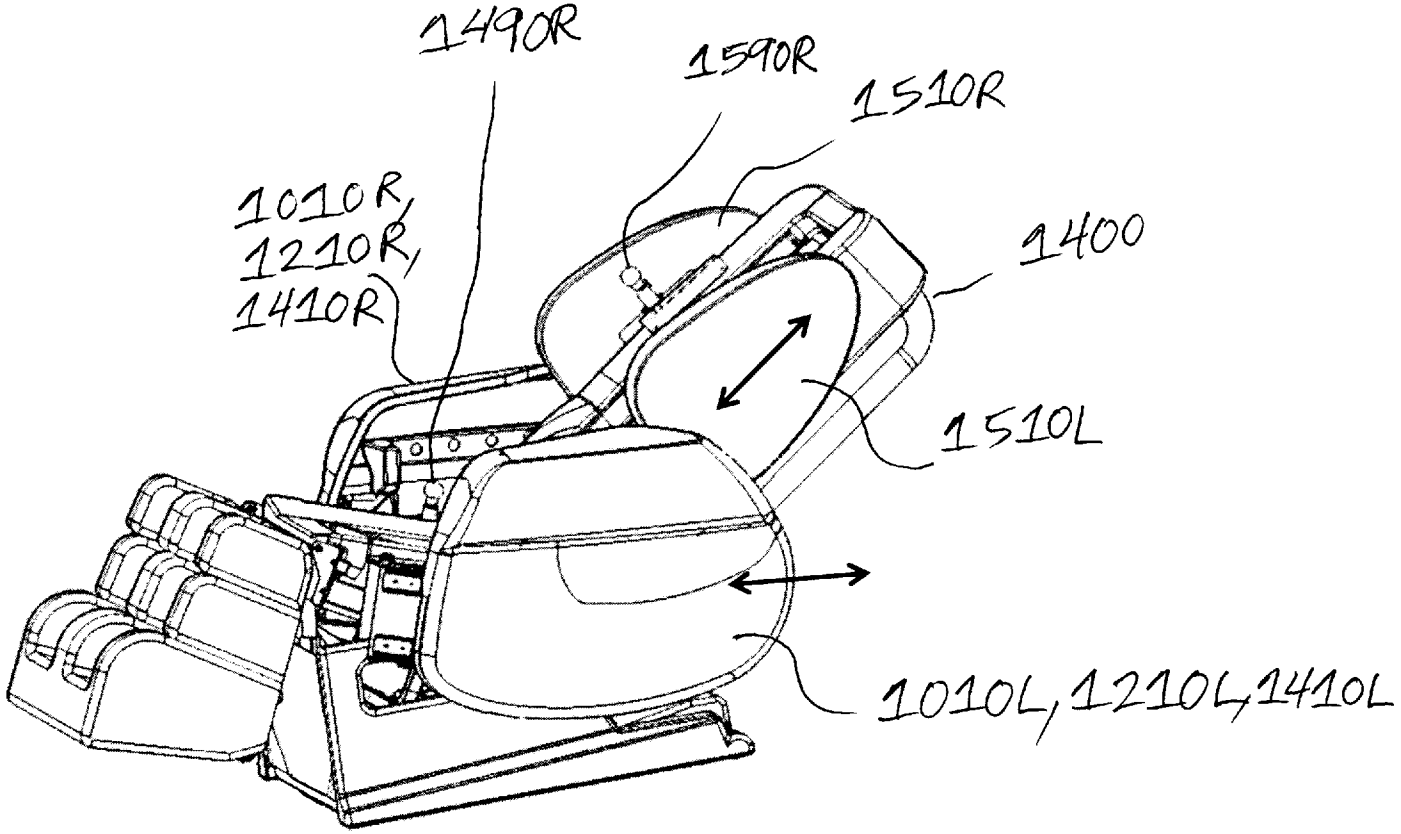
FIG. 42 is a front, left side, perspective view of the massage chair of FIG. 41, wherein right and left armrest frames or arm panels have been slid back for easy user's access for fitting with users of different heights and/or of different upper body lengths, and wherein the armrest sliding adjustment apparatus is positioned in a second or adjusted arm panel position while the bicep and tricep panel sliding adjustment apparatus remains positioned in the first, original or starting bicep and tricep panel position.

As best shown in FIGS. 43-45, the latching device 1490R, 1490L locks the corresponding armrest frame or arm panel 1410R, 1410L to the chair frame 1402. Each of the armrest frames or arm panels 1410R, 1410L is able to be slid and locked or secured in at least two arm panel positions, such as a first, original or starting arm panel position (shown in FIGS. 43 and 45) or another arm panel position (shown in FIG. 44). As shown in FIG. 42, each armrest frame or arm panel 1410R, 1410L is preferably able to be slid back with an opening angle that make the armrest frame or arm panel 1410R, 1410L to come out in a direction that is away from the chair frame 1402. This prevents the armrest frame or arm panel 1410R, 1410L from hitting other chair body parts during movement.

Figure 41:
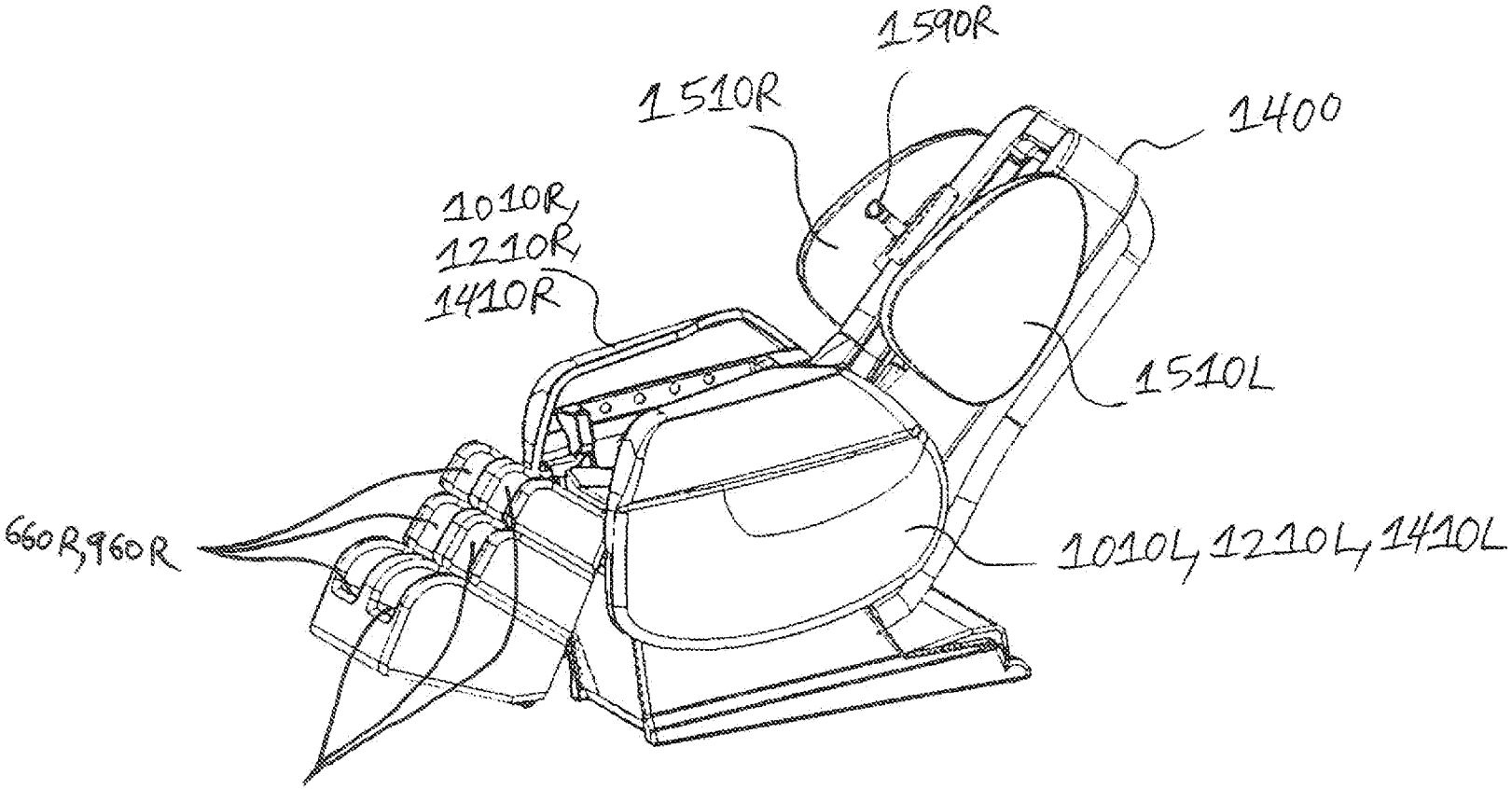
FIG. 41 is a front, left side, perspective view of a massage chair that includes an armrest sliding adjustment apparatus and a bicep and tricep panel sliding adjustment apparatus according to the present invention, wherein the armrest sliding adjustment apparatus is positioned in a first, original or starting arm panel position and the bicep and tricep panel sliding adjustment apparatus is positioned in a first, original or starting bicep and tricep panel position.

FIG. 41 shows a massage chair 1400 that includes both an armrest sliding adjustment apparatus 1451 and a bicep and tricep panel sliding adjustment apparatus 1551. Each of the armrest sliding adjustment apparatus 1451 and bicep and tricep panel sliding adjustment apparatus 1551 is positioned in a first, original or starting arm panel position and a first, original or starting bicep and tricep panel position, respectively.

FIG. 42 shows the massage chair 1400 wherein right and left armrest frames or arm panels 1410R, 1410L have been slid back for easy user's access and for fitting with users of different arm lengths, heights, and/or upper body lengths, and wherein the armrest sliding adjustment apparatus 1451 is positioned in a second or adjusted arm panel position while the bicep and tricep panel sliding adjustment apparatus 1551 remains positioned in the first, original or starting bicep and tricep panel position.

FIG. 43 shows the massage chair 1400, wherein the left armrest frame or arm panel 1410L has been completely removed to show the components of the left armrest sliding adjustment device 1460L, wherein the right armrest frame or arm panel 1410R has been partially removed to show some of the components of the right armrest sliding adjustment device 1460R, and wherein each of the right and left armrest sliding adjustment devices 1460R, 1460L is positioned in the first, original or starting arm panel position and the first, original or starting bicep and tricep panel position, respectively.

FIG. 44 shows a close-up of the left armrest sliding adjustment device 1460L, wherein the left armrest sliding adjustment devices 1460L is positioned in another arm panel position.

FIG. 45 shows the massage chair 1400, wherein the left armrest frame or arm panel 1410L has been completely removed to show the components of the left armrest sliding adjustment device 1460L, wherein the right armrest frame or arm panel 1410R has been partially removed to show some of the components of the right armrest sliding adjustment device 1460R, and wherein the left bicep and tricep panel 1510L has been completely removed to show the components of the left bicep and tricep panel sliding adjustment device 1560L.

Referring to FIGS. 41-43 and 45 and as a further aspect of the present invention, the invention is directed to a bicep and tricep panel sliding adjustment apparatus 1551 for allowing at least one biceps and triceps massage device 1520R, 1520L to be adjusted in a linear direction from one position to a second position to accommodate users of different heights and/or of different upper body lengths. As shown in FIG. 45, the bicep and tricep panel sliding adjustment apparatus 1551 may be secured, attached, fastened, fixed or mounted to or about the sides 1409R, 1409L of the back body area portion 1408 of the chair frame 1402 by screw(s) (not shown), any device(s) known to one of ordinary skill in the art, any method(s) known to one of ordinary skill in the art, or any combination thereof. The at least one biceps and triceps massage device 1520R, 1520L may be comprised of fluid-actuated devices (such as, but not limited to, airbags, air cells, water bags, water cells, gel bags, gel cells, and any combination thereof), any biceps and triceps massage device known to one of ordinary skill in the art, or any combination thereof.

As best shown in FIGS. 43 and 45, the bicep and tricep panel sliding adjustment apparatus 1551 includes a pair of bicep and tricep panel sliding adjustment devices 1560R, 1560L. Each bicep and tricep panel sliding adjustment device 1560R, 1560L includes two plates 1570*a*R, 1570*b*R, 1570*a*L, 1570*b*L, a sliding structure 1580R, 1580L positioned between the two plates 1570*a*R, 1570*b*R, 1570*a*L, 1570*b*L, and a latching device 1590R, 1590L.

As best shown in FIGS. 41-43 and 45, the first plate 1570*a*R, 1570*a*L is secured, attached, fastened, fixed or mounted to a corresponding side 1409R, 1409L of the back body area portion 1408 of the chair frame 1402 by screw(s) (not shown), any device(s) known to one of ordinary skill in the art, any method(s) known to one of ordinary skill in the art, or any combination thereof, while the second plate 1570*b*R, 1570*b*L is secured, attached, fastened, fixed or mounted to the bicep and tricep panel 1510R, 1510L by screw(s) (not shown), any device(s) known to one of ordinary skill in the art, any method(s) known to one of ordinary skill in the art, or any combination thereof.

As best shown in FIG. 45, the sliding structure 1580R, 1580L allows the sliding adjustment motion to be able to take place. As a non-limiting example, the sliding structure 1580R, 1580L may be comprised of a female component 1582R, 1582L (such as, but not limited to, a guide rail with a channel) and a male component 1584R, 1584L (such as, but not limited to, an engagement rail) wherein the female component 1582R, 1582L is secured, attached, fastened, fixed or mounted to the first plate 1570*a*R, 1570*a*L while the male component 1584R, 1584L is secured, attached, fastened, fixed or mounted to the second plate 1570*b*R, 1570*b*L. In this non-limiting example, the male component 1584R, 1584L engages with the female component 1582R, 1582L to allow the sliding adjustment motion to be able to take place.

As best shown in FIGS. 41-43 and 45, the latching device 1590R, 1590L locks the corresponding bicep and tricep panel 1510R, 1510L to the chair frame 1402. Each of the bicep and tricep panel 1510R, 1510L is able to be slid and locked or secured in at least two bicep and tricep panel positions, such as a first, original or starting bicep and tricep panel position (shown in FIGS. 41-43 and 45) or another bicep and tricep panel position (not shown). As shown in FIG. 42, each bicep and tricep panel 1510R, 1510L is preferably able to be slid back and upward.

Figure 48:
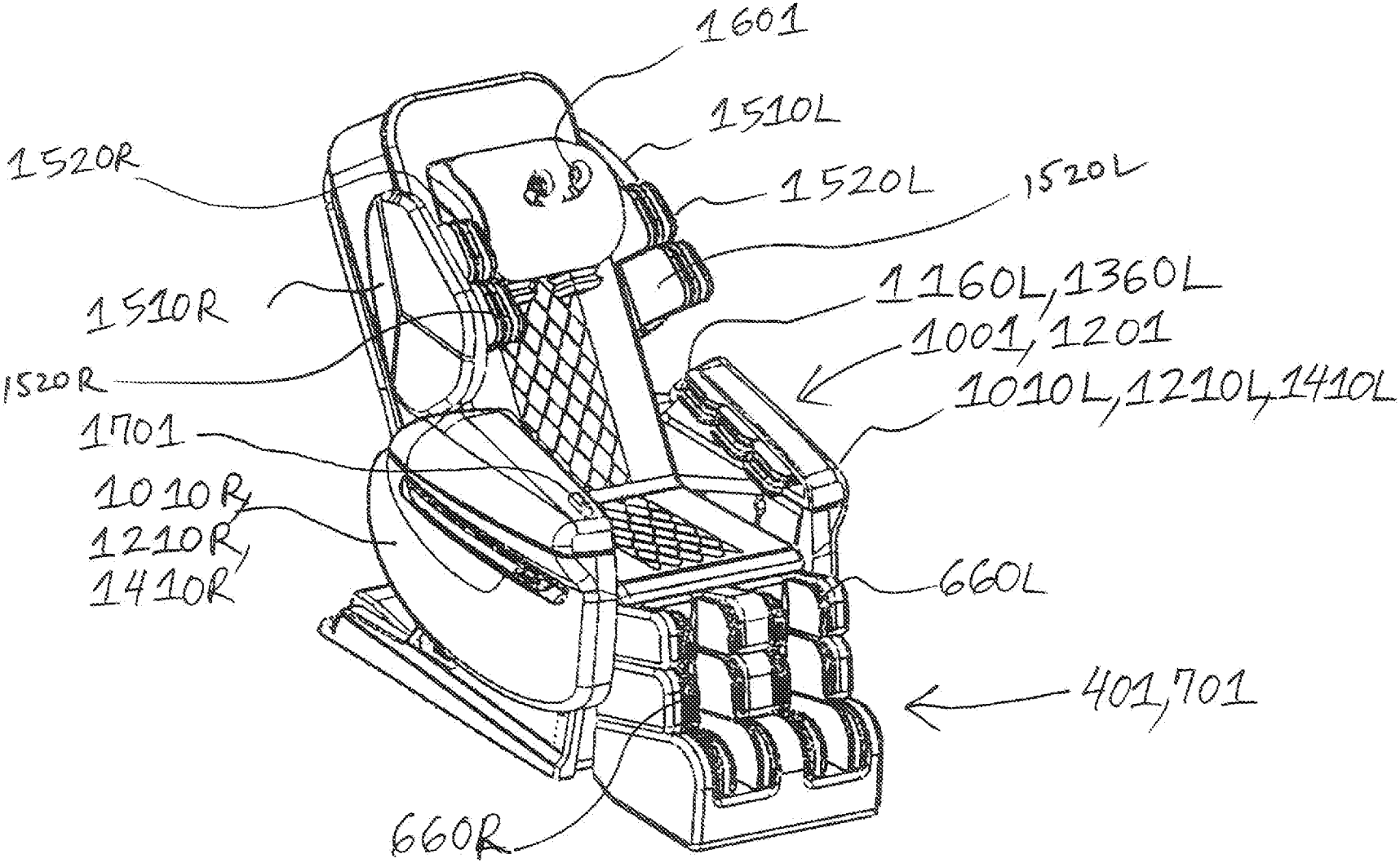
FIG. 48 is a front, right side, perspective view of a massage chair according to the present invention.

Referring to FIG. 48 and as an additional aspect of the present invention, the invention is directed to a chair, such as, but not limited to, a massage chair 1900, that comprises at least one of the following: the legs and feet massage apparatus 401 or 701 (the first embodiment or any of the related embodiments; which comprises an array of rollers (not shown) driven by a gear motor(s) to rotate in circular motion, and also comprises fluid-actuated device(s) 660R, 660L, 960R, 960L to control the massage intensity); the hands and arms massage apparatus 1001 or 1201 (the first embodiment or any of the related embodiments; which comprises a linear sliding mechanism (not shown) that allow a user to slide the arm back and forth for easy user access); the armrest sliding adjustment apparatus 1451; the bicep and tricep panel sliding adjustment apparatus 1551 (which comprises a linear sliding mechanism (not shown) that allows a user to adjust the at least one massage device directed to the biceps and triceps from a first, original or starting bicep and tricep panel position (shown in FIGS. 41-43 and 45) to another bicep and tricep panel position (not shown); a neck and shoulder massage system 1601; and an integrated smart medical device 1701.

As best shown in FIG. 48, the neck and shoulder massage system 1601 is preferably positioned at neck and shoulder body areas of the chair frame (not shown) such that it can effectively provide massage effects or benefits to the neck and shoulder body portion area of the user U. The neck and shoulder massage system 1601 may be any applicable neck and shoulder massage system known to one of ordinary skill in the art.

As best shown in FIG. 48, the integrated smart medical device 1701 is preferably able to measure blood pressure, heart rate, and body temperature from the user's finger tip skin. The integrated smart medical device 1701 preferably also includes a window to measure blood sugar level, stress level, and oxygen level. The user's health data may be displayed on a device screen or on the massage chair controller or both. The integrated smart medical device 1701 is connected to the massage chair MC via wire, wifi, or bluetooth.

Figure 49:
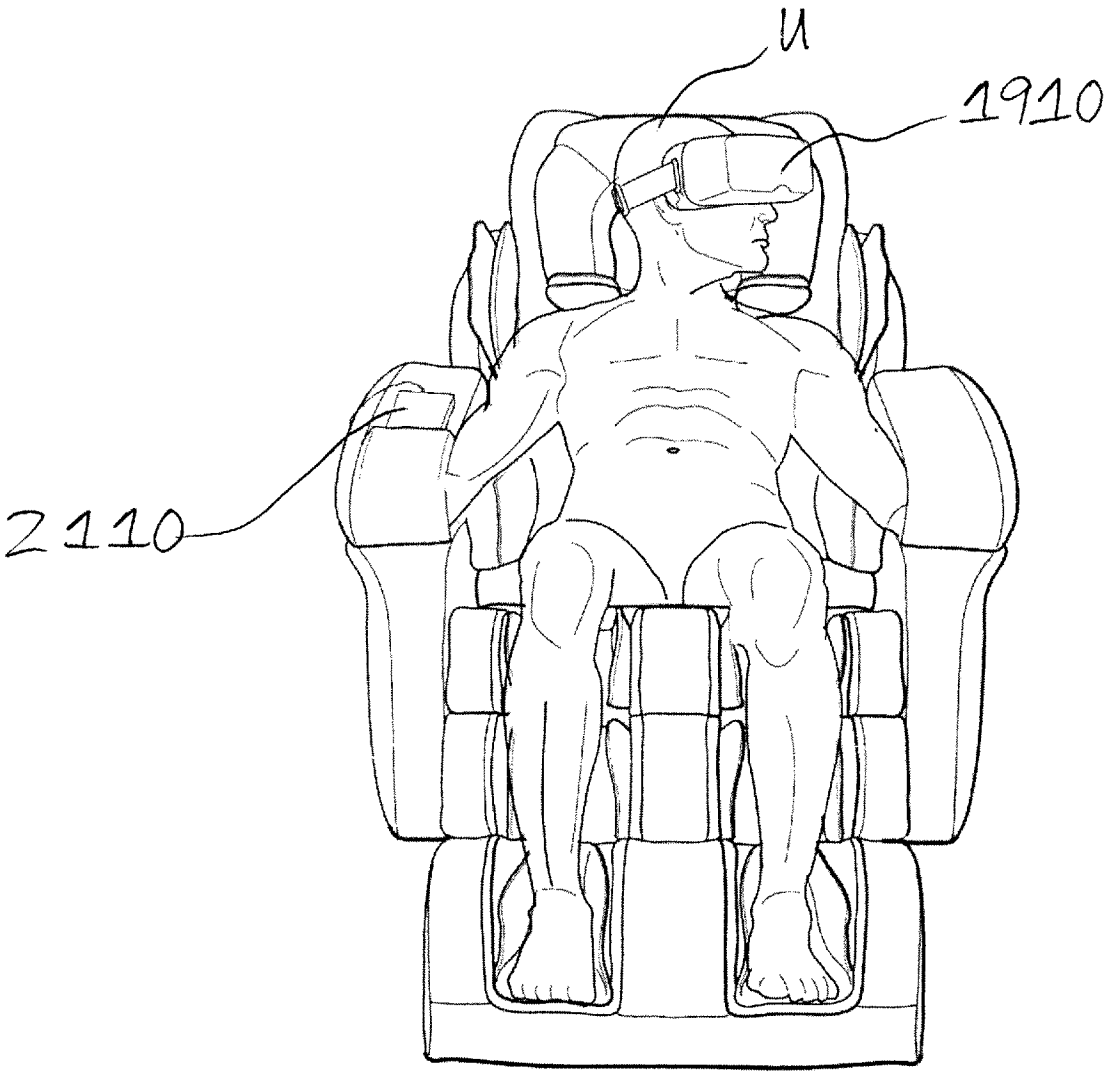
FIG. 49 is a front, environmental view of a massage chair according to the present invention.

With regard to FIG. 49, a chair, such as, but not limited to, the massage chair 1900, may comprise or additionally comprise a virtual reality device 1910. The virtual reality device (VRD) 1910 may be any VRD known to one of ordinary skill in the art.

Referring to FIGS. 50-59, the functions and performance of any massage chair MC (such as, but not limited to, massage chair 1900) described and/or shown in this application, and/or the components (such as, but not limited to, legs and feet massage apparatus 401, 701; hands and arms massage apparatus 1001, 1201; armrest sliding adjustment apparatus 1451; bicep and tricep panel sliding adjustment apparatus 1551; neck and shoulder massage system 1601; integrated smart medical device 1701; and virtual reality device 1910) described and/or shown in this application may be performed, carried out or controlled by a touchscreen-based control device or system, such as, but not limited to, touchscreen-based control system 2100.

The touchscreen-based control system 2100 allows a user of a massage chair to gain access to providable information by selecting various selectable selections and tabs, such as, but not limited to, the modes of massages; massage intensity settings, chair position settings, chair heat settings and any combination(s) thereof; the Internet; songs; radio stations; etc., with the use of one or more fingers of the user.

In a preferred and non-limiting embodiment of an aspect of the present invention, the touchscreen-based control system 2100 includes a touchscreen device 2110 in operative communication with the massage chair MC.

As best shown in FIGS. 50, 51 and 54-59, touchscreen device 2110 preferably comprises a housing 2112, a protective layer or surface 2113, a touch-sensitive layer or surface 2114, a touch controller 2116, a processor or operating system 2118, a display controller 2120, a display layer or surface 2122, a main controller printed circuit board (PCB) or motherboard 2123, software, software program or application (app) 2124 comprising providable information that may be provided to a user in response to touch inputs from the user, and software, software program or application (app) 2126 in operative communication with the massage chair 1900. The touchscreen device 2110 may be an LCD touchscreen device, an LED touchscreen device, or any other type of touchscreen device known to one of ordinary skill in the art.

Figure 50:
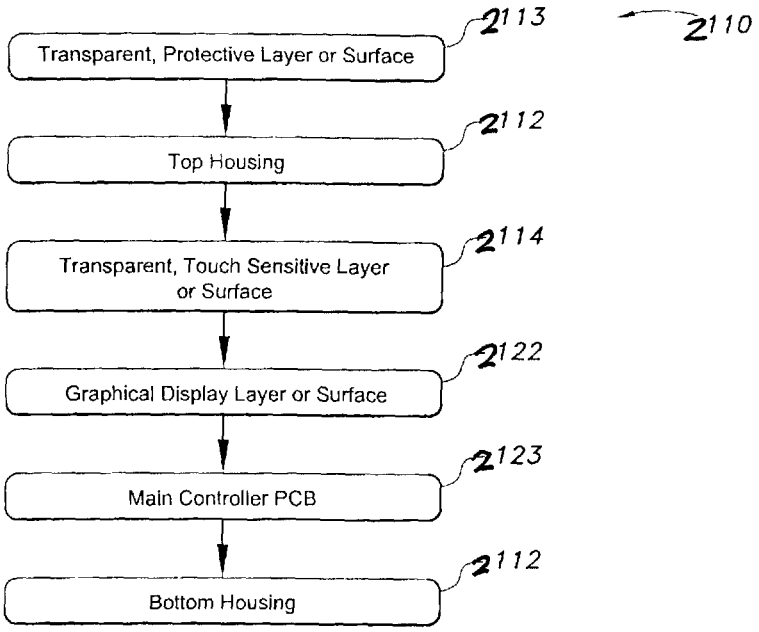
FIG. 50 is a block diagram of a non-limiting example of a hardware assembly of a touchscreen device of a touchscreen-based control system according to the present invention.
Figure 59:
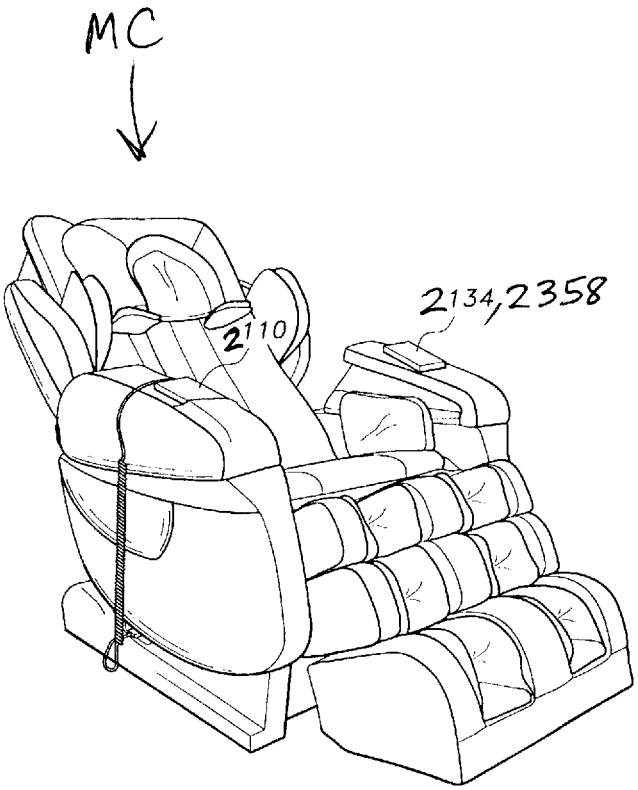
FIG. 59 is an environmental, perspective view of a touchscreen-based control system according to the present invention, showing a touchscreen device and a remote control.

As best shown in FIGS. 50 and 59, the housing 2112 preferably houses most or all of the components of the touchscreen device 2110. The housing 2112 may be any housing known to one of ordinary skill in the art.

As best shown in FIGS. 50 and 54-58, the protective layer or surface 2113 protects the touch-sensitive layer or surface 2114 and possibly other components housed in the touchscreen device 2110 from damage or breakage arising from scratches, device drops, fluid spills, etc. For best effectiveness, it is preferred that the protective layer or surface 2113 is a transparent, protective layer or surface. The transparent, protective layer or surface 2113 may be any transparent, protective layer or surface known to one of ordinary skill in the art.

As best shown in FIGS. 50 and 54-58, the touch-sensitive layer or surface 2114 receives touch inputs from the user (not shown) to communicate with the massage chair MC whereby the massage chair MC communicates with a massage device (not shown) of the massage chair MC to provide massage effects to the user. For best effectiveness, it is preferred that the touch-sensitive layer or surface 2114 is a transparent, touch-sensitive layer or surface. The transparent, touch-sensitive layer or surface 2114 may be any transparent, touch-sensitive layer or surface known to one of ordinary skill in the art.

Figure 51:
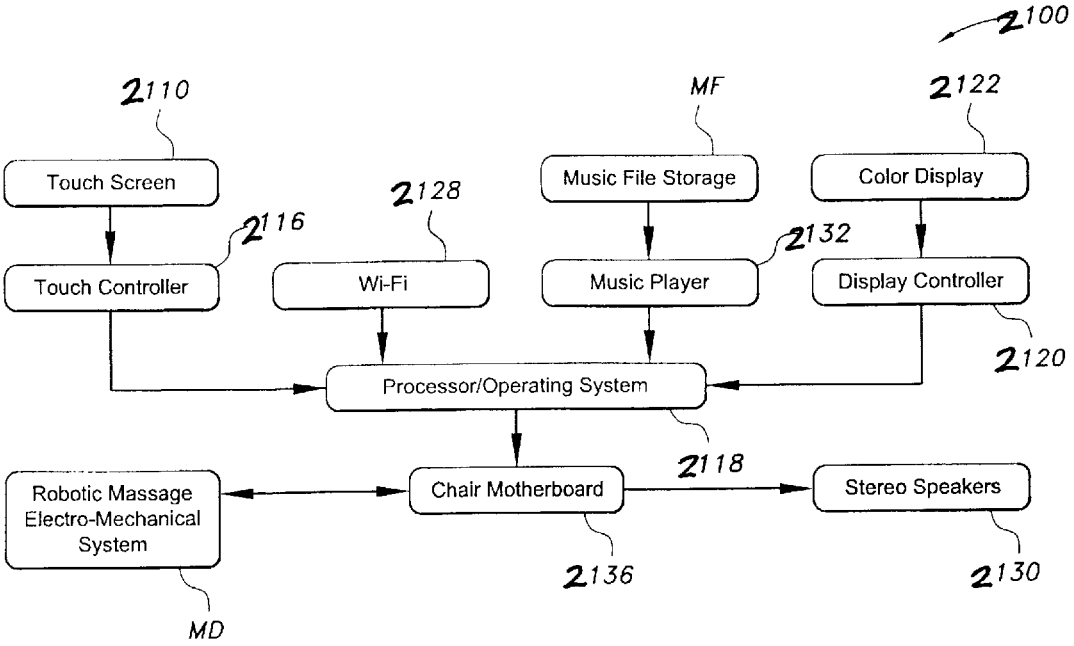
FIG. 51 is a block diagram of a non-limiting example of a hardware system of a touchscreen-based control system according to the present invention, showing the touchscreen-based control system in communication with a massage chair.

As best shown in FIG. 51, the touch controller 2116 identifies touch inputs from the user. The touch controller 2116 may be any touch controller known to one of ordinary skill in the art.

As best shown in FIG. 51, the processor 2118 processes the touch inputs and operatively communicates with the display controller 2120. The processor 2118 may be any processor or operating system known to one of ordinary skill in the art.

As best shown in FIG. 51, the display controller 2120 generates video signals of the selected information and/or selected selection SI to be displayed on the display surface 2122. The display controller 2120 may be any display controller known to one of ordinary skill in the art.

As best shown in FIGS. 54-58, the display layer or surface 2122 displays the selected information and/or selected selection SI that were derived from the touch inputs. Preferably, the display layer or surface 2122 is a graphical display layer or surface. The display layer or surface 2122 may be any display layer or surface known to one of ordinary skill in the art.

As best shown in FIG. 50, the main controller printed circuit board (PCB) or motherboard 2123 may be any main controller printed circuit board (PCB) or motherboard known to one of ordinary skill in the art.

Figure 52:
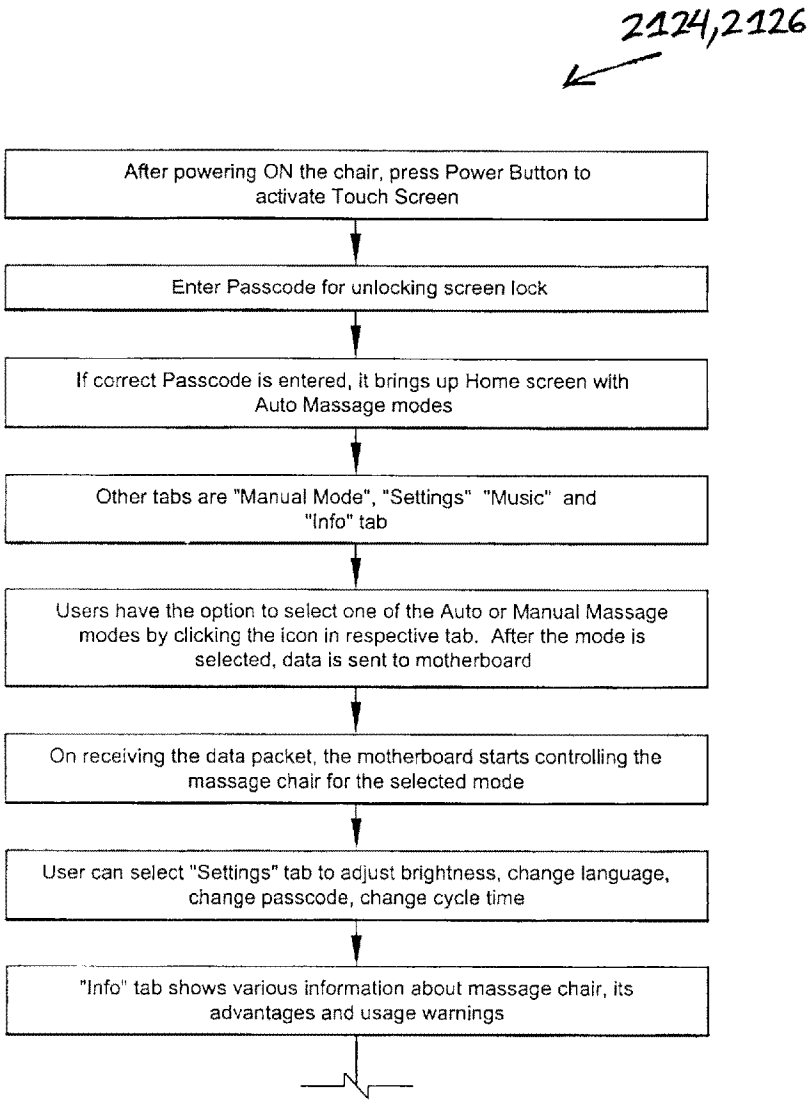
FIG. 52 is a partial flow chart (first portion) of a non-limiting example of a method or process performed by a software system or program of a touchscreen-based control system according to the present invention.
Figure 53:
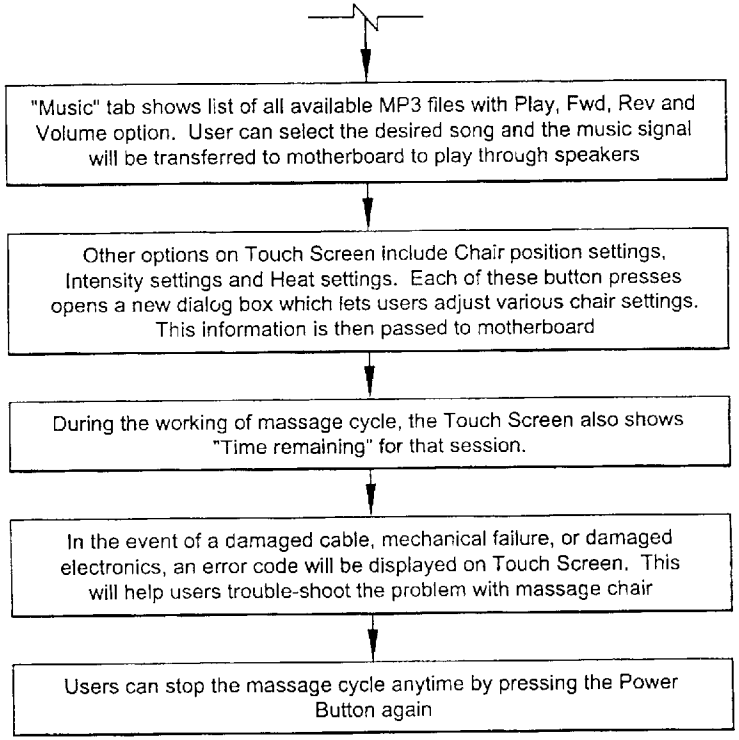
FIG. 53 is a partial flow chart (second portion) of a non-limiting example of a method or process performed by a software system or program of the touchscreen-based control system of FIG. 52, completing the partial flow chart shown in FIG. 52.

As best shown in FIGS. 52 and 53, the software 2124 comprises providable information that may be provided to a user in response to touch inputs from the user.

As best shown in FIGS. 52 and 53, the software 2126 in operative communication with the massage chair MC effectuates the massage chair MC to communicate with the massage device to provide massage effects to the user in response to the touch inputs.

For simplicity purposes, software 2124 and software 2126 may be combined into a single software, software program or application (app).

As best shown in FIGS. 54-58, the providable information preferably is accessed and selected by the user through the user's touch inputs of the applicable selectable selections SS and tabs T1, T2, T3, T4, T5. The providable information preferably includes a plurality of selectable massage intensity settings, chair position settings, chair heat settings, and any combination(s) thereof (via applicable selectable selections SS); at least an "Auto" ("Automatic") mode (via the "Auto" tab T1) of massage and a "Manual" mode (via the "Manual" tab T2) of massage; health-related information (via the "Info" tab T5); a plurality of songs stored in a music file MF (via the "Music" tab T4); chair and safety related information (via the "Info" tab T5); and settings (via the "Settings" tab T3) related information, such as, but not limited to, brightness of the display, language of the providable information, passcode, and cycle time. Preferably, certain selectable selections SS, such as the modes of massages; massage pressure levels; massage intensity settings, chair position settings, chair heat settings and any combination(s) thereof; songs; and radio stations, that a user may select are predetermined selections. When the Internet is accessible, then the providable information may also include some, most or all of the information that can be accessed via the Internet.

The touchscreen-based control system 2100 or the touchscreen device 2110 may further include a device for providing Internet access 2128, at least one speaker 2130, a music player 2132, and a remote control 2134 that is in operative communication with the massage chair MC.

As best shown in FIG. 51, the device for providing Internet access 2128, preferably via Wi-Fi, allows the user to browse, surf or access the Internet, play games, play music, upgrade system software, etc. Alternatively, the device for providing Internet access 2128 may be any known technology or device known to one of ordinary skill in the art.

As best shown in FIG. 51, the at least one speaker 2130 is preferably stereo speakers, and may be integrated within the touchscreen device 2110, integrated within the massage chair MC, or a separate component. The at least one speaker 2130 may be any speaker(s) known to one of ordinary skill in the art.

As best shown in FIG. 51, the music player 2132 may be integrated within the touchscreen device 2110, integrated within the massage chair MC, or a separate component. The music player 2132 may be any music player known to one of ordinary skill in the art.

The remote control 2134 may also be used by the user to communicate with the massage chair MC to effectuate desired results. Preferably, the remote control 2134 communicates with the massage chair MC via a chair motherboard 2136. The remote control 2134 may be any remote control known to one of ordinary skill in the art that can operatively communicate with the massage chair MC.

FIG. 50 shows a block diagram of a non-limiting example of a hardware assembly of the touchscreen device 2110 of the touchscreen-based control system 2100. Preferably, the protective layer or surface 2113 is positioned proximately to the top portion of the housing 2112 and above the touch-sensitive layer or surface 2114; the touch-sensitive surface 2114 is positioned above the display layer or surface 2122; the display layer or surface 2122 is positioned above the motherboard 2123; and the motherboard 2123 is positioned about the bottom portion of the housing 2112.

FIG. 51 shows a block diagram of a non-limiting example of a hardware system of the touchscreen-based control system 2100, which is in communication with a massage chair MC.

FIG. 52 shows a partial flow chart (first portion) of a non-limiting example of a method or process performed by a software system or program 2124, 2126 of the touch-screen-based control system 2100.

FIG. 53 shows a partial flow chart (second portion) of a non-limiting example of a method or process performed by the software system or program 2124, 2126 of the touch-screen-based control system 2100, completing the partial flow chart shown in FIG. 52.

Figure 54:
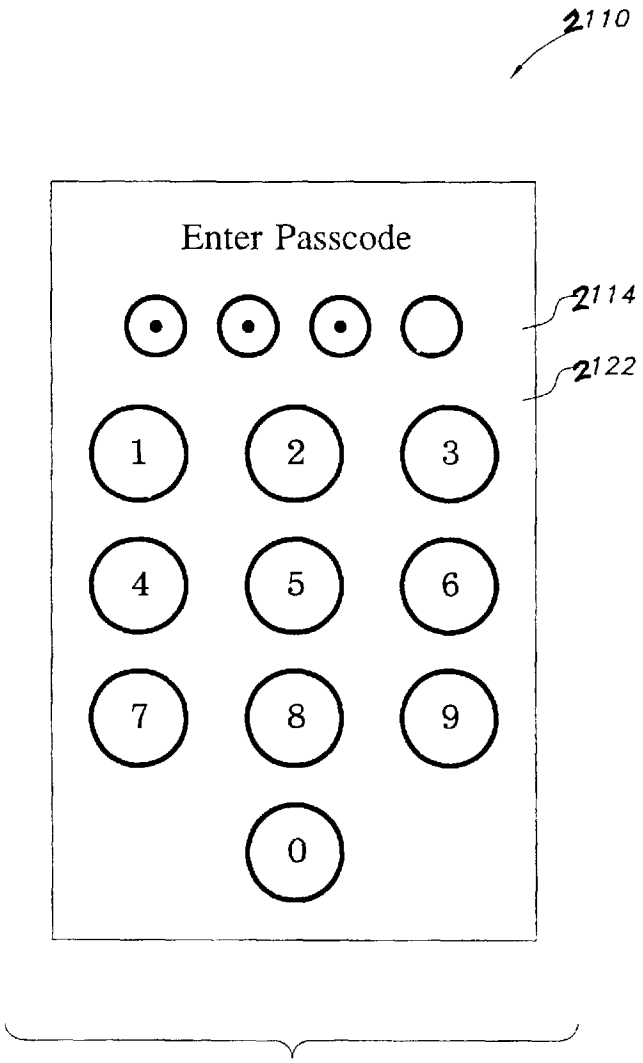
FIG. 54 is a front view of a touchscreen device of a touchscreen-based control system according to the present invention, showing a non-limiting example of an "Enter Passcode" screen page.

FIG. 54 shows touchscreen device 2110 of the touch-screen-based control system 2100, wherein a non-limiting example of an "Enter Passcode" screen page.

Figure 55:
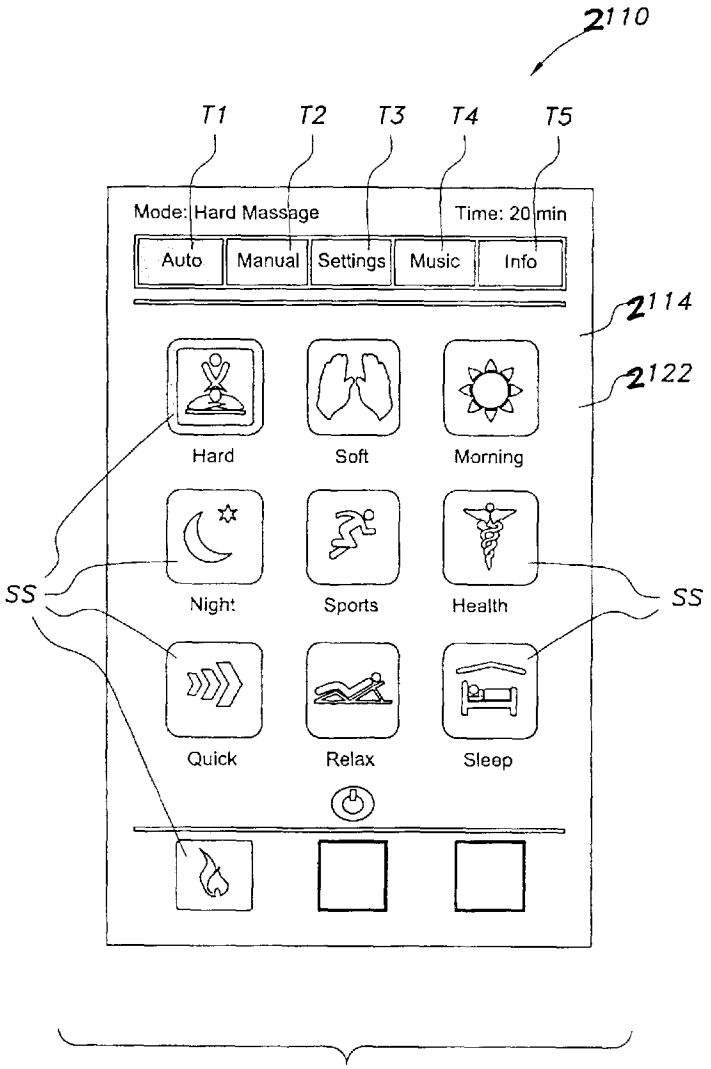
FIG. 55 is a front view of a touchscreen device of a touchscreen-based control system according to the present invention, showing a non-limiting example of a screen page where a user may select selectable selections provided on the screen page.

FIG. 55 shows touchscreen device 2110 of the touch-screen-based control system 2100, wherein a non-limiting example of a screen page where a user may select selectable selections provided on the screen page.

Figure 56:
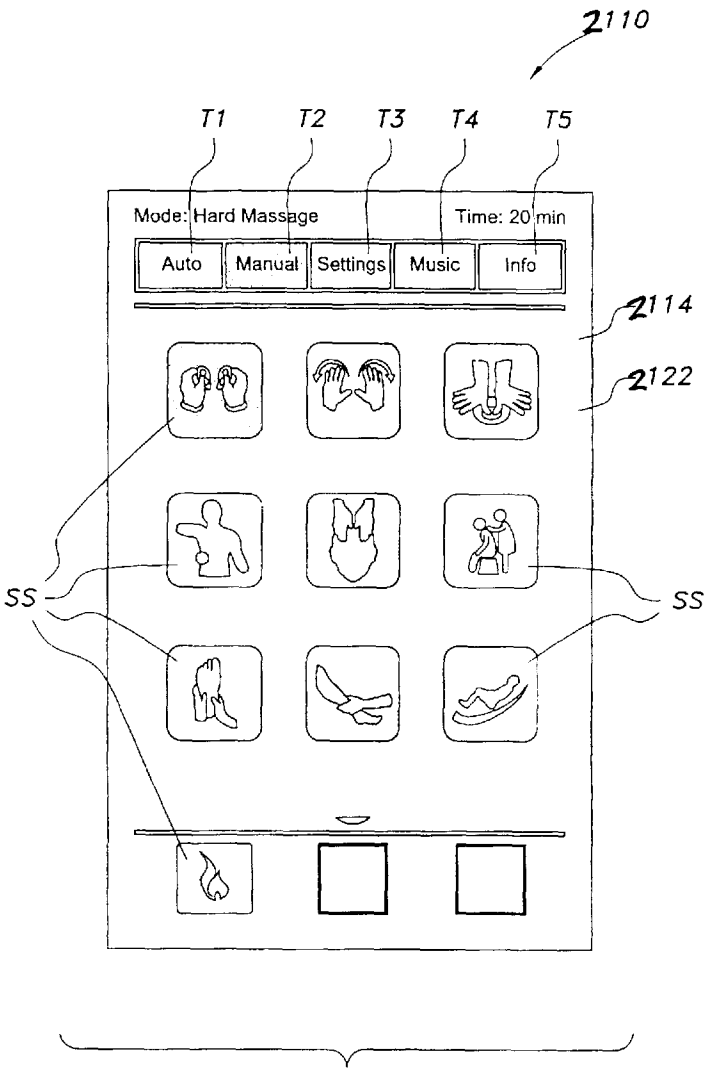
FIG. 56 is a front view of a touchscreen device of a touchscreen-based control system according to the present invention, showing a non-limiting example of another screen page where a user may select selectable selections provided on the screen page.

FIG. 56 shows touchscreen device 2110 of the touch-screen-based control system 2100, wherein a non-limiting example of another screen page where a user may select selectable selections provided on the screen page.

Figure 57:
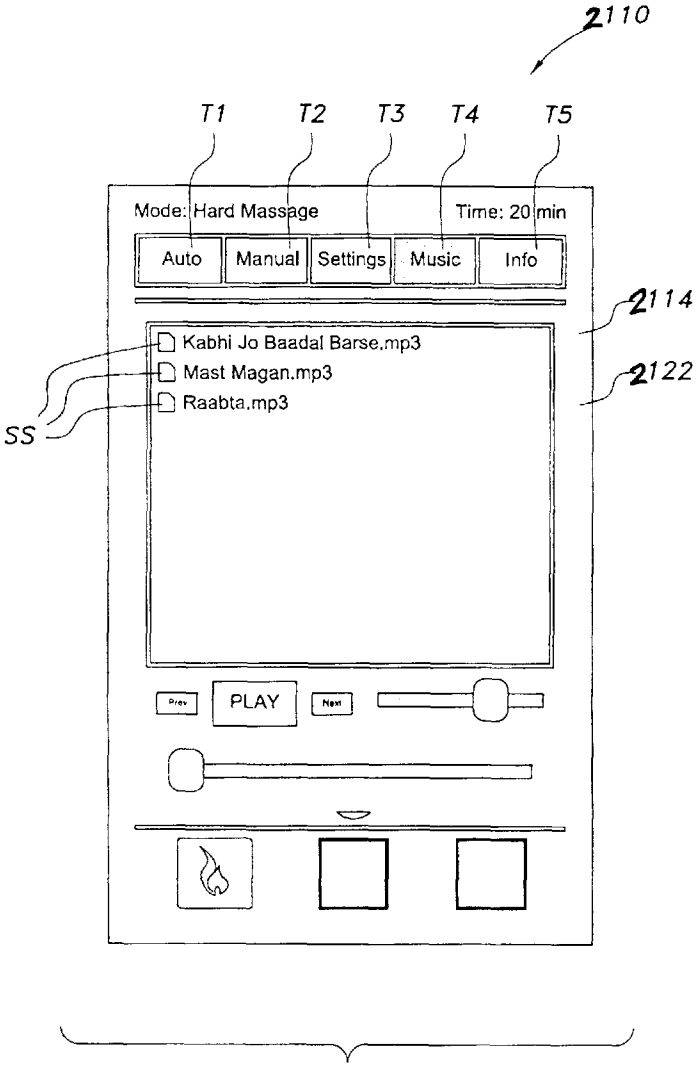
FIG. 57 is a front view of a touchscreen device of a touchscreen-based control system according to the present invention, showing a non-limiting example of an a further screen page where a user may select selectable selections provided on the screen page.

FIG. 57 shows touchscreen device 2110 of the touch-screen-based control system 2100, wherein a non-limiting example of an a further screen page where a user may select selectable selections provided on the screen page.

Figure 58:
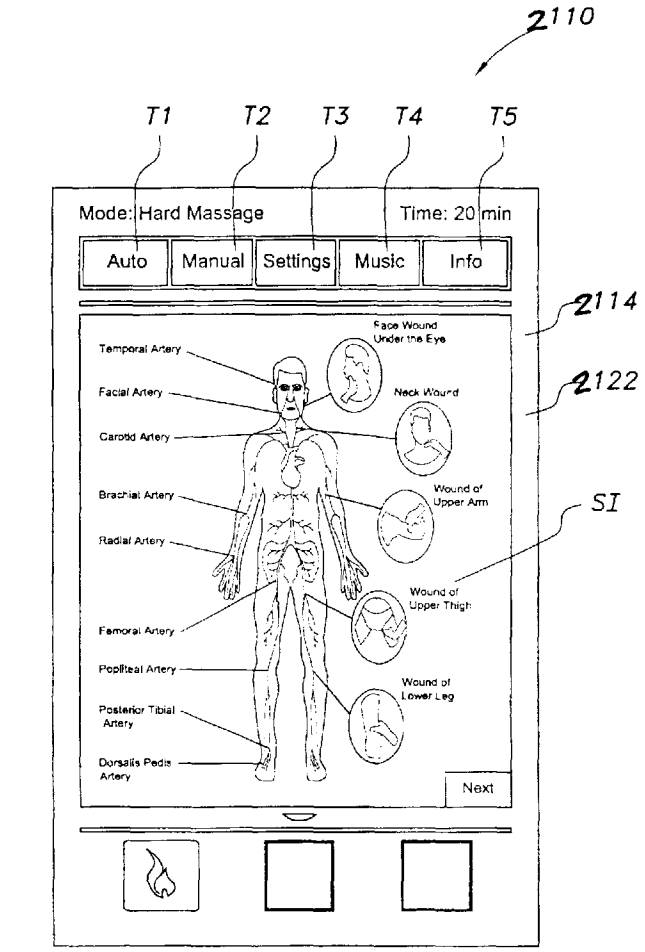
FIG. 58 is a front view of a touchscreen device of a touchscreen-based control system according to the present invention, showing a non-limiting example of an additional screen page where a user may obtain and/or view provideable information shown on the screen page.

FIG. 58 shows touchscreen device 2110 of the touch-screen-based control system 2100, wherein a non-limiting example of an additional screen page where a user may obtain and/or view provideable information shown on the screen page.

FIG. 59 shows touchscreen device 2110 and remote control 2134 of the touchscreen-based control system 2100.

Figure 46:
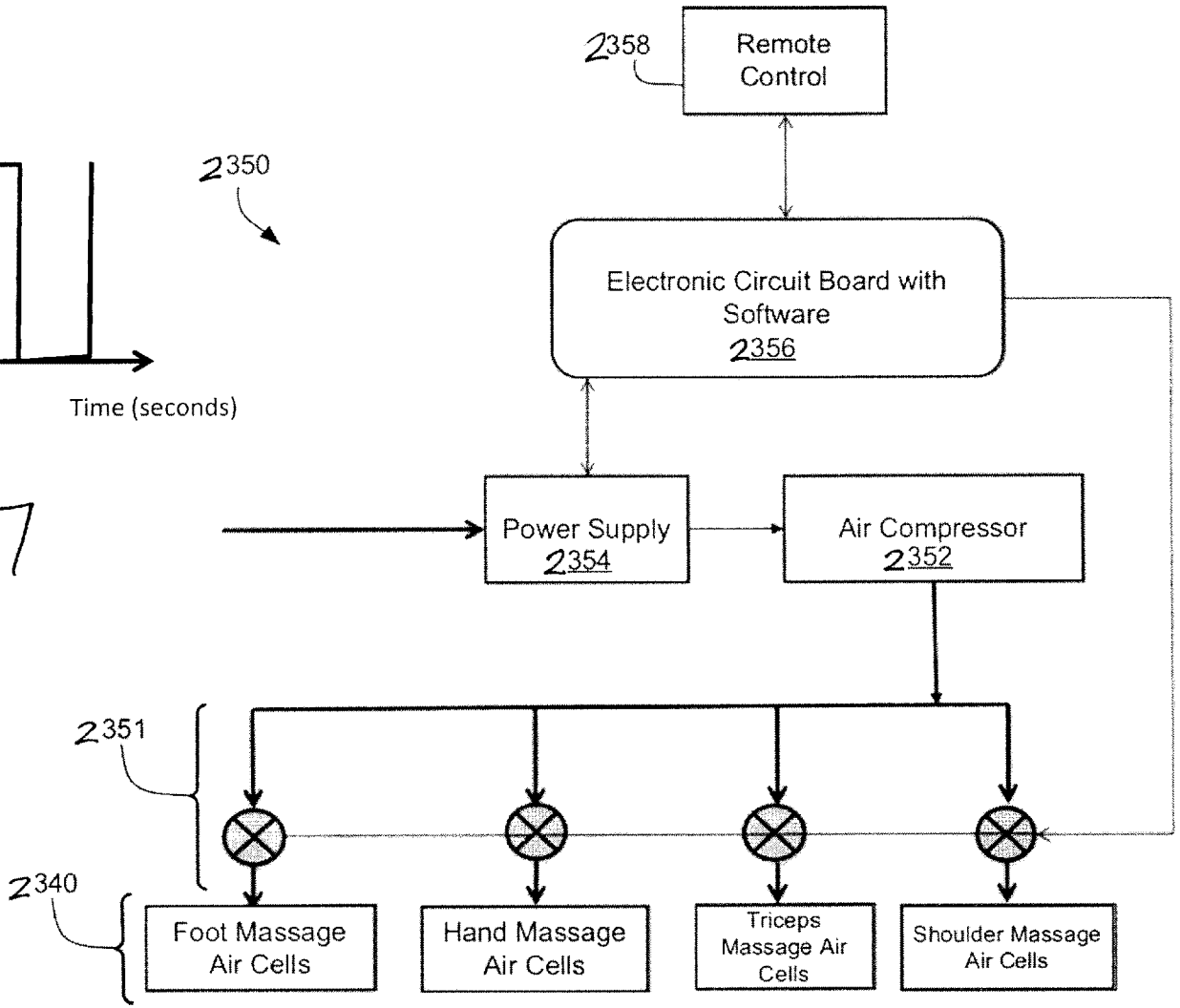
FIG. 46 is a block diagram of an embodiment of air cells control.

FIG. 46 shows a block diagram of an embodiment of a system of air cells control.

In an embodiment, the system 2350 preferably includes at least one air compressor 2352, a power supply 2354, a master control board (MCB) or electronic circuit board with software 2356, and a remote control 2358 (or touchscreen device 2110 of the touchscreen-based control system 2100).

The at least one air compressor 2352 is operable to pump air massage pressure to desired locations in a massage chair MC so as to provide a user of the massage chair MC with air pressure massage to at least one of the feet, hands, triceps, biceps, and/or shoulders. The at least one air compressor 2352 is adapted for receiving a power supply voltage having a first frequency from a power supply 2354. The at least one air compressor 2352 may be any air compressor known to one of ordinary skill in the art.

The power supply 2354 may be any power supply known to one of ordinary skill in the art.

The master control board (MCB) or electronic circuit board with software 2356 is adapted for regulating the valves 2351 from which pressure are transferred to and from fluid-actuated devices 2340 (such as, but not limited to, airbags, air cells, water bags, water cells, gel bags, gel cells, and any combination thereof) directed to the massage of the feet, hands, triceps, biceps, and/or shoulders. The master control board (MCB) or electronic circuit board with software 2356 may be any electronic circuit board with software known to one of ordinary skill in the art.

Figure 47:
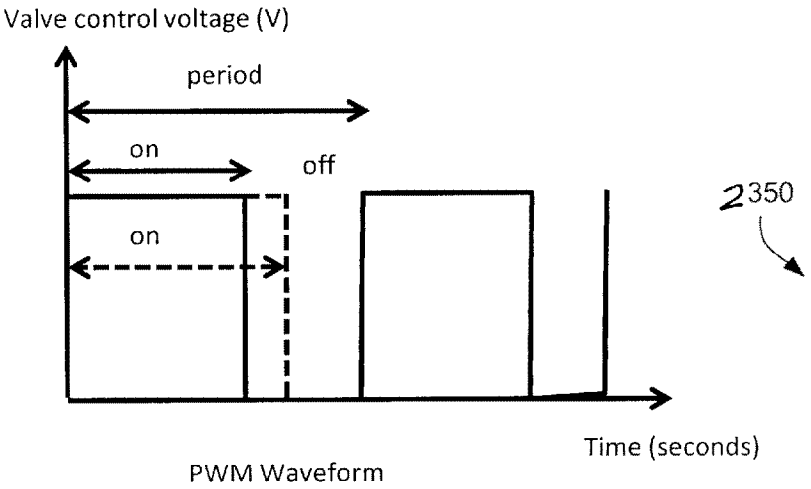
FIG. 47 is a graph showing air pressure being controlled by square wave, pulse width modulation (PWM), wherein the varying of the ratio of valve control on time over the off time affect air cell pressure.

FIG. 47 shows a graph of air pressure being control by square wave, pulse width modulation (PWM). The varying of the ratio of valve control on time over the off time affect air cell pressure.

It is to be understood that the present invention is not limited to the embodiments described above or as shown in the attached figures, but encompasses any and all embodiments within the spirit of the invention.

What is claimed is:

1. A massage chair comprising:

a chair frame; and a legs and feet massage apparatus mounted to said chair frame for providing massage effects to legs and feet of a user, wherein said legs and feet massage apparatus comprises a frame, a motor, a motor gearbox, at least one calf massage rotational shaft, at least one calf massage roller set supported by said frame, and at least one air-actuated device, wherein said at least one calf massage roller set comprises at least one calf massage roller that is operationally connected with said at least one calf massage rotational shaft and that is rotated by said motor and said motor gearbox, wherein said at least one calf massage roller moves in a circular motion around an axis of said at least one calf massage rotational shaft, wherein said at least one air-actuated device comprises at least one aircell located in proximity to said at least one calf massage roller for controlling massage intensity of said at least one calf massage roller to the user, and wherein more air being provided to said at least one aircell will generate more calf massage roller intensity being applied to the user.

2. The massage chair according to claim 1, wherein at least one aircell of said at least one aircell that controls intensity of said at least one calf massage roller is controlled by square wave PWM control.

3. The massage chair according to claim 1, wherein said intensity of said at least one calf massage roller is configured to be selected by the user via a touchscreen-based control device input.

4. The massage chair according to claim 1, further comprising a foot detection sensor located on bottom of said frame of said legs and feet massage apparatus to detect feet of the user and extend said frame of said legs and feet massage apparatus to fit length of the user.

5. The massage chair according to claim 4, wherein said foot detection sensor is operationally connected to an input of micro controller with embedded software to monitor state of said foot detection sensor and extend a frame actuator accordingly.

6. The massage chair according to claim 1, further comprising a sliding adjustment for triceps and biceps to accommodate size of the user.

7. The massage chair according to claim 1, further comprising a feet massage device that comprises at least one massage plate, at least one circular-to-linear motion translator, at least one foot massage roller set, and at least one raised accupressure point.

8. The massage chair according to claim 7, wherein said at least one foot massage roller set comprises at least one feet massage roller that moves in a circular motion around an axis of at least one foot massage rotational shaft.

9. A massage chair comprising:

a chair frame; and a legs and feet massage apparatus mounted to said chair frame for providing massage effects to legs and feet of a user, wherein said legs and feet massage apparatus comprises a frame, a motor, a motor gearbox, at least one foot massage rotational shaft, at least one feet massage device supported by said frame, and at least one air-actuated device, wherein said at least one feet massage device comprises at least one massage plate and at least one raised accupressure point which extends directly from an upper surface of the at least one massage plate, wherein said at least one massage plate is operationally connected to said at least one foot massage rotational shaft via at least one circular-to-linear motion translator, wherein said at least one air-actuated device comprises at least one aircell located in proximity to said at least one feet massage device for controlling massage intensity of said at least one feet massage device to the user, and wherein more air being provided to said at least one aircell will generate more feet massage device intensity being applied to the user.

10. The massage chair according to claim 9, wherein at least one aircell of said at least one aircell that controls intensity of said at least one raised accupressure point is controlled by square wave PWM control.

11. The massage chair according to claim 9, wherein said intensity of said at least one feet massage device is configured to be selected by the user via a touchscreen-based control device input.

12. The massage chair according to claim 9, further comprising a foot detection sensor located on bottom of said frame of said legs and feet massage apparatus to detect feet of the user and extend said frame of said legs and feet massage apparatus to fit length of the user.

13. The massage chair according to claim 9, wherein said at least one feet massage device further comprises at least one foot massage roller that is operationally connected with said at least one foot massage rotational shaft and that is rotated by said motor and said motor gearbox, and wherein said at least one foot massage roller moves in a circular motion around an axis of said at least one foot massage rotational shaft.

14. The massage chair according to claim 9, further comprising at least one calf massage roller set that comprises at least one calf massage roller that is operationally connected with at least one calf massage rotational shaft and that is rotated by a calf massage motor and a calf massage motor gearbox, wherein said at least one calf massage roller moves in a circular motion around an axis of said at least one calf massage rotational shaft.

15. The massage chair according to claim 9, wherein heat is applied to at least one of said at least one raised accupressure point and said at least one raised accupressure point to provide more massage effect to the user.

16. A massage chair comprising:

a chair frame; and a hands and arms massage apparatus mounted to said chair frame for providing massage effects to hands and arms of a user, wherein said hands and arms massage apparatus comprises a frame, a motor, a motor gearbox, at least one hand and arm rotational shaft, at least one hand and arm massage roller set supported by said frame, and at least one air-actuated device, wherein said at least one hand and arm massage roller set comprises at least one hand and arm massage roller that is operationally connected with said at least one hand and arm rotational shaft and that is rotated by said motor and said motor gearbox, wherein said at least one hand and arm massage roller moves in a circular motion around an axis of said at least one hand and arm massage rotational shaft, wherein said at least one air-actuated device comprises at least one aircell located in proximity to said at least one hand and arm massage roller for controlling massage intensity of said at least one hand and arm massage roller to the user, and wherein more air being provided to said at least one aircell will generate more hand and arm massage roller intensity being applied to the user.

17. The massage chair according to claim 16, wherein at least one of said at least one aircell that controls intentsity of said at least one hand and arm massage roller is controlled by square wave PWM control.

18. The massage chair according to claim 16, wherein said intensity of said at least one hand and arm massage roller is configured to be selected by the user via a touchscreen-based control device input.

19. The massage chair according to claim 16, wherein said hand and arm massage apparatus further comprises a sliding adjustment for armrest to accommodate different hand and arm lengths of users.

20. The massage chair according to claim 16, further comprises a sliding adjustment for triceps and biceps to accommodate user size.

21. The massage chair according to claim 16, wherein heat is applied to said at least one hand and arm massage roller to provide more massage effect to the user.

22. The massage chair according to claim 16, wherein said hands and arms massage apparatus further comprises a smart medical device for measuring blood pressure, heart rate, blood sugar, stress level, oxygen level, and body temperature from finger tip skin of the user.

23. A massage chair comprising:

a chair frame; and a hands and arms massage apparatus mounted to said chair frame for providing massage effects to hands and arms of a user, wherein said hands and arms massage apparatus comprises a frame, a motor, a motor gearbox, at least one hand and arm rotational shaft, at least one hand and arm massage device supported by said frame, and at least one air-actuated device, wherein said at least one hand and arm massage device comprises at least one massage plate and at least one raised accupressure point which extends directly from an upper surface of the at least one massage plate, wherein said at least one massage plate is operationally connected to said at least one hand and arm rotational shaft via at least one circular-to-linear motion translator, wherein said at least one air-actuated device comprises at least one aircell located in proximity to said at least one hand and arm massage device for controlling massage intensity of said at least one hand and arm massage device to the user, and wherein more air being provided to said at least one aircell will generate more hand and arm massage device intensity being applied to the user.

24. The massage chair according to claim 23, at least one of said at least one aircell that controls intentsity of said at least one raised accupressure point is controlled by square wave PWM control.

25. The massage chair according to claim 23, wherein said intensity of said at least one hand and arm massage device is configured to be selected by the user via a touchscreen-based control device input.

26. The massage chair according to claim 23, wherein said hands and arms massage apparatus further comprises a sliding adjustment for armrest to accommodate different hand and arm lengths of users.

27. The massage chair according to claim 23, further comprising a sliding adjustment for triceps and biceps to accommodate user size.

28. The massage chair according to claim 23, wherein heat is applied to said at least one raised accupressure point to provide more massage effect to the user.

29. The massage chair according to claim 23, wherein said hands and arms massage apparatus further comprises a smart medical device for measuring blood pressure, heart rate, blood sugar, stress level, oxygen level, and body temperature from finger tip skin of the user.

30. The massage chair according to claim 23, wherein said at least one hand and arm massage device further comprises at least one hand and arm massage roller operationally connected with said at least one hand and arm rotational shaft and that is rotated by said motor and said motor gearbox, and wherein said at least one hand and arm massage roller moves in a circular motion around an axis of said at least one hand and arm rotational shaft.

* * * * *